US006104895A

United States Patent [19]

Yokomori et al.

[11] Patent Number: 6,104,895

[45] Date of Patent: Aug. 15, 2000

[54] DEVELOPING CARTRIDGE SIDE COVER, MOUNTING METHOD THEREOF AND DEVELOPING CARTRIDGE

[75] Inventors: Kanji Yokomori, Odawara; Kazuhiko Kanno, Numazu; Susumu Nittani, Shizuoka-ken, all of Japan

[73] Assignee: Canon Kabushiki Kaisha, Tokyo, Japan

[21] Appl. No.: 09/109,037

[22] Filed: Jul. 2, 1998

[30] Foreign Application Priority Data

Jul. 3, 1997 [JP] Japan ..... 195030/1997
Jul. 1, 1998 [JP] Japan ..... 186154/1998

[51] Int. Cl.[7] ..... G03G 21/18

[52] U.S. Cl. ..... 399/113; 399/106

[58] Field of Search ..... 399/106, 119, 399/227, 262, 111, 113, 114; 29/469

[56] References Cited

U.S. PATENT DOCUMENTS 4,974,023 11/1990 Aimoto et al. ..... 399/119
5,202,728 4/1993 Maeshima et al. ..... 399/114
5,283,619 2/1994 Nomura et al. ..... 355/261
5,701,562 12/1997 Araki et al. ..... 399/265
5,729,796 3/1998 Miura et al. ..... 399/114
5,815,782 9/1998 Yokomori et al. ..... 399/285

*Primary Examiner*—Joan Pendegrass
*Attorney, Agent, or Firm*—Fitzpatrick, Cella, Harper & Scinto

[57] ABSTRACT

A side cover for a developing cartridge for developing a latent image formed on an electrophotographic photosensitive member, the developing cartridge being detachably mountable relative to electrophotographic image forming apparatus, the developing cartridge including a developing roller, for developing a latent image formed on an electrophotographic photosensitive member; a toner accommodating portion for accommodating toner to be used for development by the developing roller, the toner accommodating portion being provided with a toner supply opening for supplying the accommodated toner to the developing roller; and A toner seal for sealing the toner supply opening, the toner seal being pulled out prior to start of use of the developing cartridge, by which the toner supply opening is unsealed to permit supply of the toner accommodated in the toner accommodating portion to the developing roller, the side cover, includes a shaft support portion for rotatably supporting a shaft at one end of the developing roller; a toner seal opening for directing the toner seal to outside when a toner supply opening of the toner accommodating portion is opened.

32 Claims, 44 Drawing Sheets

DEVELOPING CARTRIDGE SIDE COVER, MOUNTING METHOD THEREOF AND DEVELOPING CARTRIDGE

FIELD OF THE INVENTION AND RELATED ART

The present invention relates to a developing cartridge for developing a latent image formed on a electrophotographic photosensitive member when an image is formed on a recording material through an electrophotographic image forming process, and an electrophotographic image forming apparatus using the developing cartridge. Here, the electrophotographic image forming apparatus means an apparatus which forms images on recording medium, using an electrophotographic image forming process. It includes an electrophotographic copying machine, an electrophotographic printer (for example, LED printer, laser beam printer) an electrophotographic facsimile machine, an electrophotographic word processor, and the like.

Here, the developing cartridge is a cartridge which contains as a unit a developing member for developing an electrostatic latent image formed on an electrophotographic photosensitive member with toner and a toner accommodating portion for accommodating toner, said cartridge being detachably mountable to a main assembly of an electrophotographic image forming apparatus.

A conventional structure of an apparatus for forming a multi-color image through an electrophotographic process, includes a rotary type selection mechanism (developing rotary or turret) loaded with plurality of developing cartridges accommodating different color developers (toner). The developing cartridge accommodating the proper color developer is opposed to the photosensitive drum, and develops the image with the developer therein, and then, the developed image is transferred onto a recording material. By effecting the developing and transferring operations for each color, a multi-color image is formed. This method has been proposed. In such an image forming apparatus, the developing cartridge may be in the form of a unit or cartridge detachably mountable relative to the main assembly of the image forming apparatus. The developing cartridge may be exchanged by the user. By doing so, the maintenance operation of the main assembly of the apparatus is eased.

When the developing cartridge is mounted to the main assembly of the image forming apparatus, the developing cartridge is inserted into the main assembly in the direction of the rotation axial direction of the developing roller at a predetermined position, since then, the area of the mounting opening of the main assembly for permitting the mounting and demounting of the cartridge is minimized.

In such as said structure, the developing cartridge is required to be driven at a position opposing to the photosensitive drum. To accomplish this, a drive transmission gear is stationarily provided in the main assembly of the apparatus, and is connected with a driving force receiving member on the developing cartridge to transmit the driving force when the developing cartridge is moved to the position opposing to the photosensitive drum.

Such a developing cartridge is constituted by a developing frame supporting a developing member such as a developing roller or an application roller, and a toner frame accommodating the toner and coupled with the developing frame (cartridge frame structure), and then, the size of the developing cartridge is small.

The developing cartridge is provided with a shutter for covering the developing roller when the developing cartridge is out of the main assembly, and for exposing, when it is mounted to the main assembly of the image forming apparatus, a part of the developing roller (exposed portion). There is provided a flexible sealing member for sealing between the shutter and the cartridge frame when the shutter is closed, Such a developing cartridge is provided with remaining toner amount detecting means for detecting a remaining amount of the toner accommodated therein.

In order to establish a circuit for supplying a developing bias to the developing roller when the developing cartridge is mounted to the developing rotary, there are provided contacts on the developing cartridge and the developing rotary which are contactable to each other.

Such developing cartridges have the same structure and dimensions irrespective of the color of the toner therein, and to correctly position them on the developing rotary, the developing cartridges are provided with information indicative of the color.

In order to supply the toner accommodated in the toner accommodating portion toward the developing member prior to the start of the use of the developing cartridge, the developing cartridge is provided with a toner seal for hermetically separating the developing member and the toner accommodating portion before start of use, and the toner seal is pulled out by the user when it is used.

SUMMARY OF THE INVENTION

Accordingly, it is a principal object of the present invention to provide a developing cartridge side cover, a mounting method thereof and a developing cartridge having the developing cartridge side cover, which is effective to downsize the cartridge.

It is another object of the present invention to provide a developing cartridge side cover, a mounting method thereof, and a developing cartridge having the developing cartridge side cover, which is effective to reduce the number of parts.

It is a further object of the present invention to provide a developing cartridge side cover, a mounting method thereof, and a developing cartridge having a developing cartridge side cover, wherein a toner seal pulling direction can be regulated.

It is a further object of the present invention to provide a developing cartridge side cover, a mounting method thereof, and a developing cartridge having the developing cartridge side cover.

According to an aspect of the present invention, there is provided a side cover for a developing cartridge for developing a latent image formed on an electrophotographic photosensitive member, said developing cartridge being detachably mountable relative to an electrophotographic image forming apparatus, said developing cartridge including a developing roller, for developing a latent image formed on an electrophotographic photosensitive member; a toner accommodating portion for accommodating toner to be used for development by said developing roller, the toner accommodating portion being provided with a toner supply opening for supplying the accommodated toner to said developing roller; and A toner seal for sealing said toner supply opening, said toner seal being pulled out prior to start of use of said developing cartridge, by which said toner supply opening is unsealed to permit supply of the toner accommodated in said toner accommodating portion to said developing roller, said side cover, comprising a shaft support portion for rotatably supporting a shaft at one end of said developing roller; a toner seal opening for directing said toner seal to outside when a toner supply opening of said toner accommodating portion is opened.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

EMBODIMENTS

Next, the development cartridge in the preferred embodiment of the present invention, and an electrophotographic image forming apparatus (hereinafter, image forming apparatus) compatible with this development cartridge, will be described.

In the following description, "longitudinal direction" means such a direction that is approximately perpendicular to the direction in which recording medium is conveyed, and also that is approximately parallel to the surface of the recording medium being conveyed.

Embodiment 1

Figure 1:
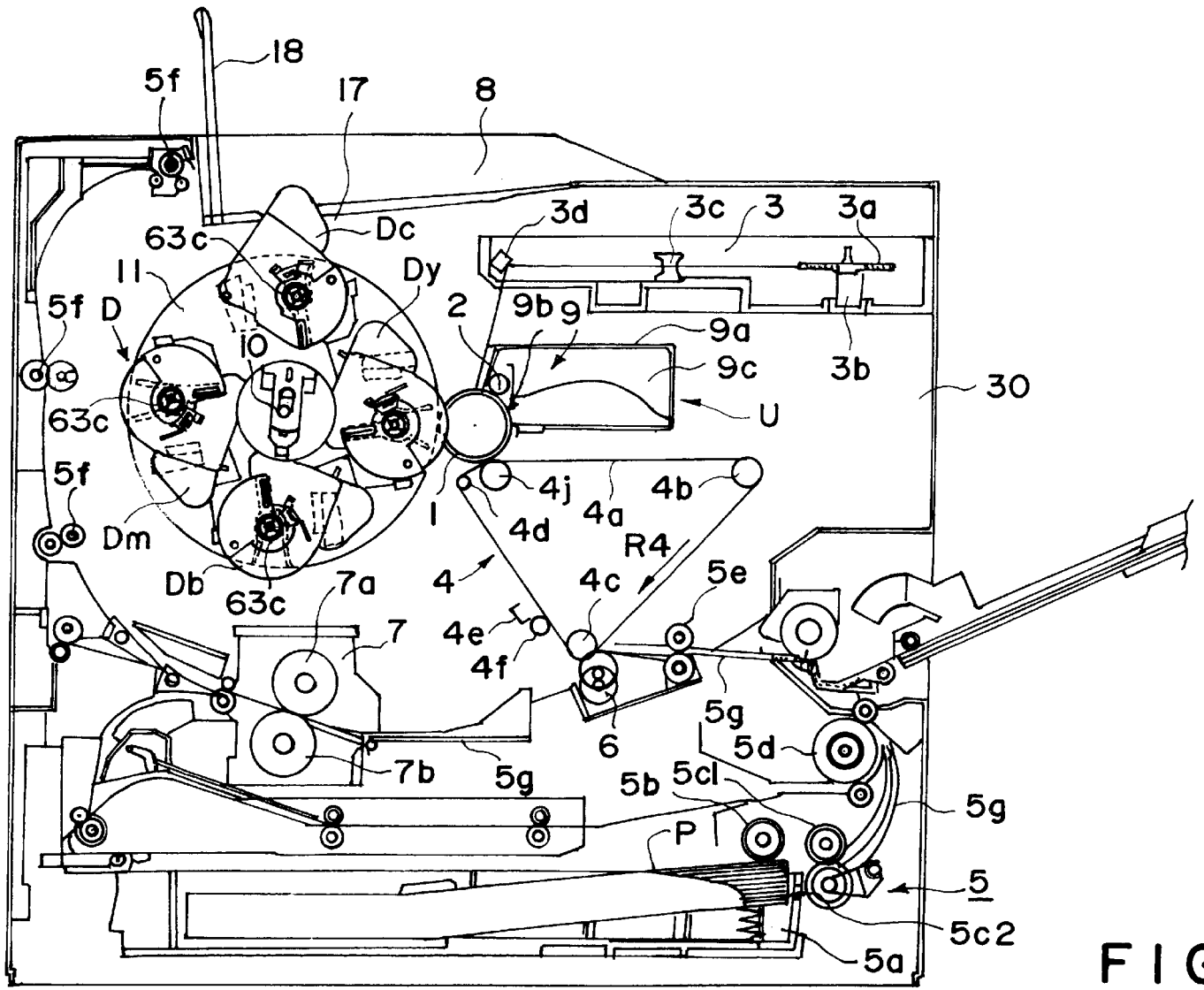
FIG. 1 is a longitudinal sectional view of an electrophotographic image forming apparatus.
Figure 2:
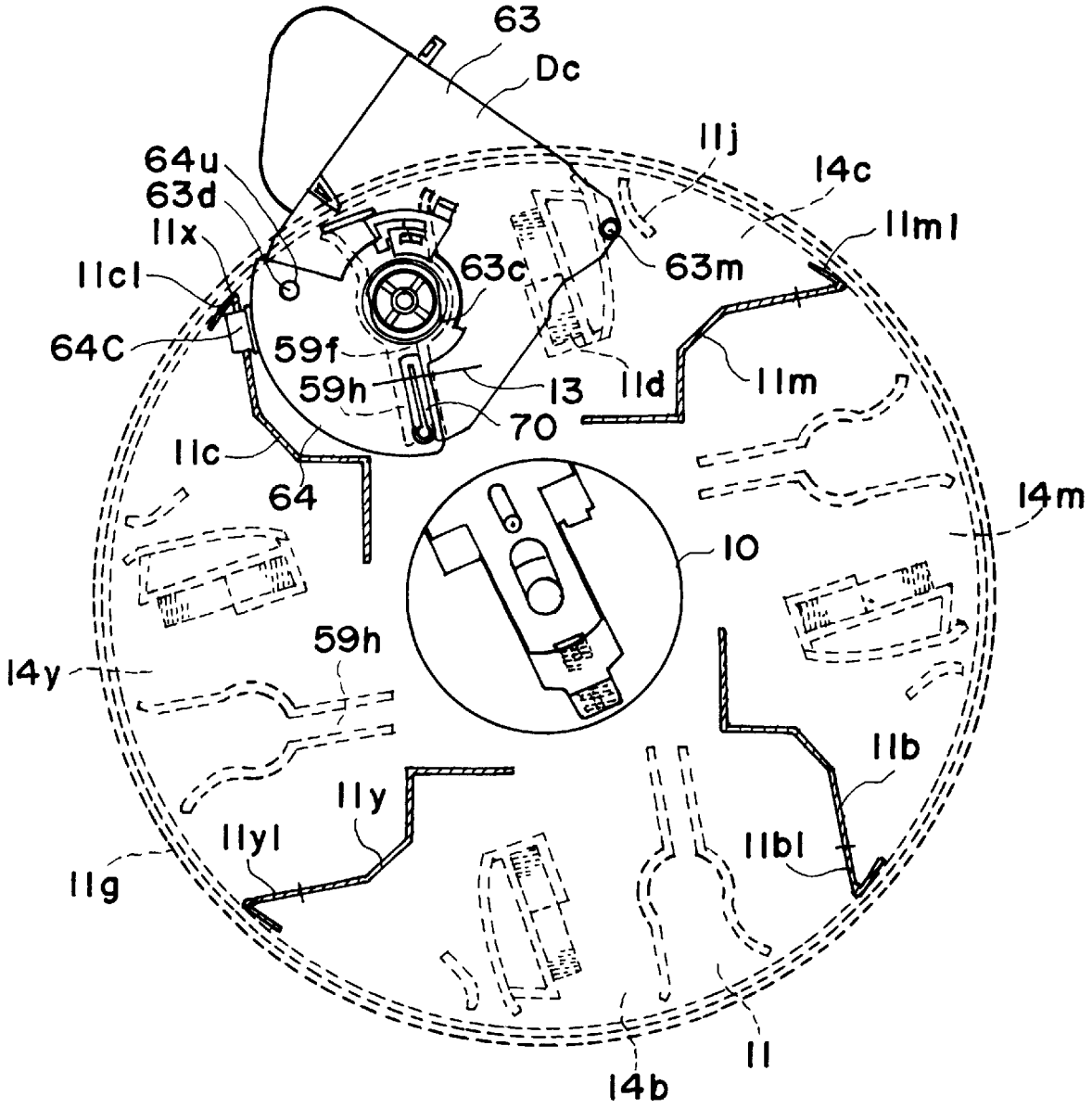
FIG. 2 is a cross-sectional view of a rotary unit.
Figure 3:
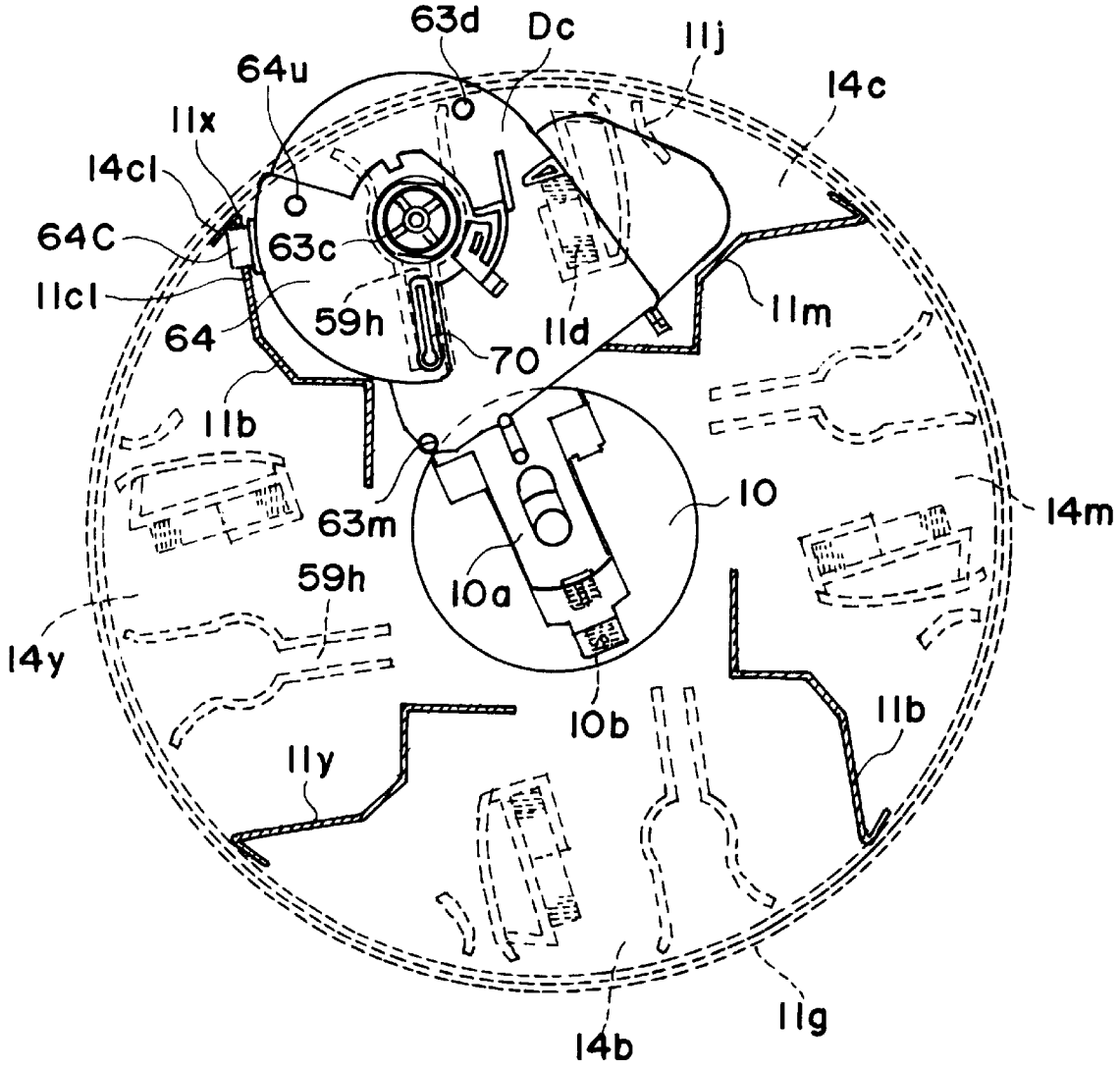
FIG. 3 is a cross-sectional view of a rotary unit.
Figure 4:
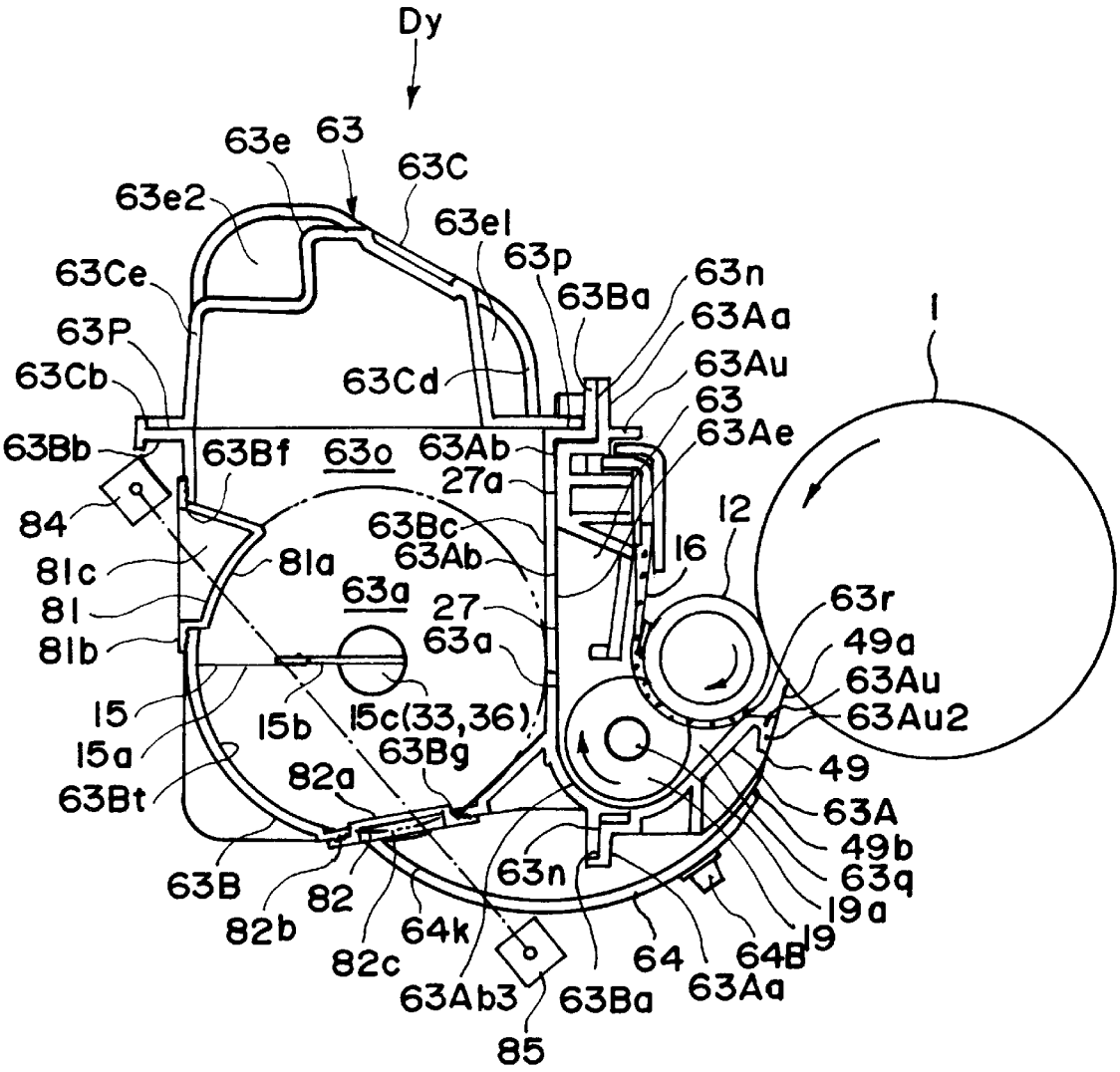
FIG. 4 is a longitudinal sectional view of color developing cartridge.
Figure 5:
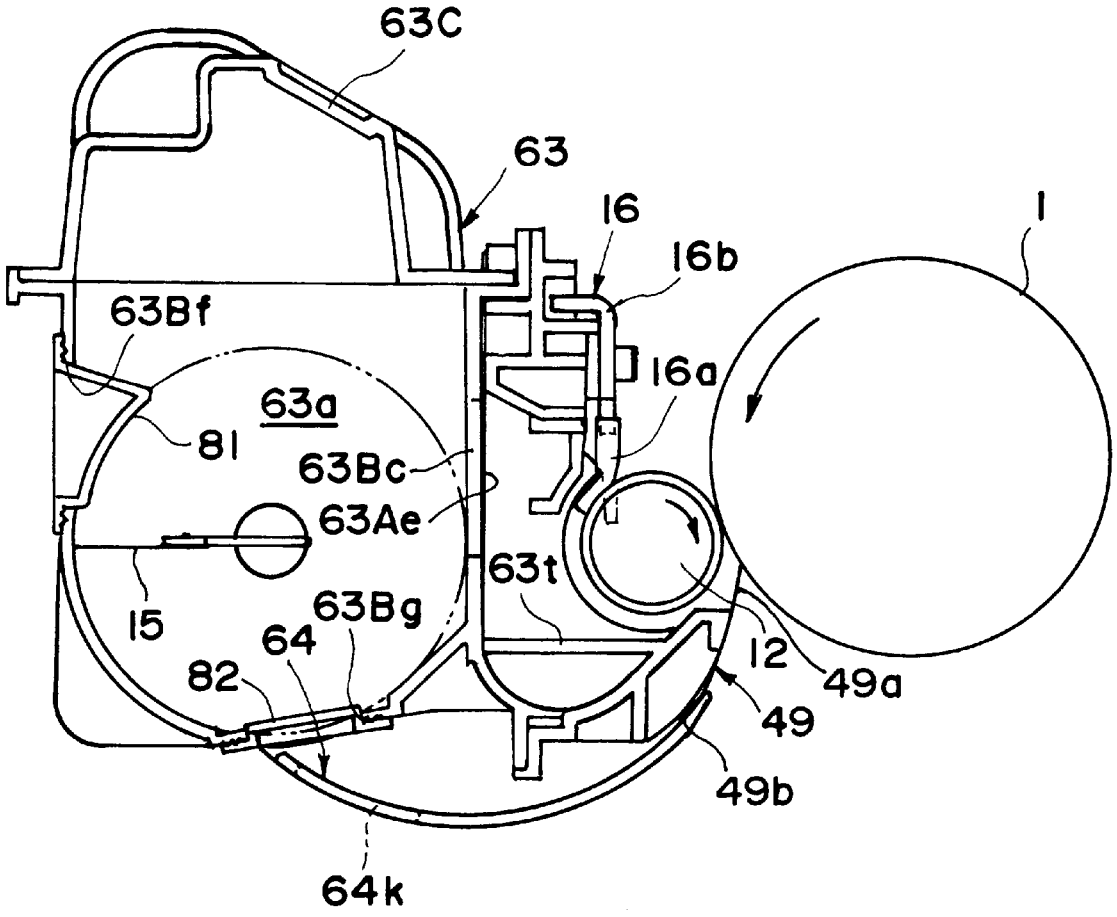
FIG. 5 is a longitudinal sectional view of black developing cartridge.
Figure 6:
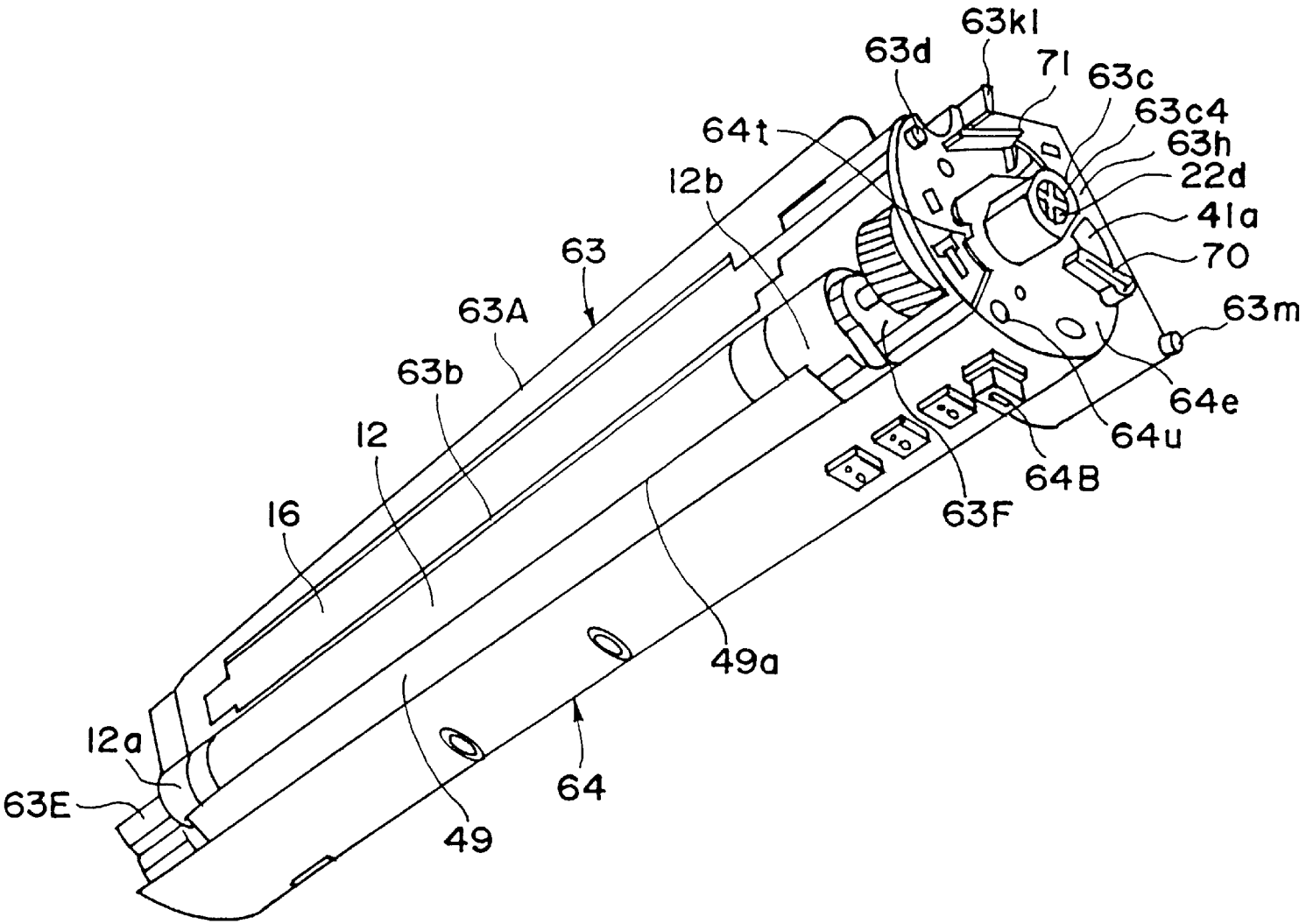
FIG. 6 is a perspective view of the developing cartridge wherein a shutter is in the open position.
Figure 7:
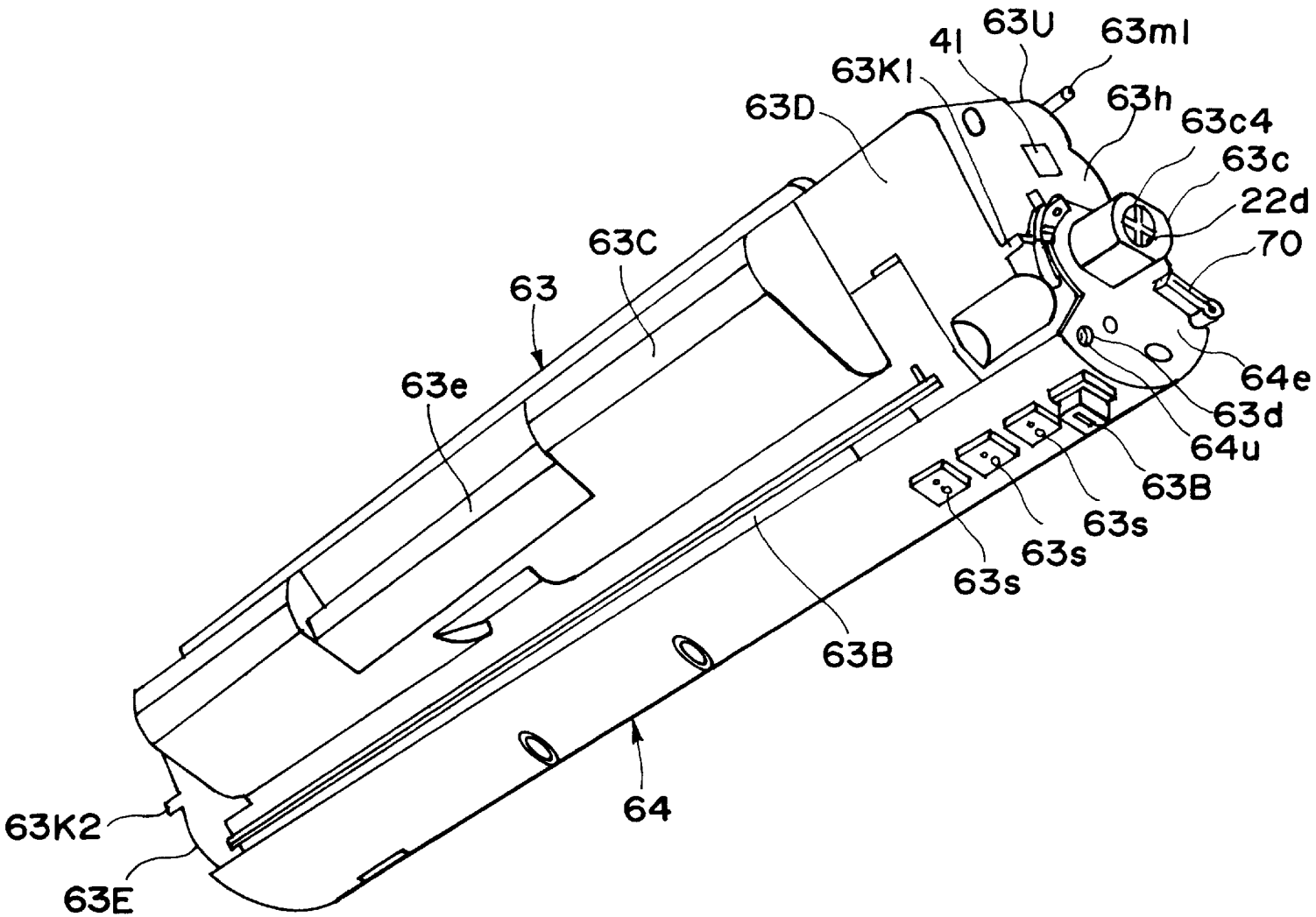
FIG. 7 is a perspective view of a developing cartridge wherein the shutter is in the close position.

First, referring to FIGS. 1–9, the first embodiment of the present invention will be described. FIGS. 1–3 are schematic drawings which depict the structure of an image forming apparatus; FIGS. 4–5, sections of a development cartridge; FIGS. 6–7, perspective views of the development cartridge; and FIGS. 8–14 are schematic drawings which depict the structure of the development cartridge. It should be noted here that in FIGS. 2, 3, and 15–19, dotted lines are used as imaginary lines.

In describing the present invention, the overall structure of the image forming apparatus will be first described, and then, the structure of the development cartridge will be described.

(Image Forming Apparatus)

First, the general structure of the image forming apparatus in accordance with this embodiment will be described. FIG.

1 is a side view of a color laser beam printer, a typical form of an image forming apparatus which forms a color image, with the use of an electrophotographic system. In this apparatus, the peripheral surface of an electrophotographic photosensitive member 1 (hereinafter, photosensitive drum) in the form of a drum, which rotates at a predetermined constant speed, is uniformly charged by a charging means 2. Then, a laser beam modulated with image data is projected from an exposing means 3 onto the charged peripheral surface of the photosensitive drum 1. As a result, a latent image is formed on the peripheral surface of the photosensitive drum 1. The latent image is developed with the use of one of four development cartridges Dm, Dc, Dy and Db, which will be collectively designated by a letter D. The developed image on the photosensitive drum 1 is sequentially transferred, in a superposing manner, onto an intermediary transfer unit 4 in the form of a belt. As a result, a full-color image is formed on the intermediary transfer unit 4. Then, the full-color image is transferred by a transferring means 6 onto a recording medium P (for example, a sheet of recording paper, an OHP sheet, and the like) which is conveyed from a recording medium feeding section by a conveying means 5. Thereafter, the recording medium P is conveyed to a fixing means 7, which permanently fixes the full-color image to the recording medium P, and discharges the recording medium P into a delivery section 8 located on the top side of the image forming apparatus.

Next, the structure of each section of the image forming apparatus will be described more specifically.

The photosensitive drum 1 is an integral part of a process cartridge U, and is supported by a container-like frame 9*a* of a cleaning means 9 for removing the toner remaining on the photosensitive drum 1 after an image composed of developer (hereinafter, "toner") is transferred onto the intermediary transfer unit 4. The process cartridge U is removably installed in the main assembly 30 of the image forming apparatus, and is replaceable by an ordinary user alone; it is replaced as the service life of the photosensitive drum 1 expires.

The photosensitive drum 1 comprises an aluminum cylinder with a diameter of approximately 50 mm, and a layer of organic photosensitive material coated on the peripheral surface of the aluminum cylinder. It is rotatively supported by the container-like frame 9*a* of the cleaning means 9 that doubles as the holder for the photosensitive drum 1. In contact with the peripheral surface of the photosensitive drum 1, a cleaning blade 9*b* for scraping off the toner remaining on the peripheral surface of the photosensitive drum 1, and the charging means 2, are disposed. In other words, in this embodiment, the photosensitive drum 1, the cleaning means 9, and the charging means 2, are integrated in the form of a cartridge, that is, the process cartridge U, removably installable in the apparatus main assembly 30.

Figure 21:
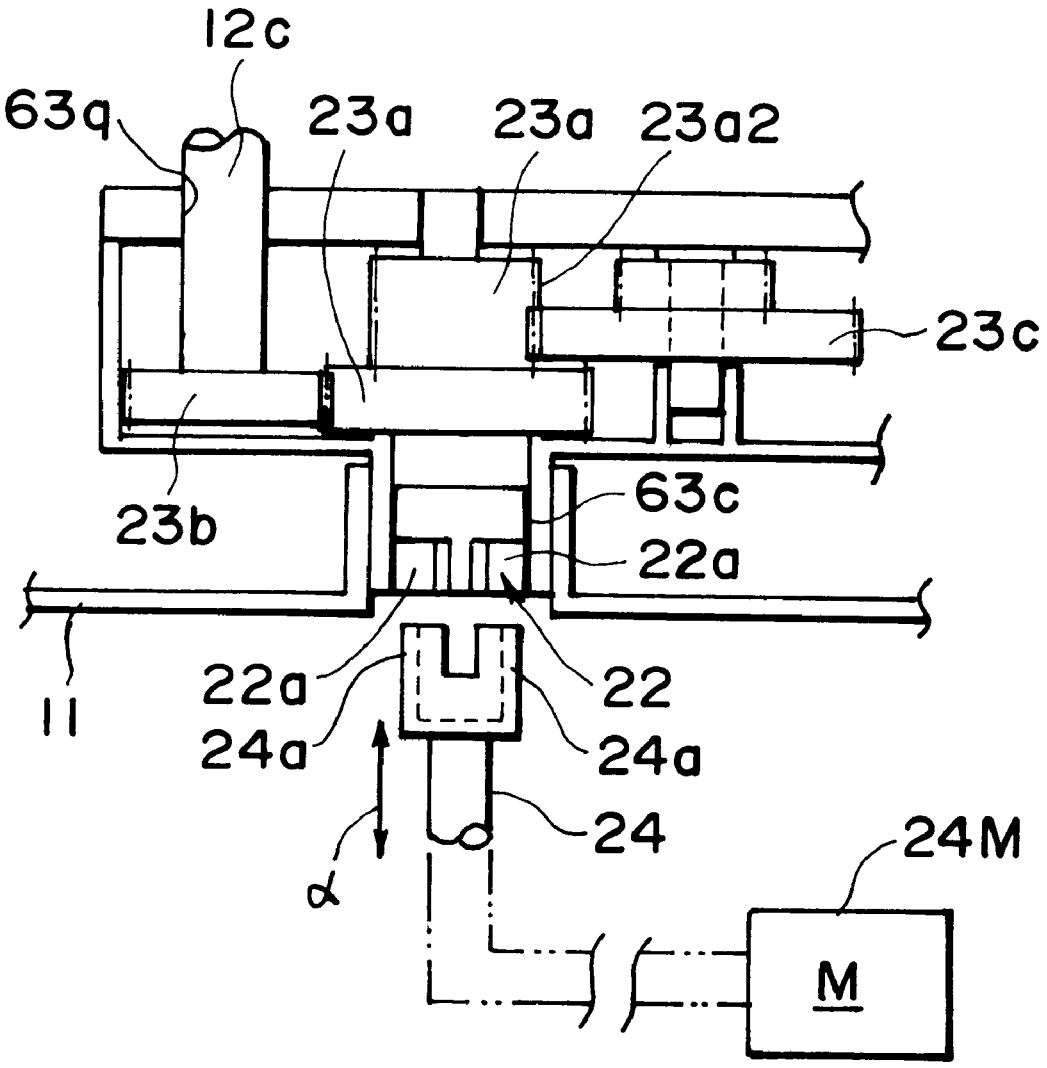
FIG. 21 is a top plan view illustrating a showing of the driving device.

The photosensitive drum 1 is rotated in the counterclockwise direction in FIG. 1 in synchronism with an image forming operation by the driving force transmitted to the photosensitive drum 1 from a motor 24M (FIG. 21).

The charging means 2 in this embodiment is such a charging means that uses a so-called contact type charging method. Thus, the peripheral surface of the photosensitive drum 1 is uniformly charged by applying voltage to an electrically conductive charge roller, as a charging member, which is being rotated in contact with the peripheral surface of the photosensitive drum 1.

The exposing means 3 exposes the charged peripheral surface of the photosensitive drum 1. More specifically, as image signals are given to an unillustrated laser diode, the diode projects an image forming light modulated with the image signals onto a polygon mirror 3*a*, which is being rotated at a high velocity by a scanner motor 3*b*. The image forming light deflected by the mirror 3*a* is projected through an image forming lens 3*c*, is deflected by a deflection mirror 3*d*, and then, selectively exposes the peripheral surface of the photosensitive drum 1, which is rotating at a predetermined constant velocity. As a result, an electrostatic latent image is formed on the peripheral surface of the photosensitive drum 1.

The latent image is developed by the development cartridge D (developing apparatus) into a toner image of specific color. The structure of the development cartridge D will be described later.

The toner image formed by the development cartridge D is transferred onto the intermediary transfer unit 4. The intermediary transfer unit 4, as the second image bearing member, is such a unit that transfers all at once (second transfer) the plurality of toner images having been transferred (first transfer) onto the intermediary transfer unit 4, onto the recording medium P. The intermediary transfer unit 4 comprises an intermediary transfer belt 4*a* which is run in the direction of an arrow mark R4. The intermediary transfer belt 4*a* in this embodiment is a belt with a circumference of approximately 440 mm, being suspended around three rollers: a driving roller 4*b*, a second transfer roller 4*c*, and a following roller 4*d*. The intermediary transfer unit 4 also comprises a pressing roller 4*j*, which takes two positions; a position where the pressing roller 4*j* keeps the intermediary transfer belt 4*a* pressed upon the photosensitive drum 1, and a position where the pressing roller 4*j* allows the intermediary transfer belt 4*a* to keep a short distance away from the photosensitive drum 1. The intermediary transfer belt 4*a* is run in the arrow R4 direction by the rotation of the driving roller 4*b*. Further, the intermediary transfer unit 4 comprises a cleaning unit 4*e*, which is disposed at predetermined location outside the loop of intermediary transfer belt 4*a*. The cleaning unit 4*e* can be placed in contact with the outward surface of the intermediary transfer belt 4*a*, or can be moved away from the intermediary transfer belt 4*a*. The cleaning unit 4*e* removes the waste toner which is remaining on the intermediary transfer belt 4*a* after the toner images on the intermediary transfer belt 4*a* are transferred all at once (second transfer) onto the recording medium P. The cleaning unit 4*e* comprises a charging roller 4*f*, which is placed in contact with the intermediary transfer belt 4*a* to charge the toner, which is remaining on the intermediary transfer belt 4*a*, to the polarity opposite to the polarity to which the toner is charged during the image transfer onto the recording medium P. The reversely charged toner is electrostatically adhered to the photosensitive drum 1, and then, is recovered by a cleaning apparatus for cleaning the photosensitive drum 1. The cleaning apparatus 9 will be described later. The method for cleaning the intermediary transfer belt 4*a* does not need to be limited to the above described electrostatic cleaning method; a mechanism method which use a blade or a fur brush, a combination of the electrostatic and mechanical methods, and the like may be also used.

The toner which is remaining on the peripheral surface of the photosensitive drum 1 after the toner images are transferred onto the intermediary transfer unit 4 is removed by the cleaning means 9; the toner is scraped into a toner bin 9*c* by a cleaning blade 9*b*, as a cleaning member, placed in contact with the peripheral surface of the photosensitive drum 1. The toner scraped into the toner bin 9*c* is accumulated therein. The toner bin 9*c* is constituted of a part of the frame 9*a* of the cleaning means 9, and is given a capacity large enough so that it will not be filled up with the toner before the service life of the photosensitive drum 1 expires. Thus, the toner within the toner bin 9*c* is disposed all at once as the process cartridge is replaced at the end of the service life of the photosensitive drum 1.

In this embodiment, the transferring means 6 for transferring the toner images, which have been transferred onto the intermediary transfer unit 4 in a superposing manner, onto the recording medium P is constituted of a transfer roller 6 as an image transfer member. The transfer roller 6 comprises a metallic shaft, and a layer of foamed elastic material with electrical resistance in a medium range wrapped around the peripheral surface of the metallic shaft. It is rendered movable in the vertical direction in FIG. 1.

While four color toner images are transferred onto the intermediary transfer unit 4, that is, while the intermediary transfer unit 4 is rotated a plurality of times, the transfer roller 6 is placed at the bottom position outlined by a solid line in FIG. 1, being separated from the intermediary transfer unit 4, so that the toner images are prevented from being disturbed by the transfer roller 6.

After the toner images are transferred onto the intermediary transfer unit 4 in a superposing manner, that is, after a full-color toner image is formed on the intermediary transfer unit 4, the transfer roller 6 is moved to the top position outlined by a single dot chain line in FIG. 1, by an unillustrated cam, in synchronism with the timing with which the full-color toner image is transferred onto the recording medium P. As the transfer roller 6 is moved to the top position, it is pressed upon the intermediary transfer unit 4, pinching the recording medium P between itself and the intermediary transfer unit 4. At the same time as the transfer roller 6 is moved to the top position, bias voltage begins to be applied to the transfer roller 6, and as a result, the full-color toner image on the intermediary transfer unit 4 is transferred onto the recording medium P.

Referring to FIG. 1, the conveying means 5 for conveying the recording medium P comprises: a sheet feeding cassette 5*a* for storing a plurality of recording medium P; a pickup roller 5*b*; a combination of a feeding roller 5*c*1 and a retarding roller 5*c*2 for preventing two or more sheets of recording medium P from being fed at the same time; a conveying roller pair 5*d*; a registering roller pair 5*e*; a discharging roller pair 5*f*; and a conveying guide 5*g*.

In an image forming operation, the pickup roller 5*b* is rotatively driven in accordance with the image forming operation to feed out, one by one, the recording medium P in the sheet feeding cassette 5*a*. The recording medium P having fed out of the sheet feeding cassette 5*a* is guided by the conveying guide 5*g*, and is conveyed farther by the conveying roller pair 5*d* to the registering roller pair 5*g*. The registering roller pair 5*e* is activated according to a predetermined rotational image sequence that comprises a period in which the registering roller pair 5*e* is stopped to keep the recording medium P on standby, or stationary, and a period in which the registering roller pair 5*e* is rotated to convey the recording medium P toward the intermediary transfer unit 4, so that the full-color image and the recording medium P is properly aligned in the following process, that is, the transferring process. Then, the full-color toner image is transferred onto the recording medium P by the transferring means.

The recording medium P on which the full-color toner image has been transferred is conveyed to the fixing means 7, by which the full-color toner image is fixed. The fixing means 7 comprises a fixing roller 7*a* for applying heat to the recording medium P, and a pressing roller 7*b* for pressing the recording medium P onto the fixing roller 7*a*. Both rollers 7*a* and 7*b* are hollow and contain a heater. They are rotatively driven. They fix the full-color toner image to the recording medium P by conveying the recording medium P while applying heat and pressure to the recording medium P.

Thereafter, the recording medium P on which the full-color toner image has been fixed is discharged into the delivery section 8 by the discharging roller pair 5*f* which constitutes the conveying means.

(Development Cartridge—Developing Apparatus)

Next, the structure of a development cartridge for developing a latent image formed on the aforementioned photosensitive drum 1 will be described.

In order to form a full-color image, the image forming apparatus in this embodiment comprises four development cartridge D (Dm, Dc, Dy and Db) for developing four colors: magenta, cyan, yellow, and black. Referring to FIGS. 1–3, the development cartridges D are removably fitted in a rotary unit 11 which is rotated about an central shaft 10. In an image forming operation, the development cartridges D circularly move about the central shaft 10, being held by the rotary unit 11. The rotary unit 11 is stopped as a development cartridge D which contains a color toner to be immediately used arrives at a position where the development cartridge squarely faces the photosensitive drum 1, that is, the position where the distance between the development cartridge D and the photosensitive drum 1 is microscopic (approximately 300 $\mu$m). At this position, the toner is supplied to the peripheral surface of the photosensitive drum 1 in a manner to reflect the electrostatic latent image on the photosensitive drum 1; the latent image is developed.

In an image forming operation, for each rotation of the intermediary transfer unit 4, the rotary unit 11 also rotate once, so that the magenta development cartridge Dm which contains magenta color toner, the cyan development cartridge Dc which contains cyan color toner, the yellow development cartridge Dy which contains yellow color toner, and the black development cartridge Db which contains black color toner, carry out a development process, in the same order as they are listed. It should be noted here that the black color toner is a magnetic toner, and the other color toners are nonmagnetic toners.

FIG. 4 depicts a development cartridge D (for example, the yellow development cartridge Dy), which is stopped at the development position where the development cartridge D squarely faces the photosensitive drum 1. The development cartridge D comprises a development roller 12 as an image developing member, that is, a toner carrying member for supplying the photosensitive drum 1 with toner, and a toner storing portion 63*a* for storing the toner to be supplied to the development roller 12. The development cartridge D also comprises a cartridge frame 63 and a shutter 64. The cartridge frame 63 is constituted of a plurality of subframes, and supports the development roller 12. The shutter 64 covers or exposes the opening cut in the cartridge frame 63. In the toner storing portion 63*a*, a toner conveying member 15 is disposed. A brand-new development cartridge is sealed with a toner seal 27 to prevent the toner stored in the toner storing portion 63*a* from leaking. Thus, before installing a brand-new development cartridge D into the apparatus main assembly 30, an operator is required to peel the toner seal 27 to unseal the toner storing portion 63*a*, so that the toner in the toner storing portion 63*a* is enabled to be supplied to the development roller 12.

The toner conveying member 15 rotates by receiving driving force from the apparatus main assembly 30, to deliver the toner in the toner storing portion 63*a* to the development roller 12. The development roller 12 is a rotatable aluminum roller, and a development blade 16 is placed in contact with the peripheral surface of the development roller 12. Thus, as the development roller 12 is rotated in the clockwise direction in FIG. 4, a thin layer of toner is coated on the peripheral surface of the development roller 12. While the toner is coated, it is triboelectrically charged.

A toner image which reflects the latent image on the photosensitive drum 1 can be formed on the photosensitive drum 1 by applying development bias supplied from the apparatus main assembly 30, to the development roller 12 placed in a manner to squarely face the photosensitive drum 1, on which the latent image has been formed.

As each development cartridge D is moved to the development position, the development roller 12 in the development cartridge D is connected to a high voltage power source and a mechanical power source, which are provided on the main assembly side. As a result, development bias voltage specific to each development cartridge D is selectively applied to the development cartridge D, and the mechanical driving force is transmitted to the development roller 12 and the like, rotating them.

The magenta development cartridge Dm, the cyan development cartridge Dc, and the yellow development cartridge Dy, which are depicted in FIG. 4, are the same in structure. All of these color development cartridges Dm, Dc and Dy comprise a coating roller 19. At the interface between the coating roller 19 and the development roller 12, the peripheral surface of the coating roller 19 moves in the direction opposite to the direction in which the peripheral surface of the development roller 12 moves. The coating roller 19 is rotatively supported by the development frame 63A of the cartridge frame 63.

The black development cartridge Db illustrated in FIG. 5 does not have a coating roller. The black toner adheres to the development roller 12 due to its own adhesive force, and due to the magnetic force of a magnet (unillustrated) disposed inside the development roller 12. The thickness of the layer of the toner, which has adhered to the development roller 12, is regulated by the development blade 16 placed in contact with the peripheral surface of the development roller 12. As the thickness of the toner layer is regulated by the development blade 16, the toner becomes triboelectrically charged. As described before, in the development cartridges Dm, Dc and Dy, the development roller 12 does not contain a magnet. This is because the black toner in this embodiment is a magnetic toner, whereas the magenta, cyan and yellow toners are nonmagnetic toners.

(Installation of Development Cartridge into Main Assembly of Image Forming Apparatus)

Figure 13:
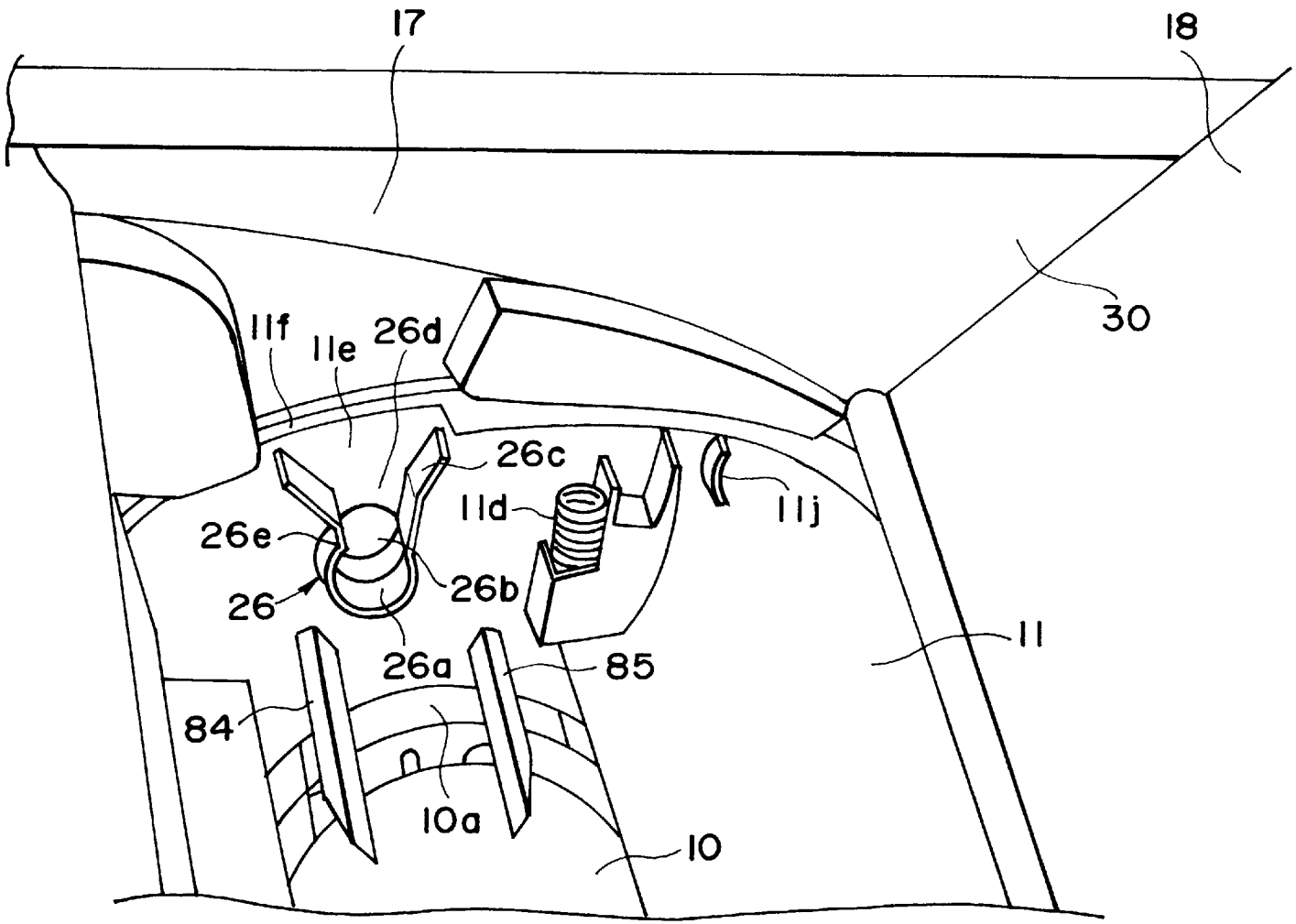
FIG. 13 is a perspective view of a non-driving side of a developing cartridge mounting portion of a rotary unit.
Figure 14:
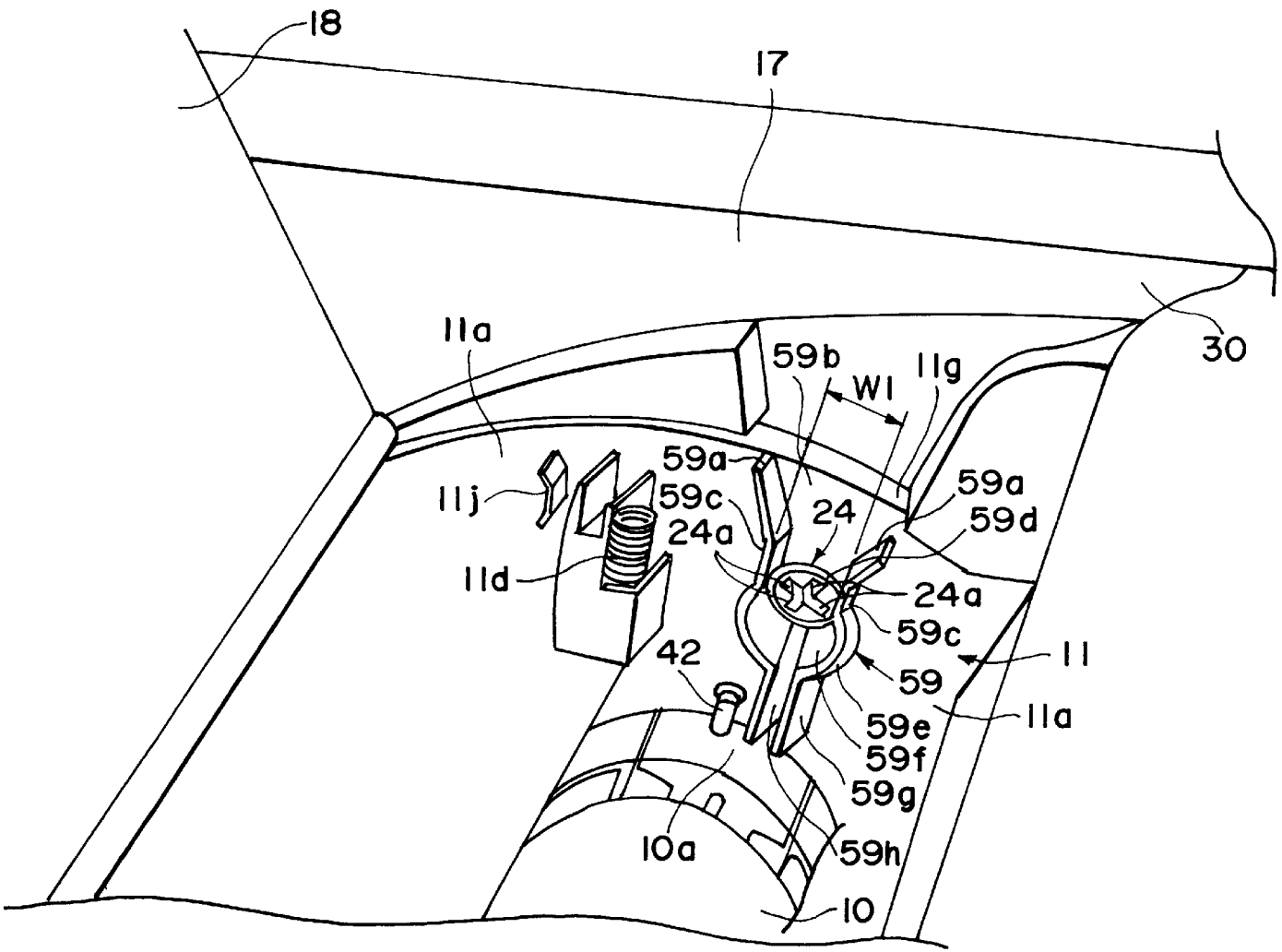
FIG. 14 is a perspective view of a driving side of a developing cartridge mounting portion of a rotary unit.

Next, the structure for installing the development cartridge. D into the main assembly 30 of an image forming apparatus will be described. Referring to FIGS. 1, 13 and 14, the apparatus main assembly 13 is provided with a development cartridge opening 17, which is located at a predetermined position in the apparatus main assembly 30, and the width of which is greater than the dimension of the development cartridge D in the longitudinal direction. To the edge of the opening 17, a cover 18 is pivotally attached to expose or cover the opening 17. Normally, the development cartridge opening 17 is covered with the cover 18.

The apparatus main assembly 30 is provided with a development apparatus replacement switch (unillustrated), which is to be pressed when the development cartridge D needs to be replaced because of toner depletion of the like. As the switch is depressed by an operator, the rotary unit 11 rotates about the central shaft 10, by which the rotary unit 11 is supported, until one of the color development cartridges D to be replaced arrives at the development cartridge opening 17.

Referring to FIG. 14, as the cover 18 is opened by the operator, a guide 59 is exposed, which constitutes means for installing the development cartridge D. There are four guides 59 at a lateral end of the rotary unit 11, equally dividing the rotary unit 11 in the circumference direction of the rotary unit 11. Next, referring to FIGS. 6, 7, 8 and 10, the shutter 64 of the development cartridge D is provided with a guide portion 70, which is slid along the guide 59 by the operator to insert the development cartridge D into the apparatus main assembly 30. It should be noted here that the guide portion 70 is provided on only one of the longitudinal ends of the development cartridge D (ends in the terms of the axial direction of the development roller 12), and therefore, the guide 59 is provided also on only one of the two lateral walls, that is, the longitudinal end lateral wall 11*a* of the rotary unit 11. The lateral walls 11*a* and 11*e* are provided with arc-shaped ribs 59*e* and 26*a*, respectively, and the longitudinal end walls of the development cartridge D are provided with projections 63*c* and 63*g* that fit in the space surrounded by the arc-shaped ribs 59e and 26*a*, respectively.

When installing the development cartridge D in the rotary unit 11, the operator grasps the handhold portion 63*e* (FIG. 7) of the development cartridge D by hand, and inserts the development cartridge D into the rotary unit 11 in the direction perpendicular to the longitudinal direction of the development roller 12, with the development roller 12 facing forward (development roller 12 facing in such a direction that it faces the photosensitive drum 1 after installation of the development cartridge D).

Then, after the shutter 64 of the development cartridge D is immovably locked with the apparatus main assembly 30, the operator rotates the development cartridge D about the projections 63*c* and 63*g*. As a result, the shutter 64 is opened, and the development roller 12 is exposed from the cartridge frame 63 in a manner to directly and squarely face the photosensitive drum 1, being readied for image development.

The other lateral wall 11*e* of the rotary unit 11 is provided with a semispherical pressing member 26*b*, which is surrounded by the arc-like ribs 26*a* of the guide 26, and elastically presses the development cartridge D in the longitudinal direction of the development cartridge D after the development cartridge D is installed in the rotary unit 11 (development cartridge D is elastically pressed toward a driving force receiving member 22). More specifically, the pressing member 26*b* is under elastic pressure generated by a spring in the longitudinal direction. Therefore, the development cartridge D is elastically pressed toward the longitudinal end (of the development cartridge D) to which driving force is transmitted. In other words, in installing the development cartridge D in the rotary unit 11 (apparatus main assembly 30), the driving force receiving member side of the development cartridge D is used as the reference point in terms of the longitudinal direction.

Figure 8:
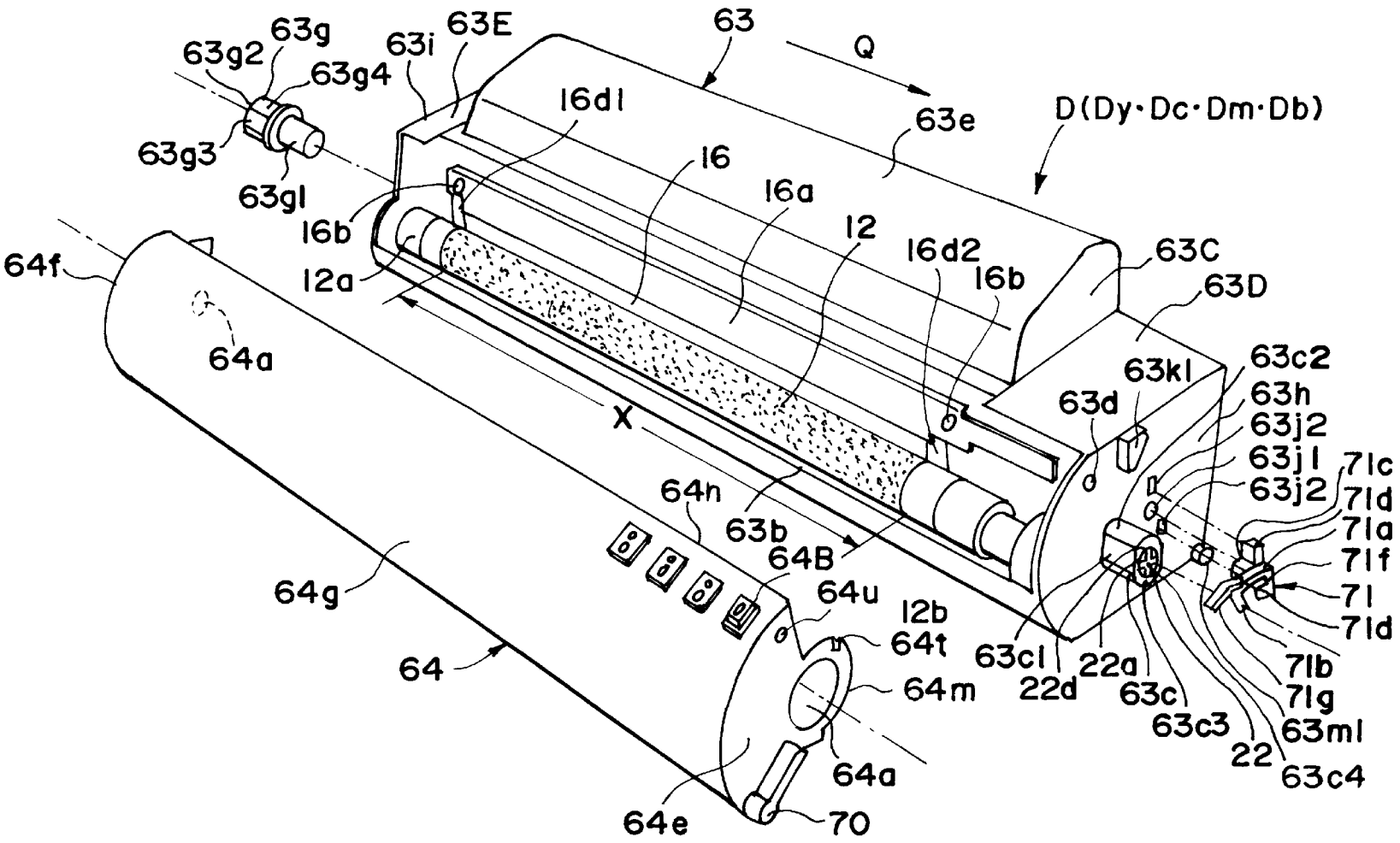
FIG. 8 is an exploded perspective view of a developing cartridge wherein a shutter part is broken.
Figure 9:
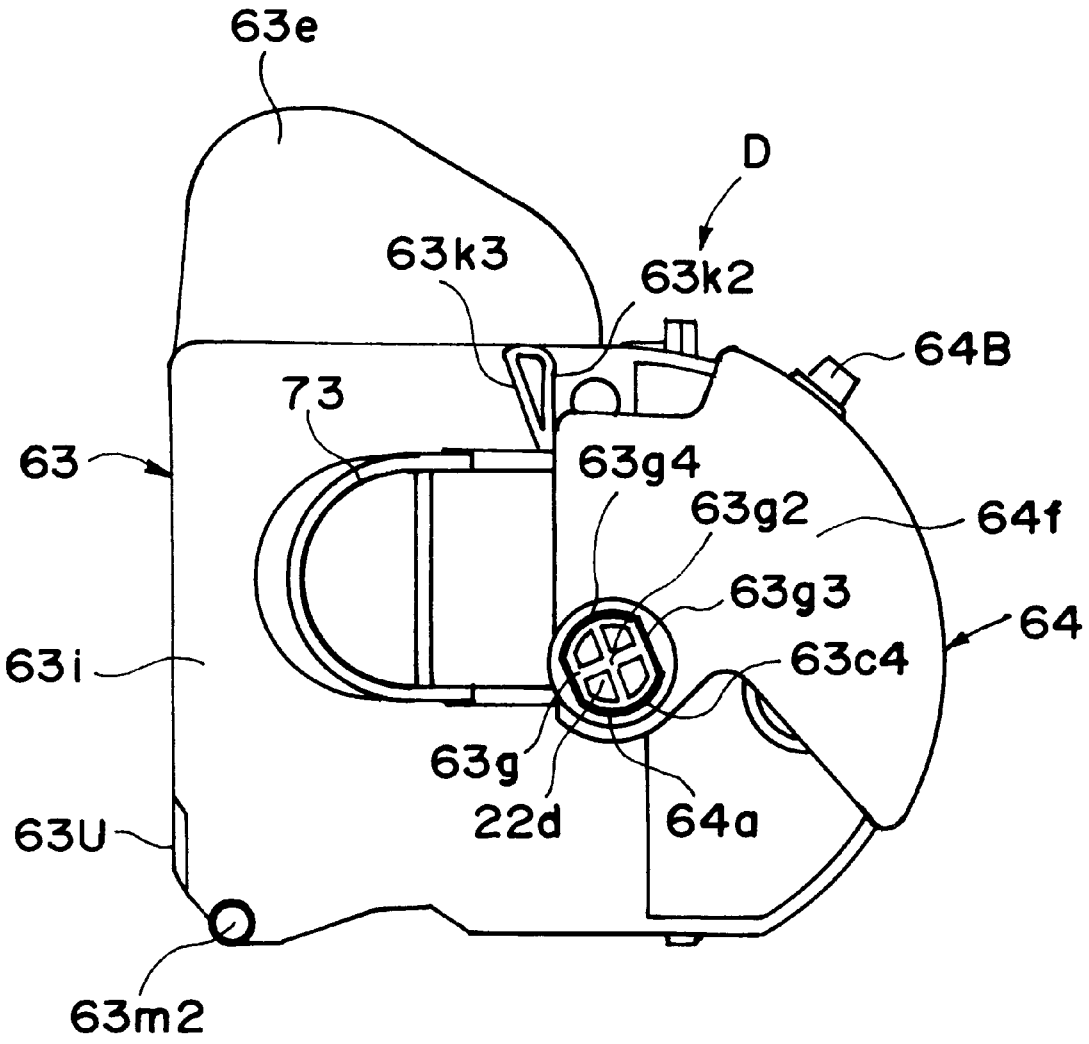
FIG. 9 is a side view of a non-driving side of the developing cartridge wherein the shutter is closed.
Figure 10:
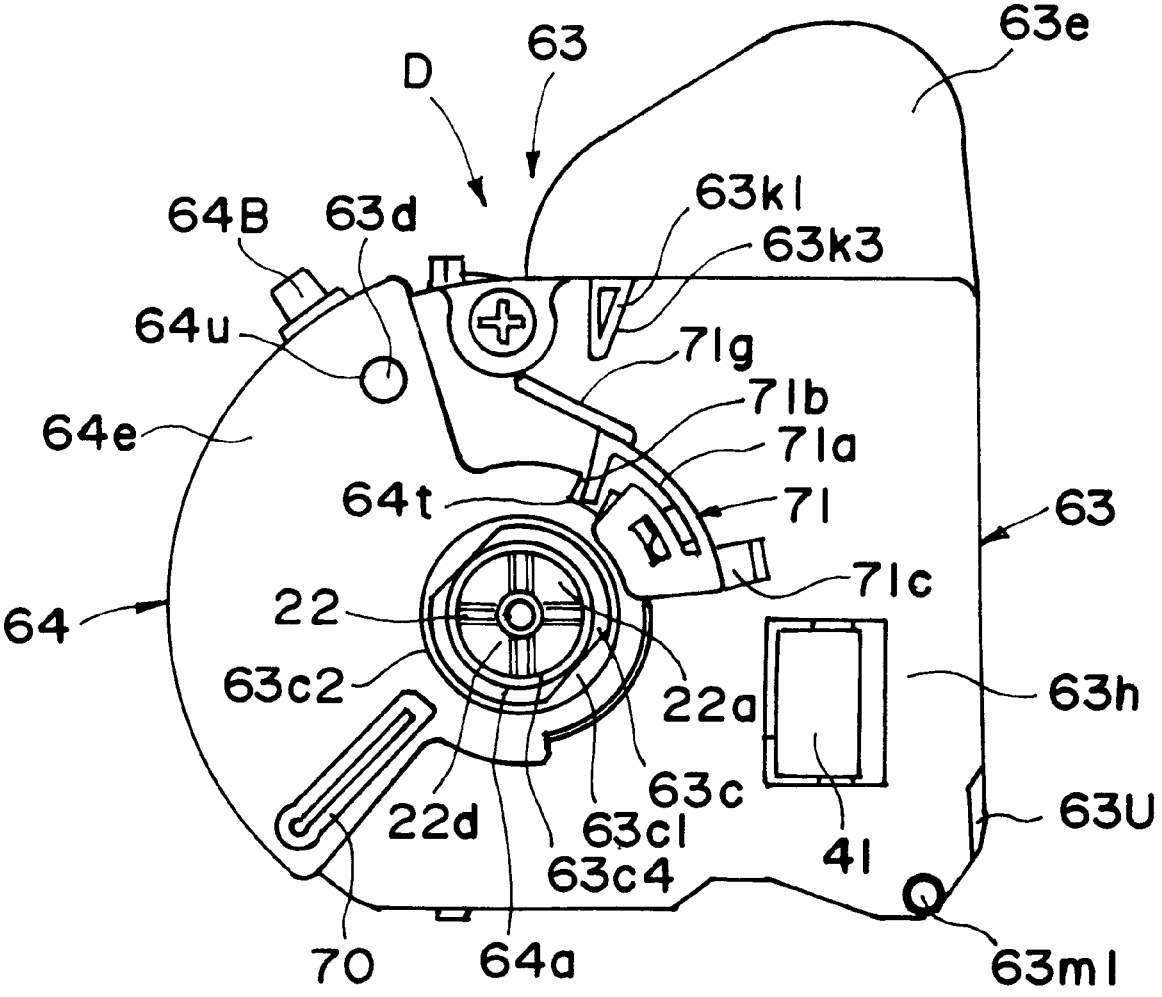
FIG. 10 is a side view of a driving side of a developing cartridge wherein the shutter is closed.
Figure 11:
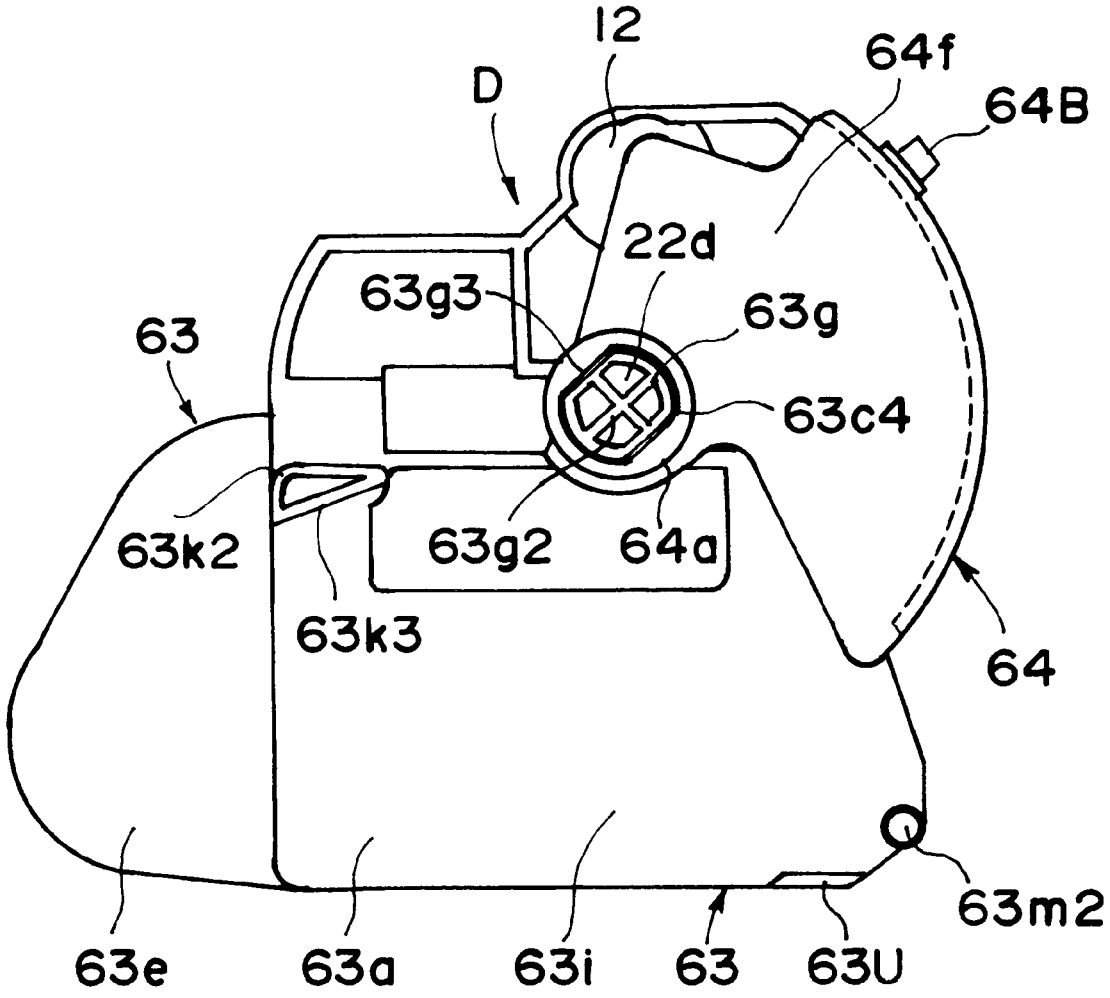
FIG. 11 is a side view of a non-driving side of a developing cartridge wherein the shutter is opening.
Figure 12:
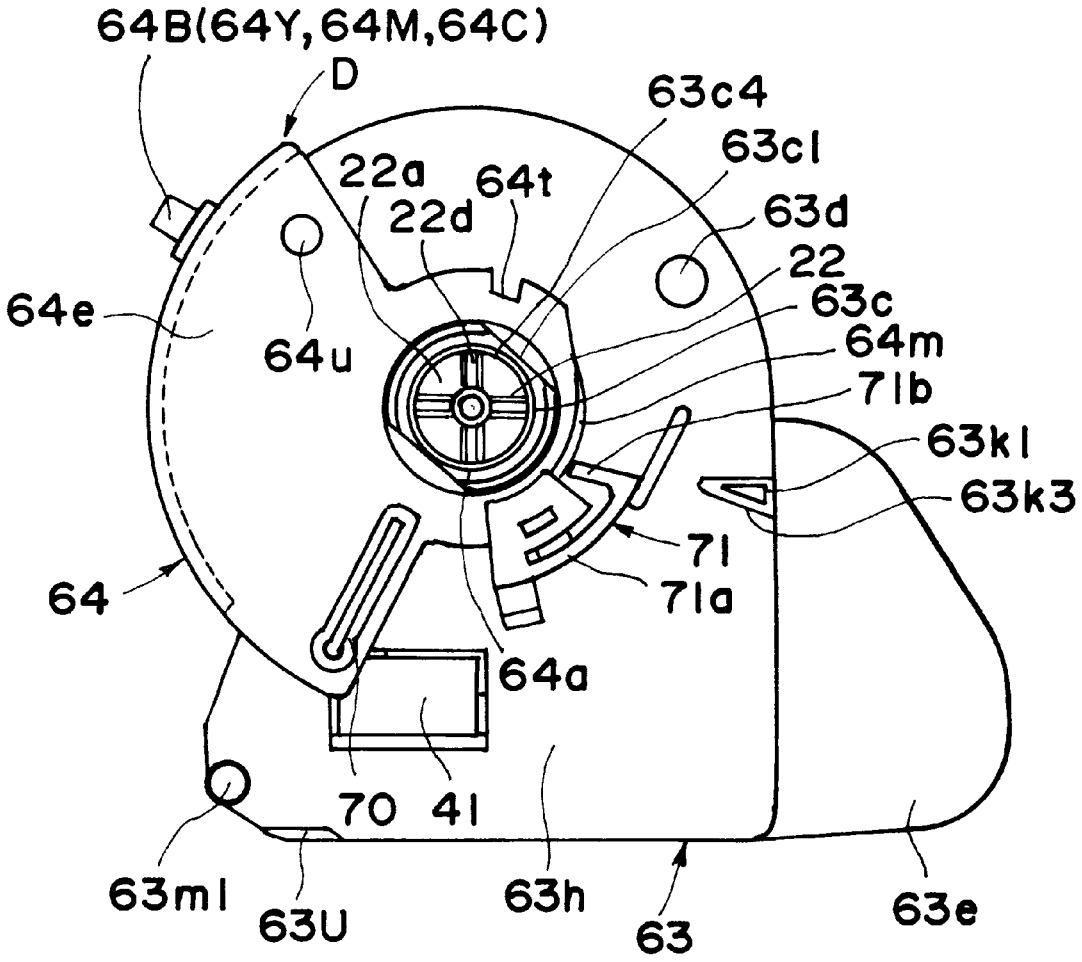
FIG. 12 is a side view of a driving side of a developing cartridge wherein the shutter is opening.

Here, referring to FIGS. 8–12, the structure of the development cartridge D will be described in detail. FIG. 8 is a perspective view of the development cartridge D, from which the shutter 64 and the components belonging to the shutter 64 have been removed. FIGS. 9 and 10 are side views of the development cartridge D, at the opposing longitudinal ends, with the shutter 64 closed. The FIGS. 11 and 12 are side views of the development cartridge D, at the opposing longitudinal ends, with the shutter 64 open.

Referring to FIG. 8, the cartridge frame 63 of the development cartridge D is provided with an opening 63*b*, which extends in the longitudinal direction of the cartridge frame 63. The development roller 12 is attached to the cartridge frame 63 in such a manner that the development roller 12 is exposed through the opening 63*b*. Further, the cartridge frame 63 is provided with a projection 63*c*, which is integrally formed with the cartridge frame 63, and projects outward from the approximate center of a longitudinal end wall 63*h* of the cartridge frame 63. The projection 63 acts as a guide when the development cartridge D is inserted into the apparatus main assembly 30, and also acts as a rotational axis when the development cartridge D is installed, or removed from, the apparatus main assembly 30. The projection 63*c* is in the form of a cylinder, and will be described later in more detail.

The development cartridge D comprises a projection 63*g*, which is removably attached to the approximate center of the longitudinal end wall 63*i* of the cartridge frame 63, that is, the counterpart of the wall 63*h* (FIG. 8 depicts the projection 63*g* which has been removed from the cartridge frame 63). More specifically, the projection 63*g* is attached to the cartridge frame 63 by inserting the anchoring portion 63*g*1 of the projection 63*g* into the hole (unillustrated) cut through the longitudinal end wall 63*i*. The anchoring portion 63*g*1 is provided with a latching portion (unillustrated), which is located at the tip of the anchoring portion 63*g*1, and the projection 63*g* is attached to the cartridge frame 63 by engaging this latching portion of the anchoring portion 63*g*1 with the cartridge frame 63. As the development cartridge D is installed into the development cartridge space of the rotary unit 11, the other end of the projection 63*g*2, that is, the end opposite to the anchoring portion 63*g*1, of the projection 63*g* comes in contact with the aforementioned pressing member 26*b*, which is elastically projecting from the longitudinal end wall 11*a* of the rotary unit 11. Therefore, the development cartridge D comes under the pressure from the pressing member 26*b*, being pressed toward the longitudinal end wall 63*h* of the development cartridge D (in the direction of an arrow mark Q in FIG. 8). In other words, the development cartridge D is accurately placed in the rotary unit 11 (apparatus main assembly 30), using the longitudinal end wall 63*h* of the development cartridge D, that is, the driving force receiving side of the development cartridge, as the reference point.

The longitudinal ends of the development roller 12 are fitted with spacer rings 12*a* and 12*b*, one for one. Therefore, when the development roller 12 is at the development position, the spacer rings are pressed upon the peripheral surface of the photosensitive drum 1 by an elastic pressure applying member 25 (FIG. 24), or by the elastic pressure of a compression spring 10*b* (FIG. 3) which elastically presses or sliding member 10*a*. As a result, a predetermined gap is maintained between the development roller 12 and photosensitive drum 1.

The development blade 16 formed of rubber or the like is attached to the cartridge frame 63, by attaching the metallic plate 16*a* of the development blade 16 to the cartridge frame 63 with a small screw 16*b*. The structure of the development blade 16 will be described later in detail.

To the longitudinal end wall 63*h* of the development cartridge D, a locking member 71 is attached (FIG. 8 depicts it as being separated from the wall 63*h*). The locking member 71 comprises: a latching portion 71*b* which engages with a latching portion catching recess 64*t* of the side wall 64*e* of the shutter 64; a support portion 71*a* for supporting the latching portion 71*b*; and anchoring portions 71*c* and 71*d*, with which the locking member 71 is attached to the longitudinal end wall 63*h* of the cartridge frame 63. Referential codes 63*j*1 and 63*j*2 are holes cut through the wall 63*h*, and the anchoring portions 71*c* and 71*d* are engaged in these holes, respectively. The locking member 71 is formed of plastic material, and is molded in a single piece. In the process of inserting the development cartridge D in the development cartridge space of the rotary unit 11, the arm portion 71*g*, that is, a portion of the locking member 71, comes in contact with a solid projection of the apparatus main assembly 30. As the development cartridge D is farther inserted, the supporting portion 71*a* is elastically bent, and as a result, the latching portion 71*b* is disengaged from the latching portion catching recess 64*t*, that is, the shutter 64 is unlocked.

Next, referring to FIGS. 2, 3, 6, 8, 10 and 12, the semispherical projection 63*d*, which comes in contact with one of the longitudinal ends of the development cartridge D, is provided on only the longitudinal end wall 63*h* of the cartridge frame 63. Accordingly, the shutter 64 is provided with a hole 64*u*, in which the projection 63*d* engages, and which is located so as to align with the projection 63*d* when the development cartridge D is in the rotary unit 11. Thus, when the shutter 64 is in the closed state, the projection 63*d* is in engagement with the hole 64*u*, and therefore, even if the shutter 64 is released from the locking member 71, the cartridge frame 63 does not unexpectedly rotate.

Further, the longitudinal end walls 63*h* and 63*i* comprise attitude controlling boss 63*m* (63*m*1, 63*m*2), and spring contacting portions 63*k* (63*k*1, 63*k*2), respectively, which project outward from the walls.

Referring to FIG. 9, a referential FIG. 73 designates a toner seal removal handle, which is used by an operator to pull out the aforementioned toner seal 27. (Shutter)

Next, the shutter 64 will be described.

Figure 25:
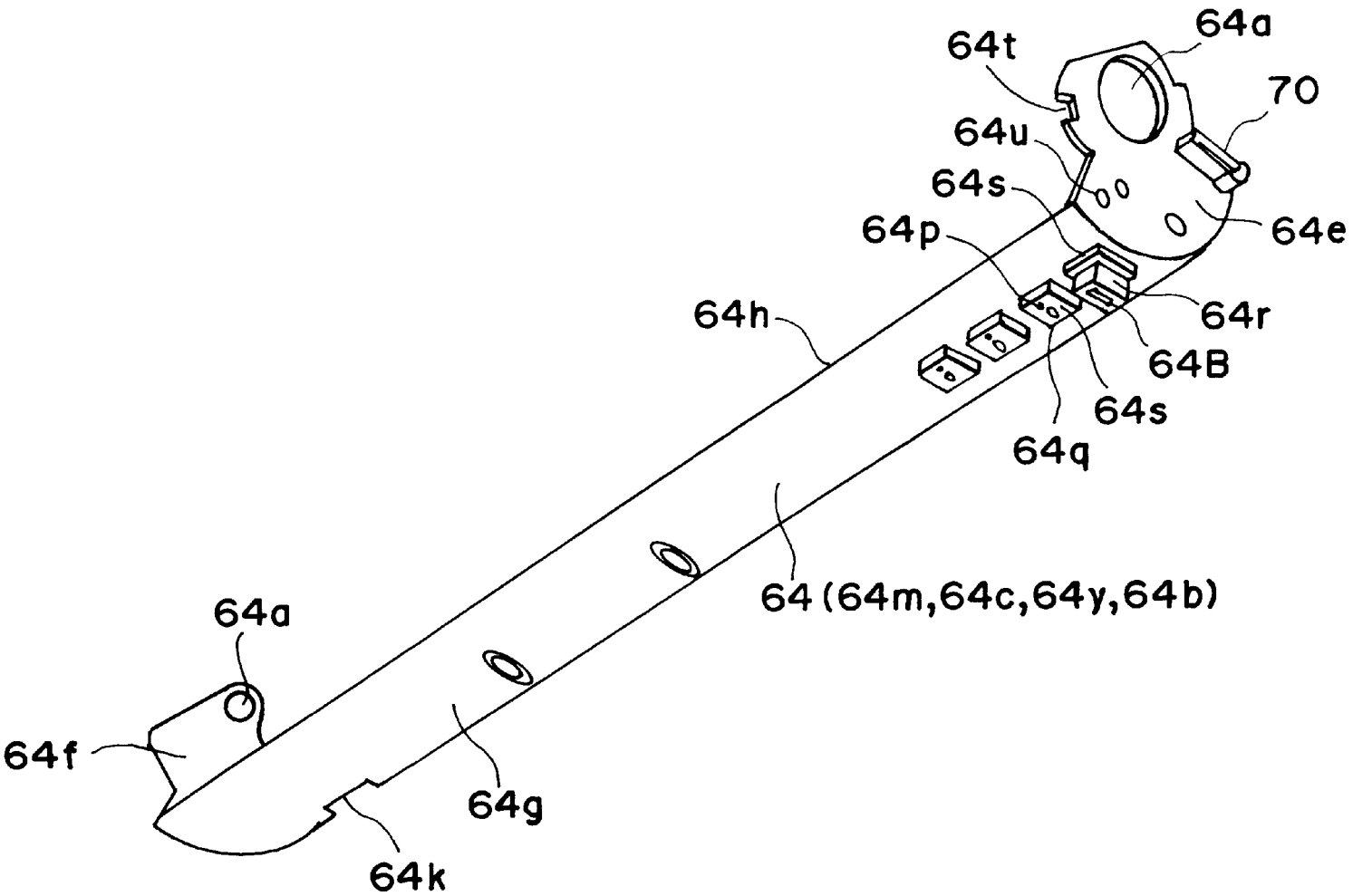
FIG. 25 is a perspective view of a shutter.

Referring to FIG. 25, the longitudinal end walls 67*e* and 64*f* of the shutter 64 are provided with a round hole 64*a*, in which the projections 63*c* and 63*g* are engaged, one for one, so that the shutter 64 is rotatably attached to the cartridge frame 63. Next, referring to FIGS. 6 and 7, as the shutter 64 is closed, the opening 63*b* is covered; the development roller 12 is covered by the shutter 64. When the development cartridge D is out of the apparatus main assembly 30, the shutter 64 is closed. Therefore, dust or the like does not adhere to the development roller 12; the development roller 12 or the like is not damaged; and foreign objects do not enter the development cartridge D.

The supporting portion 71*a* of the locking member 71 is shaped in the form of a cantilever, being therefore rendered elastically bendable, by providing the locking member 71 with a groove 71*f*. The base end of the supporting portion 71*a* in the form of a cantilever is the side where the anchoring portions 71*c* and 71*d* are located. The latching portion 71*b* and the lock releasing arm 71*g* are located at the extending end portion of the supporting portion 71*a*. The anchoring portion 71*c* is cylindrical, extending in the longitudinal direction of the development cartridge D, and fits in the hole 63*j*1. The two anchoring portions 71*d* located adjacent to the anchoring portion 71*c* have a square cross section, extending in the longitudinal direction of the development cartridge D. They each are provided with the aforementioned latching claw (unillustrated). The locking member 71 is locked with the longitudinal end wall 63*h* of the cartridge frame 63 by engaging the anchoring portions 71*d* in the square holes 63*j*2 cut adjacent to the hole 63*j*1.

Referring to FIG. 12, when the shutter 64 is open, the tip of the latching portion 71*b* is in contact with the edge portion of a cam 64n in the form of an arc that is concentric with the hole 64*a* of the side wall 64*e* of the shutter 64. As the shutter 64 is closed, the latching portion 71*b* engages in the latching portion catching recess 64*t* of the edge portion 64*n* of the cam of the shutter 64, whereby the shutter 64 is locked shut, being prevented from unexpectedly opening.

As the development cartridge D is inserted into the apparatus main assembly 30, the latching portion 71*b* is automatically disengaged from the recess 64*t*, and at the same time, the shutter 64 is opened. (Installation and Removal of Development Cartridge)

Next, referring to FIGS. 13–19, steps for installing the development cartridge D into the apparatus main assembly 30, and steps for properly positioning the development cartridge D in the apparatus main assembly 30, will be described in detail.

First, referring to FIG. 14, the inwardly facing surface of the longitudinal end wall 11*a* of the rotary unit 11 is provided with the guide 59, which comprises: an entrance portion 59*b* between the slanted ribs 59*a* which are slanted so that the distances between them are greater at the top than at the bottom; a projection guiding portion 59*d* between approximately parallel straight ribs 59*c*; a projection accommodating portion 59*f*, as the development cartridge supporting portion, between the arc-shaped ribs 59*e*; a guide accommodating portion 59*h* between the approximately parallel straight ribs 59*g* continuous from the arc-shaped ribs 59*e*. The inwardly facing surface of the longitudinal end wall 11*e*, that is, the counterpart of the wall 11*a*, is provided with the guide 26.

Figure 15:
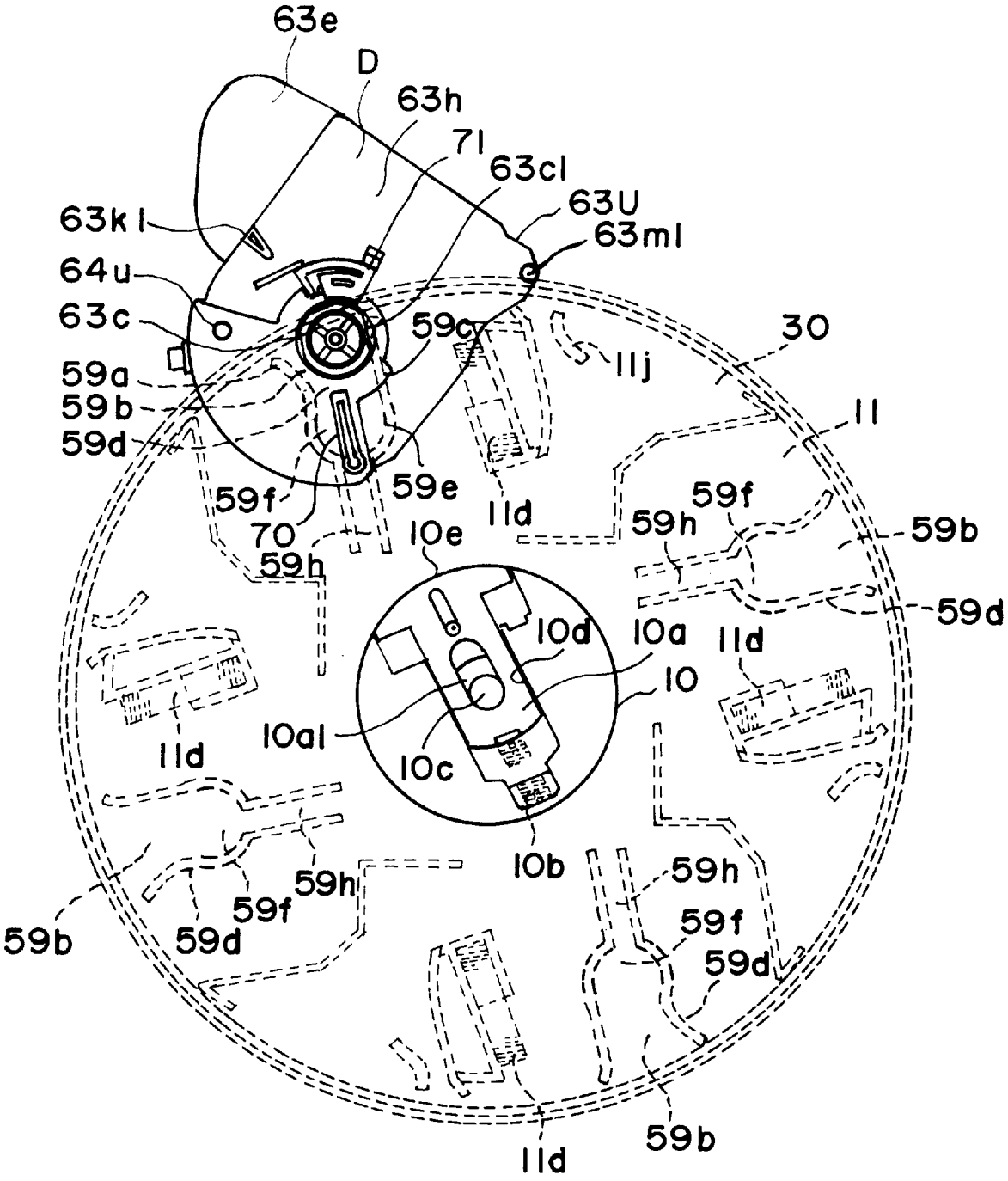
FIG. 15 is a side view illustrating a mounting operation of a developing cartridge onto a rotary unit.
Figure 18:
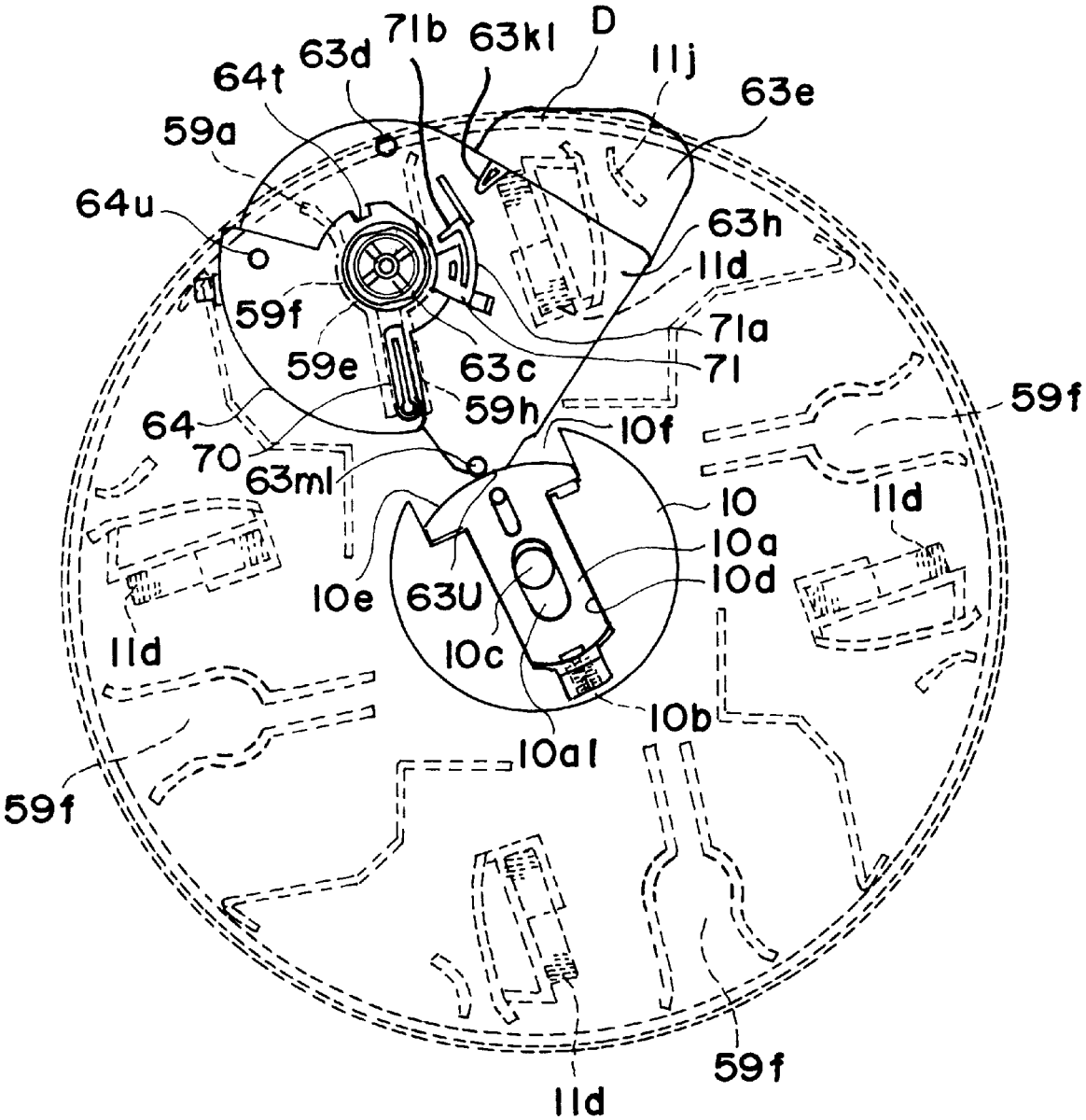
FIG. 18 is a side view illustrating a mounting operation of a developing cartridge onto a rotary unit.

Next, referring to FIGS. 13 and 14, each longitudinal end of the central shaft 10 that supports the rotary unit 11 is fitted with the sliding member 10*a*, which is placed adjacent to the inwardly facing surface 11*e* of the longitudinal end flange 11*f* of the rotary unit 11 (and also, inwardly facing surface 11*a* of the longitudinal end flange 11*g* of the rotary unit 11) when the development cartridge D is in the rotary unit 11. Moving to FIG. 15, the sliding member 10*a* is symmetrical relative to the line drawn through the center of the central shaft 10 of the rotary unit 11 and the center of the arc-shaped ribs 59*e*, and is slidably coupled with a guide portion 10*d*, the center line of the cross section of which is parallel to the aforementioned line. Further, the sliding portion 10*a* is provided with a hole 10*a*1, which extends in parallel to the guide portion 10*d*, that is, in the longitudinal direction of the central shaft 10, and the cross section of which is in the form of an elongated circle. In this hole 10*a*1, a pin shaft 10*c* fixed to the central shaft 10 is fitted, allowing the sliding member 10*a* to take two positions: a position at which the arcing peripheral surface 10*e* of the sliding member 10*a* becomes continuous with the peripheral surface of the central shaft 10*a*, forming a cylindrical surface, as illustrated in FIG. 15, and another position to which the sliding member 10*a* retracts to provide the central shaft 10 with a recess 10*f*, the bottom of which is constituted of the arcing peripheral surface of the sliding member 10*a*, as shown in FIG. 18. Between the bottom surface of the guide portion 10*d* and the inward end of the sliding member 10*a*, a compression spring 10*b* is placed in the compressed state. The width of the arcing peripheral surface 10*e* of the sliding member 10*a* (distance between one straight edge of the arcing peripheral surface of the sliding member to the other, measured in a straight line which is parallel to FIG. 18, and perpendicular to the aforementioned straight line drawn through the centers of the central shaft 10 and the arc-shaped ribs 59*e*) is such that when the development cartridge D is in the development cartridge space of the rotary unit 11, the development cartridge attitude controlling bosses 63*m* (63*m*1, 63*m*2) contact the arcing peripheral surface of the sliding member 10*a*.

When installing the development cartridge D into the apparatus main assembly 30, the user first inserts the development cartridge D, while allowing the sliding guide portion 70 and the projection 63*c* of the shutter 64 to be guided by the entrance portion 59*b* of the guide 59 (FIG. 15).

Figure 16:
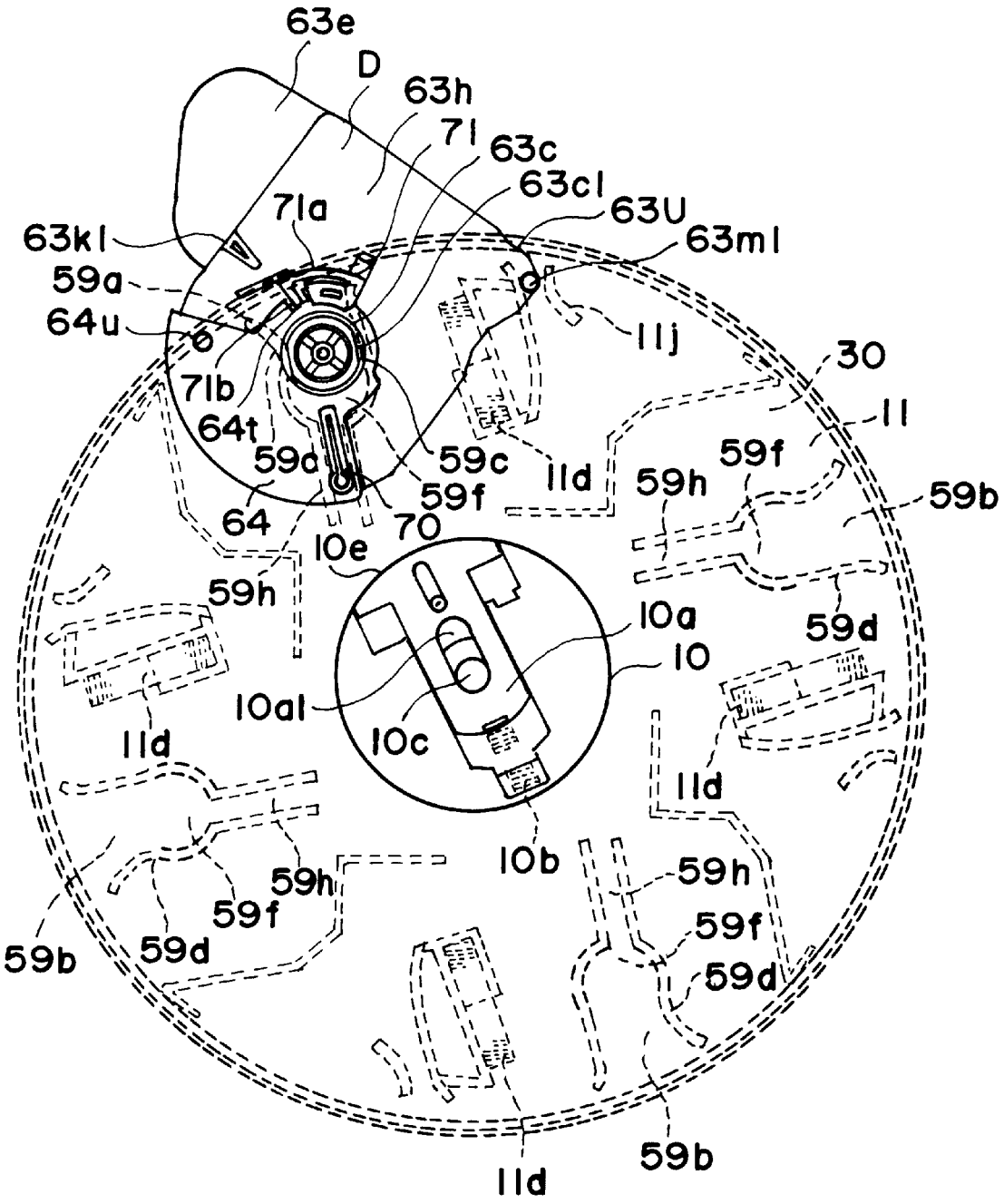
FIG. 16 is a side view illustrating a mounting operation of a developing cartridge onto a rotary unit.

As the development cartridge D is farther inserted, the projection 63*c* located at one of the longitudinal ends of the development cartridge D enters the straight portion of the projection guiding portion 59*d* between the straight ribs 59*c* as illustrated in FIG. 16. The projection 63*c* comprises a cut portion 63*c*1, the peripheral surface of which is constituted of two parallel flat surface, and two arcing surfaces located between the flat surfaces. The distance (width W1 in FIG. 14) between the two straight ribs 59*c* is such that the projection 63*c* is allowed to be guided through the projection guiding portion 59*d* only when the projection 63*c* is positioned so that the flat surfaces of the cut portion 63*c*1 become parallel to the straight ribs 59*c*. Therefore, the projection 63*c* is guided through the projection guiding portion 59*d*, with the cut portion 63*c*1 flatly engaged with the straight ribs 59*c*, causing thereby the development cartridge D to hold a predetermined angle (attitude) as it is inserted into the apparatus main assembly 30.

Figure 17:
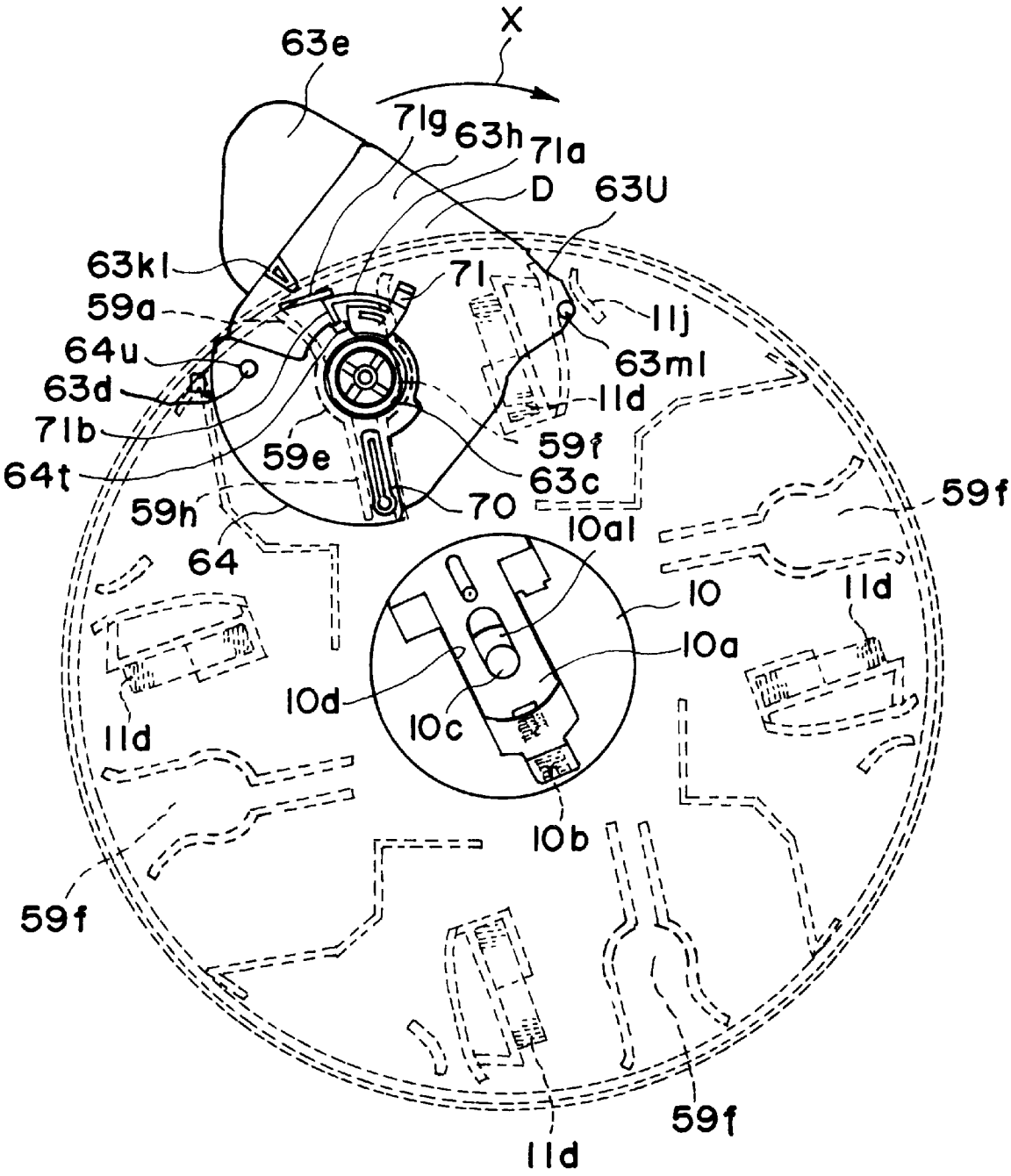
FIG. 17 is a side view illustrating a mounting operation of a developing cartridge onto a rotary unit.

Next, referring to FIG. 17, as the projection 63*c* is inserted as far as the arc-shaped ribs 59*e*, the tip of one of the two slanted ribs 59*a* comes in contact with the arm portion 71*g* of the locking member 71 that is locking the shutter 64, and pushes up the arm portion 71*g* as illustrated in FIG. 17. As a result, the supporting portion 71*a* is elastically deformed and causes the latching portion 71*b* to slip out of the latching portion catching recess 64*t* of the shutter 64; the shutter 64 is unlocked (in this embodiment, the slanted portion 59*a* doubles as a locking member disengaging member). The unlocked shutter 64 is rotatable relative to the cartridge frame 63. The arc-shaped ribs 59*e* have such a radius that allows the projection 63*c* to freely rotate, and therefore, the development cartridge D becomes rotatable about the projection 63*c*.

On the other hand, the projection 63*g* provided on the other longitudinal end wall 63*i* of the development cartridge D enters the entrance portion of the guide 26, being guided by the slanted portion 26*c* of the guide 26 illustrated in FIG. 13. As the development cartridge D is farther inserted, the cut portion 63*g*3 of the projection 63*g* enters between the two parallel straight ribs 26*e*, with the two flat peripheral surfaces of the cut portion 63*g*3 flatly engaging with the surfaces of the correspondent straight ribs 26*e*, causing thereby the development cartridge D to hold a predetermined angle (attitude) as it is inserted into the apparatus main assembly 30. The development cartridge D is inserted until the projection 63*g* engages with the arc-shaped ribs 26*a* (projection supporting ribs). The arc-shaped ribs 26*a* have such a radius that allows the projection 63*g* to rotate as it is supported by the arc-shaped ribs 26*a*. In other words, one of the longitudinal ends of the cartridge frame 63 is supported by the arc-shaped ribs 59*e*, as the supporting members, of the guide 52, with the projection 63*c* being supported by the ribs 59*e*, and the other is supported by the arc-shaped ribs 26*a*, as the supporting members, of the guide 26, with the projection 63*g* being supported by the arc-shaped ribs 26*a*. Thus, the development cartridge D is supported by the rotary unit 11 so as to be rotatable about the projections 63*c* and 63*g*.

The structure for installing, without a mistake, the development cartridge Dm, Dc, Dy and Db in the cartridge installation spaces 14*m*, 14*c*, 14*y* and 14*b* of the rotary unit 11, will be described later.

Next, as the user pushes, by hand, the handhold portion 63*e* of the cartridge frame 63 in the state illustrated in FIG. 17, the cartridge frame 63, the projections 63*c* and 63*g* of which are supported by the arc-shaped ribs 59*e* and 26*a*, respectively, rotate, although shutter 64 is still locked because the guide portion 70 is still in the guide accommodating portion 59*h*. Then, as the cartridge frame 63 rotates, the semispherical projection 63*d* comes out of the hole 64*u* of the shutter 64 and moves to a predetermined point (direction indicated by an arrow mark X in FIG. 17). As described before, in this embodiment, the shutter 64 is provided with the insertion guide portion 70, and therefore, the cartridge frame 63 can be easily rotated while keeping the shutter nonrotatable. Then, as the semispherical projection arrives at the predetermined point, the carriage frame 63 is locked by the positioning means, which will be described later. In other words, the development cartridge D has been successfully installed.

Figure 19:
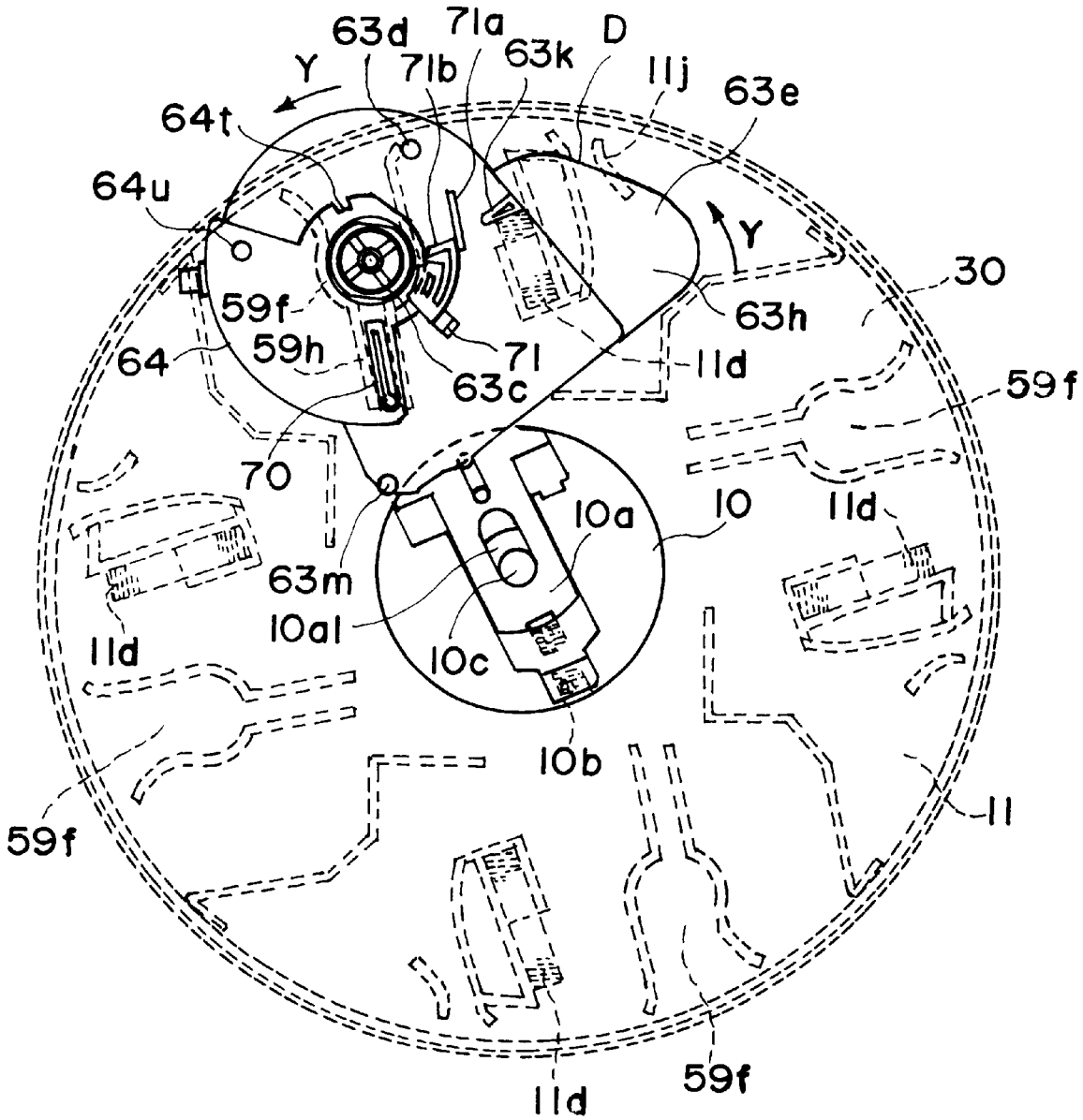
FIG. 19 is a side view illustrating a mounting operation of a developing cartridge onto a rotary unit.

Further, as the development cartridge D in the state illustrated in FIG. 17 is rotated in the arrow X direction, the cartridge attitude controlling bosses 63*m* (63*m*1 and 63*m*2) provided on the longitudinal end walls 63*h* and 63*i* of the cartridge frame 63 push the sliding member 10*a* down, which is slidably coupled in the guide portion 10*d* deep enough to reach across the rotational axis of the central shaft 10, and which is being pressed outwardly by the compression spring 10*b* (FIG. 18). As described before, the sliding member 10*a* has the hole 10*a*1, which extends through the sliding member 10*a* in parallel to the guide portion 10*d*, and the cross section of which is in the form of an elongated circle. And, the pin shaft 10*c* fixed to the central shaft 10 is put through this hole 10*a*1. Therefore, the sliding member 10*a* is slidable only in a limited range. In other words, the sliding member 10*a* is allowed to slide outward as far as a point at which the pin shaft 10*c* makes contact with the outward side of the hole 10*a*1. Also as described before, when the sliding member 10*a* is at this outward point, the arcing outward peripheral surface of the sliding member 10*a* forms a continuous surface with the peripheral surface of the central shaft 10. Next, as the cartridge frame 63 is farther rotated, the spring contacting portion 63*k* provided on the longitudinal end walls 63*h* and 63*i* of the cartridge frame 63, one for one, are pressed by the springs 11*d* provided on both longitudinal ends of the rotary unit 11, one for one. As a result, the cartridge frame 63 is subjected to such force that works in the direction to rotate the cartridge frame 63 in the direction indicated by an arrow mark Y (FIG. 19). However, since both attitude controlling bosses 63*m* remain in contact with the sliding member 10*a* coupled with the central shaft of the rotary unit 11, the attitude of the cartridge frame 63 becomes stabilized as the cartridge frame 63 is rotated to the angle illustrated in FIG. 19.

In other words, the development cartridge D has been successfully installed in the predetermined position in the rotary unit 11.

A referential code 11*j* designates a guide portion provided on the rotary unit 11. It guides the boss 63*m*.

Through the steps described above, the shutter 64 is rotated relative to the cartridge frame 63, that is, the shutter 64 is opened, exposing the development roller 12 so that the development roller 12 is allowed to directly face the photosensitive drum 1. The point at which the operator should begin to rotate the development cartridge D during the installation of the development cartridge D is recognizable by the operator because a sensation of clicking is generated when the semispherical projection 63*d* comes out of the hole 64*u* of the shutter 64.

The diameter of the cylindrical portion 63*c*2 of the projection 63*c* is greater than the distance between the two parallel flat peripheral surfaces of the cut portion 63*c*1, and therefore, once the projection 63*c* is supported by the arc-shaped ribs 59*e*, the projection 63*c* does not come out through the gap between the straight ribs 59*c* while it is rotating.

Similarly, the diameter of the cylindrical portion 63*g*4 of the projection 63*g* on the other end of the development cartridge D is greater than the distance between the two parallel flat peripheral surfaces of the cut portion 63*g*3, and therefore, once the projection 63*g* is supported by the arc-shaped ribs 26*a*, the projection 63*g* does not come out through the gap between the straight ribs 26*e* while it is rotating.

On the other hand, in order to remove the development cartridge D from the apparatus main assembly 30, the cartridge frame 63 must be rotated in the direction opposite to the installing direction, by the operator. As the development cartridge D is reversely rotated, the flat peripheral surfaces of the cut portion 63*c*1, become parallel to the straight ribs 59*c*, and the shutter 64 closes. As the shutter 64 closes, the semispherical projection 63*d* engages with the hole 64*u*, and as the projection 63*d* engages with the hole 64*u*, the aforementioned clicking is felt by the operator, and therefore, the operator can recognize that the development cartridge D has been rotated to the final position (installation-removal position). Then, the operator pulls out the development cartridge D from the apparatus main assembly 30. As the operator pulls out the development cartridge D, the supporting portion 71*a* of the locking member 71 elastically returns to the locking position as illustrated in FIG. 16, causing the latching portion 71*b* to engage with the latching portion catching recess 64*t*; in other words, the shutter 64 is automatically locked.

With the provision of the development cartridge D with the shutter 64 structured as described above, it is possible to prevent dust or the like from adhering to the development roller 12. Further, since the shutter 64 is provided with the locking mechanism, the shutter 64 is prevented from unexpectedly opening.

The shutter 64 remains closed while the development cartridge D is inserted into the apparatus main assembly 30, and therefore, the development roller 12 is not damaged during the insertion. Further, the operator is not required to remove the development roller protecting members or the like from the development cartridge D by hand before inserting the development cartridge D.

Further, during the insertion of the development cartridge D into the apparatus main assembly 30, the shutter lock is automatically unlocked, and also, after insertion, as the development cartridge D is rotated, the shutter 64 is automatically opened to allow the development roller 12 to directly face the photosensitive drum 1 to complete the installation. Therefore, the installation of the development cartridge D becomes more efficient.

(Positioning of Development Cartridge)

Next, the positioning of the development cartridge D will be described.

Figure 20:
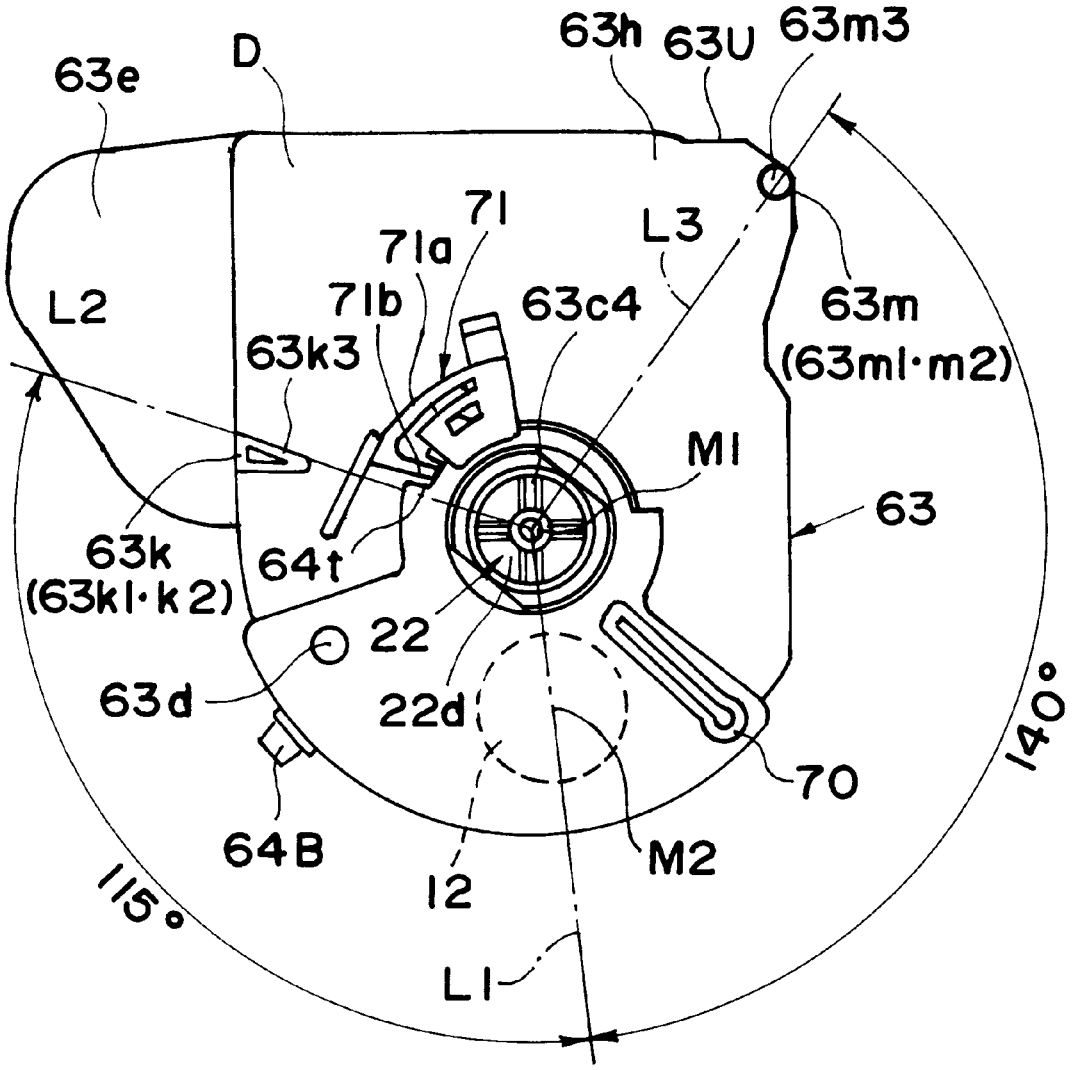
FIG. 20 is a side view illustrating a relation between a guide of the developing cartridge and a positioning member.

First, referring to FIG. 20, the positioning of the spring contacting portion 63*k* (63*k*1 and 63*k*2) as the member for bearing the spring pressure, and the positioning of the development cartridge attitude controlling bosses 63*m* (63*m*1 and 63*m*2) as the pushing members, will be described.

In the following description, the structures of the cartridge frame 63 at the longitudinal ends will be described with reference to the longitudinal end with wall 63*h*, and the same description applies to the longitudinal end with the wall 63*i*.

In this embodiment, as seen from the longitudinal direction of the development roller 12, the spring contacting portion 63*k* is positioned in a range from approximately 100 deg. to 130 deg. from the straight line drawn through the rotational center M2 of the development roller 12 and the rotational center M1 of the driving force receiving member 22, measured about the rotational center M1.

More specifically, as seen from the longitudinal direction of the development roller 12, the spring contacting portion 63*k*1 (63*k*2) is positioned so that the angle between the straight line L1 drawn through the rotational center M2 of the development roller 12 and the rotational center M1 of the driving force receiving member 22, and the straight line L2 drawing through the spring force receiving surface 63*k*3 (which aligns with the radial direction of the driving force receiving member 22) of the spring contacting portion 63*k*1 (63*k*2), becomes approximately 100 deg. to 130 deg. The actual angle in this embodiment is approximately 115 deg.

The boss 63*m* (63*m*1 and 63*m*2) is positioned approximately 130 deg. to 150 deg. away from the straight line L1 in the direction opposite to the direction of the spring force receiving portion 63*k*1 (63*k*2).

More specifically, the boss 63*m* is positioned so that the angle between straight line L1 and the straight line L3 drawn through the center 63*m*3 of the boss 63*m* and the rotational center M1 falls in an approximate range of 130 deg. to 150 deg. The actual angle in this embodiment is approximately 140 deg.

With the positioning of the spring force receiving portion 63*k* (63*k*1, 63*k*2) and the boss 63*m* (63*m*1, 63*m*2) as described above, the spring contacting portion 63*k* is enabled to desirably bear the elastic force of the compression spring 11*d* provided on the rotary unit 11 of the apparatus main assembly 30. In addition, the boss 63*m* is enabled to desirably contact the sliding member 10*a* coupled with the central shaft 10. Therefore, the development cartridge D can be precisely positioned in the development cartridge space.

The boss 63*m* (63*m*1, 63*m*2) is projected outwardly from the side surface 63*h* or 63*i* of the cartridge frame 63 by approx. 2 mm–15 mm. In this embodiment, the boss 63*m* is projected by approx. 4 mm.

The spring receptor portion 63*k* (63*k*1, 63*k*2) is projection outwardly from the side surface 63*h*, 63*i* of the cartridge frame 63 by approx. 2 mm–20 mm. In this embodiment, the spring receptor portion 63*k*1 is projected by approx. 10 mm, and 63*k*2 is projected by approx. 6 mm. In other words, the projection height of the spring receptor portion 63*k*1 provided at the driving force reception side is larger.

(Driver of the Developing Cartridge)

The description will be made as to a drive transmission structure for transmission from the main assembly of the apparatus to the developing cartridge D.

Figure 22:
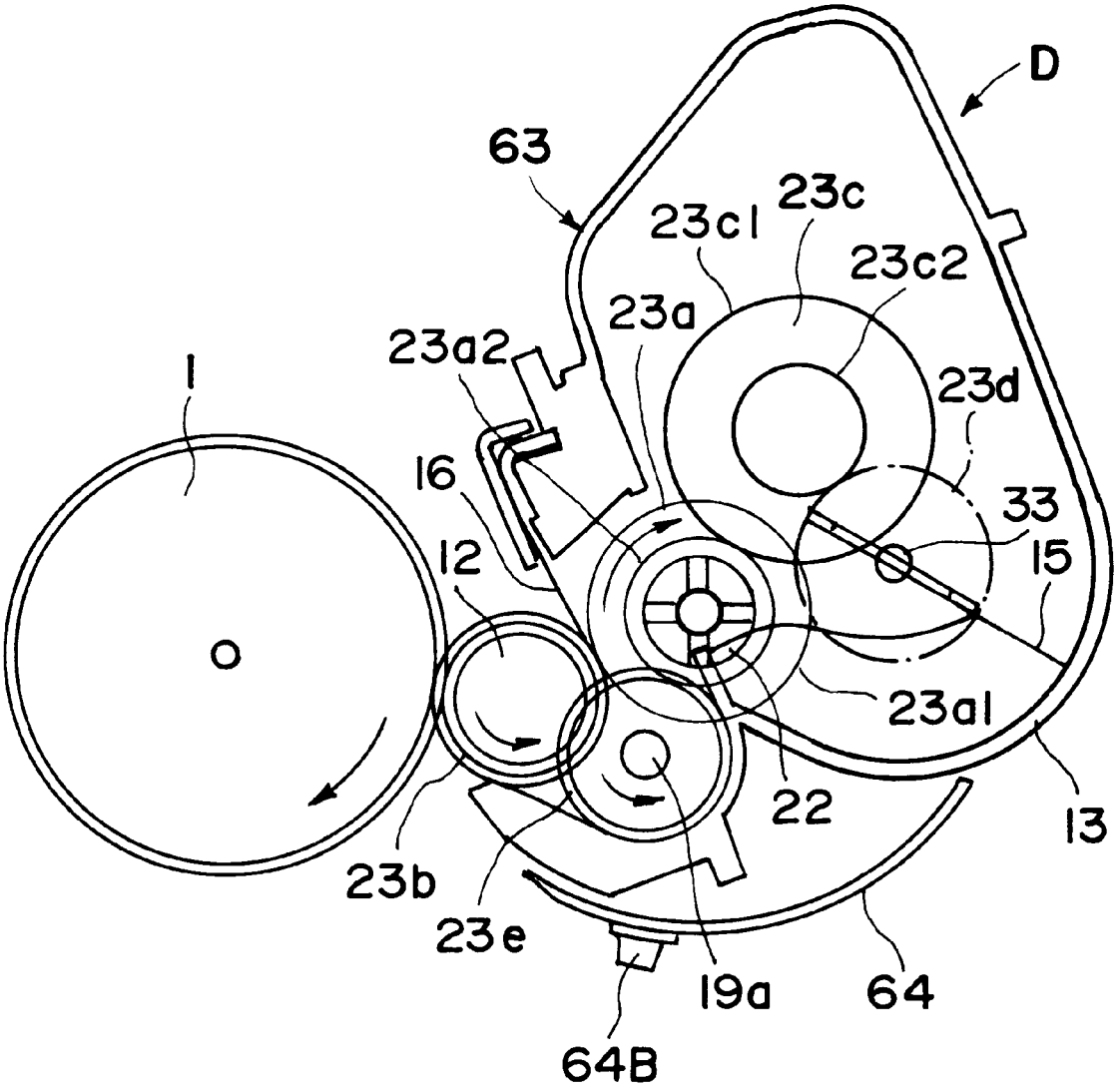
FIG. 22 is a side view of a driving device for the developing cartridge.
Figure 44:
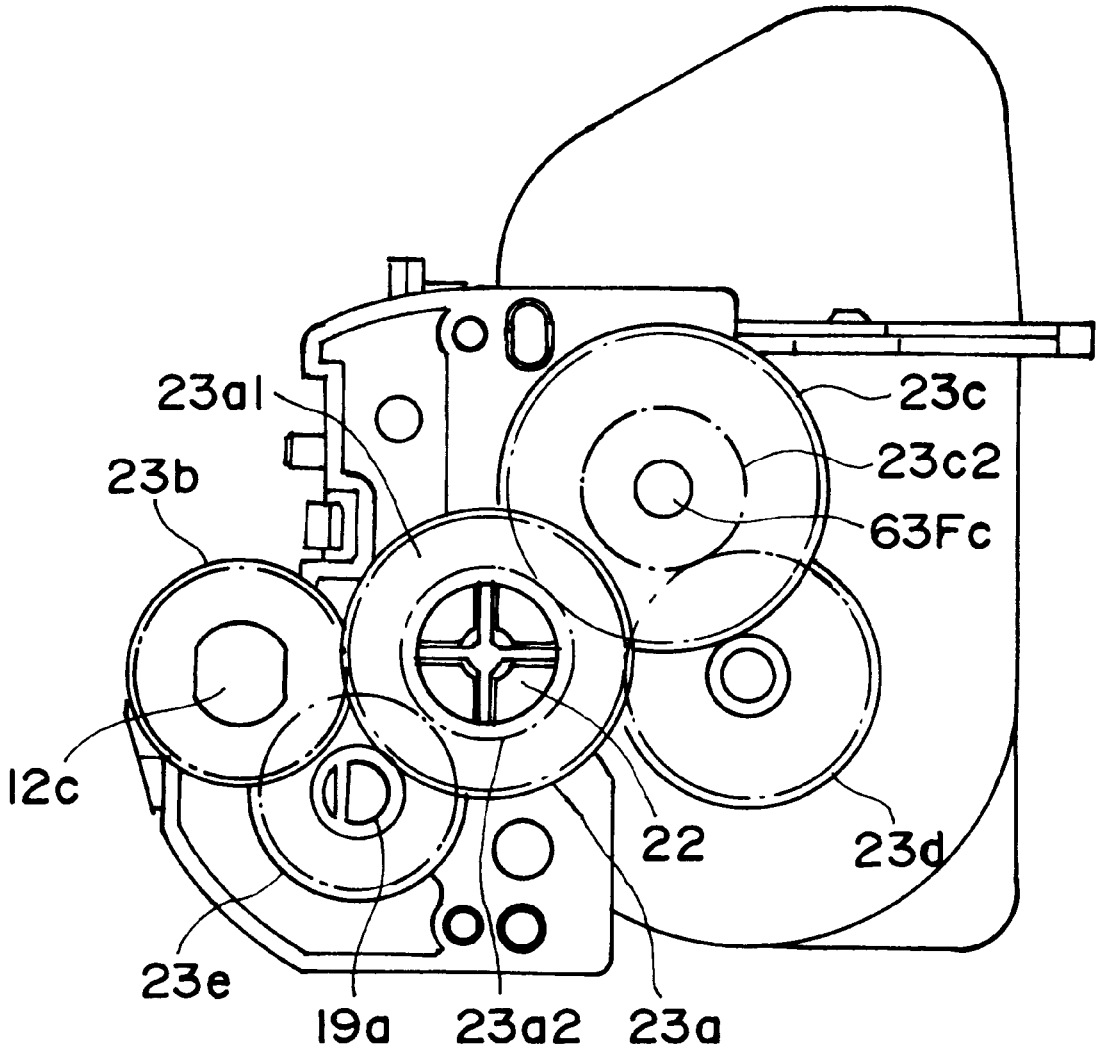
FIG. 44 is a side view of driving means of a developing cartridge.

As shown in FIGS. 21, 22 and 44, one of projections which is cylindrical (projected portion 63*c*), of the projected portions 63*c*, 63*g* of the both side surfaces 63*h*, 63*i* at the longitudinal opposite ends of the cartridge frame 63, has therein a driving force receiving member 22 for transmitting rotation driving force from the main assembly 30 to the developing roller 12. The driving force receiving member 22 has an integrally molded stepped driving gear 23*a*. A large gear 23*a*1 of the gear 23*a* is in meshing engagement with the developing roller gear 23*b* mounted to the rotation shaft 12*c* of the developing roller 12, and the developing roller 12 is rotated when the driving force is transmitted to the driving force receiving member 22. A small gear 23*a*2 of the gear 23*a* is in meshing engagement with a stirring gear 23*d* which is integrally molded with a journal 33 (FIG. 31) which is a rotation shaft of the toner feeding member 15 through the stepped idler gear 23*c* so as to transmit the rotating force also to the toner feeding member 15. An application roller gear 23*e* fixed on the rotation shaft 19*a* of the application roller 19 is in meshing engagement with a small gear 23*a*2 integral with the driving force receiving member 22.

The free end portion of the driving force receiving member 22 has a cross-shaped rib functioning as a coupling member 22*d*, which is couplable with a rive transmission member of the main assembly 30 which will be described hereinafter.

On the other hand, as shown in FIG. 21, the rotary unit 11 in the main assembly 30 of the image forming apparatus is provided with a drive transmission member 24, coaxial with and opposed to the driving force receiving member 22 when the developing cartridge D is mounted in place, for transmitting driving force from a motor 24M. The transmitting mechanism for transmitting the driving force to the drive transmission member 24 from the motor 24M is schematically shown by chain lines. The drive transmission member 24, as shown by a in FIG. 21, is movable in the axial direction of the driving force receiving member 22, and the end portion thereof is formed into a coupling configuration engageable with the rib of the driving force receiving member 22. Here, the coupling configuration means the shape with which the driving force receiving portion 22 and the drive transmission member 24 are coupled when the drive transmission member 24 is moved relative to the driving force receiving portion 22, and when one of them rotates, the other also rotates. In this embodiment, the driving force receiving member 22 is provided with four recesses 22*a*, and the drive transmission member 24 has four projections 24*a*. The driving force receiving member 22 is rotated by the rotation of the drive transmission member 24 while the recesses 22*a* and the projections 24*a* are engaged.

When the developing cartridge D mounted in place is moved to the developing position for image formation by rotation of the rotary unit 11, the drive transmission member 24 is moved toward the driving force receiving member 22 by the moving mechanism (unshown), and is engaged with the driving force receiving member 22 to transmit the driving force to the developing roller 12 or the like. Thus, even if the stop position of the developing cartridge D relative to the photosensitive drum 1 is more or less deviated, or the generating lines of the photosensitive drum 1 and the rotary unit 11 are more or less deviated, the driving force only by the coupling is transmitted at the constant position to developing cartridge D, and therefore, it is possible to reduce the pitch non-uniformity due to gear meshing defect.

Figure 23:
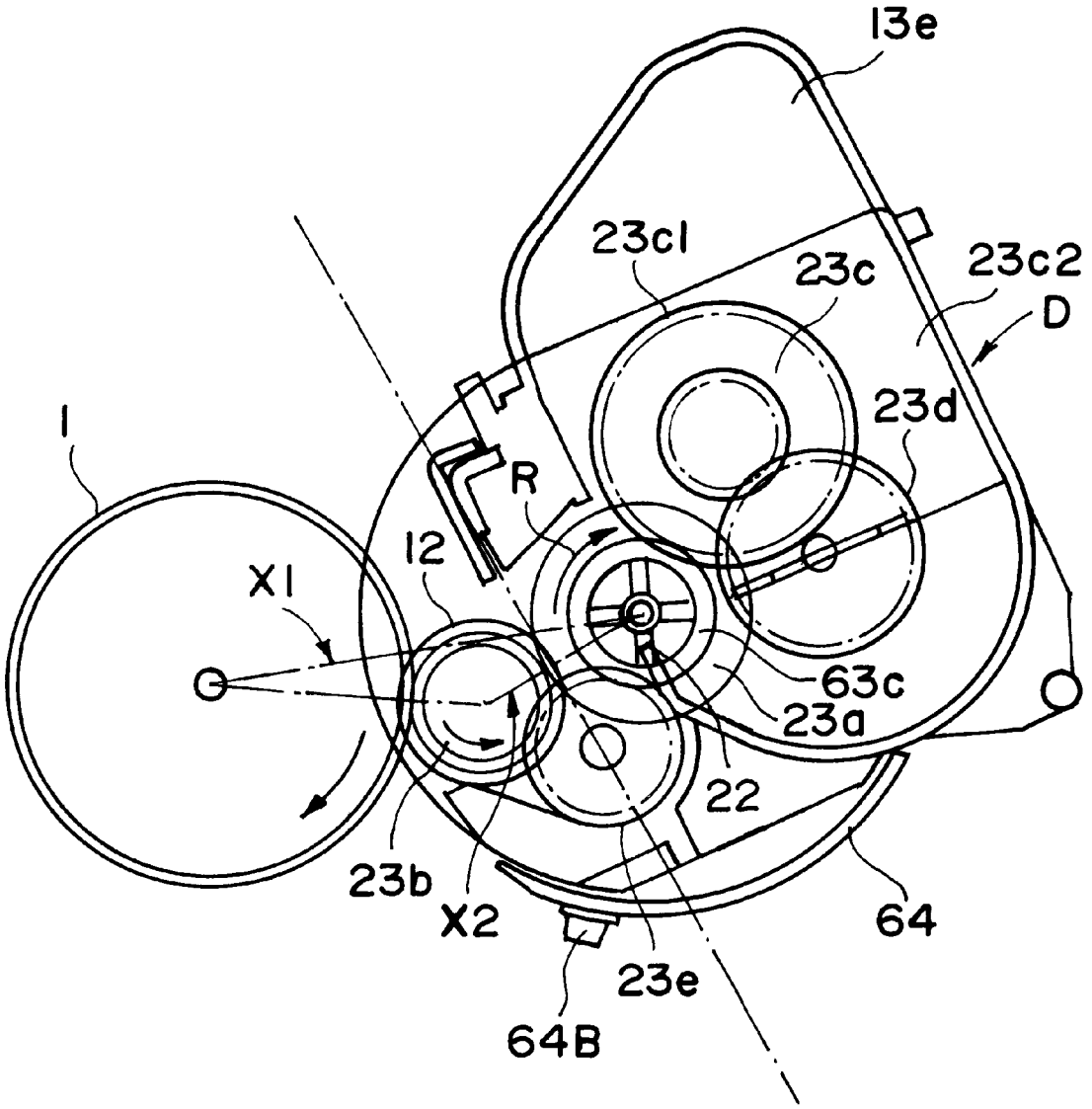
FIG. 23 is a side view showing a preferable arrangement of a driving member of a developing cartridge.
Figure 24:
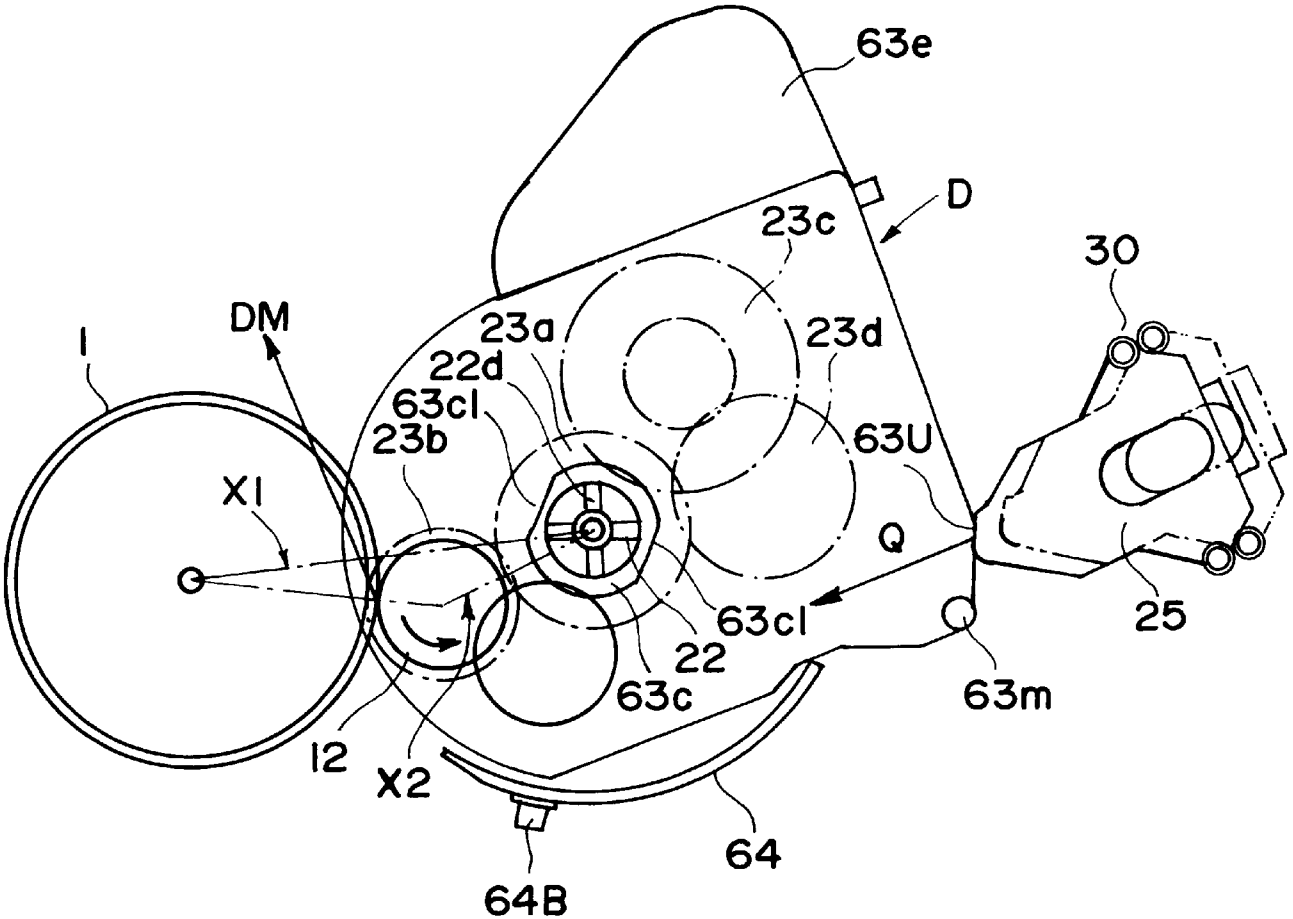
FIG. 24 is a side view showing a preferable arrangement of a driving member of a developing cartridge.

Referring to FIGS. 23 and 24, the structure for stabilizing the pressure of the developing roller 12 to the photosensitive drum 1, will be described. The same reference numerals as in FIG. 22 are assigned to the elements having the corresponding functions, and detailed descriptions thereof are omitted for simplicity.

As described in the foregoing, the rotating force is transmitted to the driving force receiving member 22 of the developing cartridge D from the drive transmission member 24 of the main assembly 30 at the development position.

In FIG. 23, the developing cartridge D is at the developing position.

At this time, a line X1 connecting a center of rotation of the developing cartridge D which is the center of the projected portion 63*c* of the developing cartridge D and the center of rotation of the photosensitive drum 1, and a line X2 connecting a center of rotation of the projected portion 63*c* and a center of rotation of the developing roller 12, satisfy that line X2 is upstream of the line X1 with respect to a driving rotational direction R of the driving force receiving member 22 as seen from a rotational center of the projected portion 63*c*.

With this structure, the developing cartridge D receives rotation moment in the direction R so that developing roller 12 is urged normally toward the photosensitive drum 1, and therefore, the development operation of the developing roller 12 is stabilized. This is advantageous in a so-called contact development, but is particularly advantageous in the case of non-contact development since a gap between the photosensitive drum 1 and the developing roller 12 is stabilized.

As shown in FIG. 24, there may be provided urging means 25 movable in the direction indicated by the arrow to fix the developing cartridge D by urging it toward the photosensitive drum 1 when the developing cartridge D is at the developing position. In such case, a direction DM of moment produced in the developing cartridge D by the urging action of the urging means 25, the line X1 connecting a center of rotation of the developing cartridge D (said projected portion 63*c*) and a center of rotation of the photosensitive drum 1, and the line X2 connecting the center of rotation of the projected portion 63*c* and the center of rotation of the developing roller 12, may satisfy that line X2 is upstream of the line X1 with respect to the direction DM of the moment as seen from the center of rotation of the projected portion 63*c*, since the same effects are provided. Here, the urging means 25 is provided at each of the longitudinal ends of the developing cartridge D to urge the rear surface portion of the toner accommodating portion 63*a*.

(Erroneous Mounting Prevention Means of the Developing Cartridge)

The developing cartridges D (Dm, Dc, Dy, Db) have the mounting portions which are the same in the configurations, dimensions or the like, and are mountable to any of the cartridge mounting portions of the rotary unit 11. By providing means for preventing the user from mounting an improper developing cartridge to any one of the cartridge mounting portion of the rotary unit 11, the operativity is improved. As shown in FIGS. 2, 3, 13, 14, the rotary unit 11 has a disk-like flanges 11*f*, 11*g* at the opposite ends thereof, and the center of the flange is supported by shaft means 10. The cartridge mounting portions 14 are disposed in the rotary unit 11 equidistantly in the circumferential direction. More particularly, four cartridge mounting portions 14 are provided equidistantly, and are to receive developing cartridges Dm, Dc, Dy, Db respectively (cartridge mounting portions 14*m*, 14*c*, 14*y*, 14*b*).

Separation plates 11*m*, 11*c*, 11*y*, 11*b* are extended between the flanges 11*f*, 11*g* to divide into the cartridge mounting portions 14, and the flanges 11*f*, 11*g* are connected with each other thereby. The separation plates 11*m*, 11*c*, 11*y*, 11*b*, are extended in the axial direction of the rotary unit 11 in the section shown in FIGS. 2, 3. The separation plates 11*m*, 11*c*, 11*y*, 11*b* are provided with main assembly discriminating portions 11*m*1, 11*c*1, 11*y*1, 11*b*1 at an end adjacent the flange 11*g* (flange 11*g* side). In FIGS. 2, 3, the rotary unit 11 is shown in a crosssection at the position of the discriminating portion 11*c*, and the discriminating portions 11*m*1, 11*y*1, 11*b*1 are not seen in the Figures, since the discriminating portions 11*m*1, 11*c*1, 11*y*1, 11*b*1 are longitudinally different positions of the rotary unit 11. The discriminating portions 11*m*1, 11*c*1, 11*y*1, 11*b*1 have the same configurations, and are in the form of recesses at an outer edge of each of the separation plate 11*m*, 11*c*, 11*y*, 11*b*.

Figure 43:
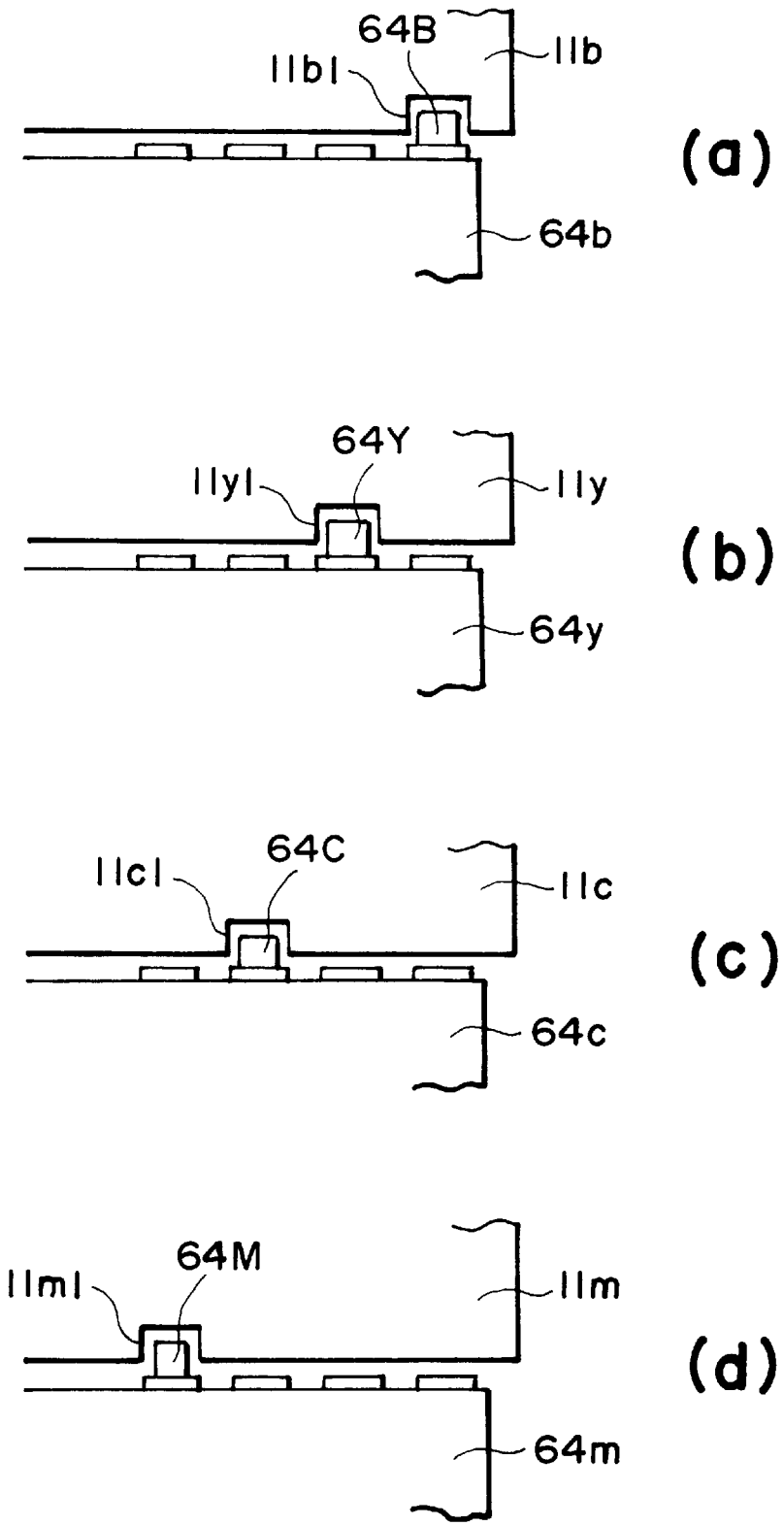
FIG. 43 ((a), (b), (c), (d)) is schematic top plan views of a developing cartridge discriminating means.

On the other hand, as shown in FIGS. 25, 43, the shutter 64 (64*m*, 64*c*, 64*y*, 64*b*) of the developing cartridge D is provided with a cartridge discriminating portion 64M, 64C, 64Y or 64B for distinguishing the developing cartridges D (FIGS. 2, 3, 25 indicate discriminating portion 64B). The discriminating portions 64M, 64C, 64Y, 64B are disposed at longitudinally different positions on the outer periphery of the cylindrical portions of the shutter 64 of the developing cartridge D. The discriminating portions 64M, 64C, 64Y, 64B are in the form of projections extending from the outer periphery of the shutter 64. The centers of the discriminating portions 64M, 64C, 64Y, 64B are on a line substantially passing through the center of the round hole 64*a* and perpendicular to a guide 70 which is in the form of a linear rib extending toward the center of the round hole 64*a* provided in the shutter 64, as seen in the longitudinal direction of the shutter 64. The discriminating portions 64M, 64C, 64Y, 64B are concentrated at an open end 64*h* of the shutter 64 faced to the developing roller 12 and adjacent the driving force reception side in the longitudinal direction.

As shown in FIG. 25, the shutter 64 has four seats 64*s* arranged at equal intervals in the longitudinal direction, to which blocks 64*r* are mountable to establish the discriminating portions 64M, 64C, 64Y, 64B. The seat 64s has block positioning holes 64*p*, 64*q* spaced in the circumferential direction of the shutter 64. The hole 64*p* is a round hole, and the hole 64*q* is elongated hole elongated in the circumferential direction of the shutter 64. The block 64*r* is substantially cubic and is provided, on a side which is not seen in FIG. 25 and which is opposed to a side opposing to the seat 64*s*, with projections engageable with the holes 64*p*, 64*q*. By engagement therebetween, the block 64*r* is correctly positioned and is fixed by bonding material.

The block 64*r* is mounted to one of the four seats 64*s* to provide a discriminating portion 64M, 64C, 64Y or 64B of the developing cartridge D. When the developing cartridge D provided with the discriminating portion 64M, 64C, 64Y or 64B is mounted to the mounting portion 14*m*, 14*c*, 14*y*, 14*b*, the discriminating portion 64M, 64C, 64Y, 64B of the developing cartridge D is engaged with the discriminating portion 11*m*1, 11*c*1, 11*y*1, 11*b*1 of the cartridge mounting portion 14, so that it may be permitted to enter the cartridge mounting portion 14*m*, 14*c*, 14*y* or 14*b*. However, to the cartridge mounting portion 14*y*, for example, any one of the developing cartridges Dm, Dc, Db is not mountable because any one of the discriminating portions 64M, 64C, 64B abuts the edge without the discriminating portion 11*y*1 of the separation plate 11*y*.

Similarly, the cartridge mounting portion 14*m* for the magenta color developing cartridge Dm rejects any one of the developing cartridges Dy, Dc, Db by the cartridge mounting portion 14*m*. The cartridge mounting portion 14*c* for the cyan color developing cartridge Dc rejects any one of the developing cartridges Dy, Dm, Db. The cartridge mounting portion for the black toner developing cartridge Db rejects any one of the developing cartridges Dy, Dm, Dc.

Figure 26:
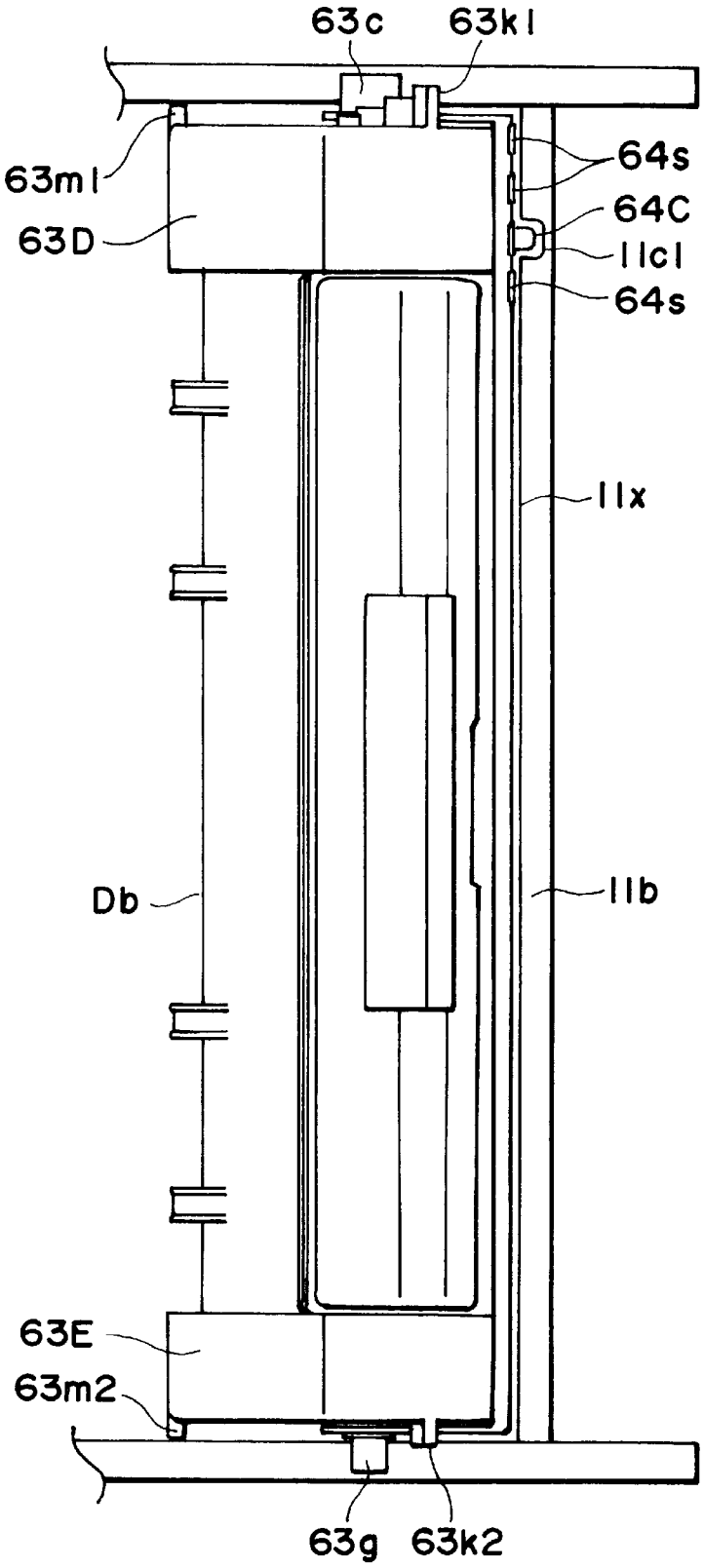
FIG. 26 is top plan view illustrating mounting of a rotary unit of a developing cartridge.

FIGS. 2, 26 show the state in which the developing cartridge Dc is in the process of being mounted to the cartridge mounting portion 14*c*. When the developing cartridge Dc is mounted to the cartridge mounting portion 14*c*, the linear guide portion 70 of the developing cartridge Dc is inserted into a guide inserting portion 59*h* of the cartridge mounting portion 14*c* so that shutter 64 enters the cartridge mounting portion 14*c* in the linear direction, and simultaneously, the developing cartridge Dc makes a translational motion in the lateral direction. It reaches a position where the position determining boss 63*m* of the developing cartridge Dc can enter the guide portion 11*j* provided in the wall surface 11*a* of the driving side flange 11*g* of the rotary unit 11. The discriminating portion 64C provided in the shutter 64 comes close to the edge 11*x* of the separation plate 11*c*, but the edge 11*x* is provided with a discriminating portion 11*c*1 (recess) which permits only the discriminating portion 64C to enter, and therefore, the projected portion 63*c* of the developing cartridge Dc engages with the engaging portion 59*f* of the rotary unit 11, and the discriminating portion 11*c*1, 64C are engaged. The boss 63*m* enters the guide portion 11*j*, so that positions are now shown in FIGS. 2, 17, 26. When the cartridge frame 63 is rotated clockwisely in FIG. 2, the cyan developing cartridge Dc accommodating the cyan toner is mounted to the cartridge mounting portion 14*c* of the rotary unit 11 in the manner described in the foregoing, as shown in FIG. 3.

When the developing cartridge Dm, Dy, Db accommodating a color toner other than the cyan toner is going to be mounted to the cartridge mounting portion 14*c* for the cyan developing cartridge Dc, the leading end of the guide portion 70 of the developing cartridge Dm, Dy, Db can enter the guide inserting portion 59*h*, but when the leading end of the guide portion 70 reaches a position 13 shown in FIG. 2, the discriminating portion 64M, 64Y, 64B of the developing cartridge Dm, Dy, Db abuts the edge 11*x* of the separation plate 11*c*. The developing cartridge Dm, Dy, Db is unable to go further, and the cutting portion 63*c*1 having a width equal to the length between the opposite sides of the projected portion 63*c* has already enters the linear rib 59*c* portion (FIG. 14), and therefore, the developing cartridge Dm, Dy, Db cannot rotate, either. Therefore, the developing cartridge Dm, Dy, Db other than the developing cartridge Dc accommodating the cyan toner is not mountable to the cartridge mounting portion 14*c* of the developing cartridge Dc.

Similarly, the developing cartridge Dm, Dy, Db are mountable to the cartridge mounting portions 14*m*, 14*y*, 14*b*, respectively, but the other developing cartridge is not mountable.

The shutter 64 mounted to a developing cartridge D for developing a latent image formed on the electrophotographic photosensitive drum 1, which is detachably mountable to the main assembly 30 of the electrophotographic image forming apparatus for forming a multi-color image, is provided with the guide portion 70, mounted for rotation about a longitudinal axis relative to the cartridge frame 63 of the developing cartridge D, for guiding it to the developing cartridge mounting portion 14 of the main assembly 30 of the image forming apparatus. The shutter is movable between a covering position for covering an exposed portion of the developing roller 12 of the cartridge D when it is out of the main assembly 30 and a retracted position for exposing the developing roller 12 when the cartridge is mounted to the cartridge mounting position of the main assembly 30. The shutter 64 includes developing cartridge side discriminating portions 64M, 64C, 64Y, 64B which permit the developing cartridge D to enter the discriminating portion 11*m*1, 11*c*1, 11*y*1, 11*b*1 of the main assembly only when they are aligned in position, at the time when a developing cartridge D is mounted to any one of the developing cartridge mounting portions 14 of the main assembly 30 of the image forming apparatus. When the user mounts the developing cartridge to the cartridge mounting portion of the main assembly of the image forming apparatus, the user is prevented from mounting improper color developing cartridge to the cartridge mounting portion.

The developing cartridge side discriminating portion may have common seats 64*s*, and the blocks 64*r* are selectively mounted thereto, so that there is no need of preparing different types of shutters 64, and therefore, the manufacturing cost can be reused.

In the embodiment, the discriminating portion is shifted to toward the driving force receiving portion shifting of the developing cartridge, but it may be changed to another longitudinal position. The intervals between adjacent discriminating portions may be irregular. The discriminating portion is in the form of square projection and recess, but convex/concave is usable (arcuated shape or v-shaped).

(Structure of Developing Frame)

As shown in FIGS. 4, 6, 7, the cartridge frame generally indicated by a reference numeral 63 is constituted by the developing frame (main cartridge frame) 63A, the developing frame, the cover frame 63C, the side covers (developer cartridge side covers) 63D, 63E, and the coupling frame 63F.

As shown in FIG. 4, the developing frame 63A and the toner frame 63B are welded together by ultrasonic welding at a triangular projections on a connecting surface 63*n* between the flanges 63A*a* extended along the longitudinal direction at both of the lateral sides of the developing member supporting frame 63A and a flange 63B*a* extended along the longitudinal direction of the toner frame 63B.

The toner frame 63B and the cover frame 63C are coupled so that the openings 63*o* of the frames face each other thus constituting a toner container. To accomplish this, flange 63B*a* of the toner frame 63B has a L-shaped cross-section, and the upper surface thereof functions as a connecting surface 63*p*. The flange 63B*b* constitutes a connecting surface 63*p* and is formed to enclose the openings 63*o*. The flange 63C*b* enclosing the opening 63*o* of the cover frame 63C is welded by ultrasonic welding with the flange 63B*b* of the toner frame 63B at the connecting surface 63*p*.

As shown in FIGS. 6, 7 as perspective views, the opposite longitudinal end portions of the thus welded developing frame 63A and toner frame 63B are covered by side covers 63D, 63E, and side cover 63E is screwed to the developing frame 63A, and the side cover 63D is screwed to the coupling frame 63F fixed to the developing frame 63A. In this manner, the frames constitutes an integral cartridge frame 63.

(Developing Frame)

The description will be made referring to FIGS. 4, 5, 27 and 28.

The developing frame 63A is projected toward the opening 63B*c* side of the toner frame 63B from the flange 63A*a* extended longitudinally at two lateral sides. One lateral side of the from side 63A*b* of the projected portion is opposed to a toner seal surface 27*a* along the length. On the toner seal surface 27*a*, the toner seal 27 of the toner frame 63B is stuck, and the toner seal 27 is stuck on the toner seal surface 27*a*. The longitudinal surface 63A*b*1 (FIG. 27) of the front surface 63A*b* of the projected portion, close to the toner seal 27 on the toner seal surface 27*a*, is flush with the surface 63A*b*2. The flat surface 63A*b*2 is provided along the lateral direction at each of the longitudinal opposite ends of the toner supply opening 63A*e*, and it continues to the flat surface 63A*b*2. The lateral flat surface 63A*b*2 extended in the lateral direction at each of the longitudinal opposite ends of the front side 63A*b* continues to an arcuated surface 63A*b*3 concentric with the application roller 19 and having a radius slightly larger than a radius of the outer periphery of the application roller 19 immediately outside the application roller 19. The lateral surfaces 63A*b*2, 63A*b*3 bent from the opposite ends of the front side 63A*b* of the projected portion has a narrow width. The longitudinal flat surface 63A*b*1 is projected perpendicularly from the flange 63A*a*.

End seals 31*a*, 31*b* which are elastic members are stuck on the developing frame 63A away from the longitudinal opposite sides of the front side 63A*b* of the projected portion. Adjacent a side where the toner seal 27 is pulled out, a film 31*c* is stuck on the inside of the end seal 31*a* to decrease the friction with the toner seal 27.

Figure 27:
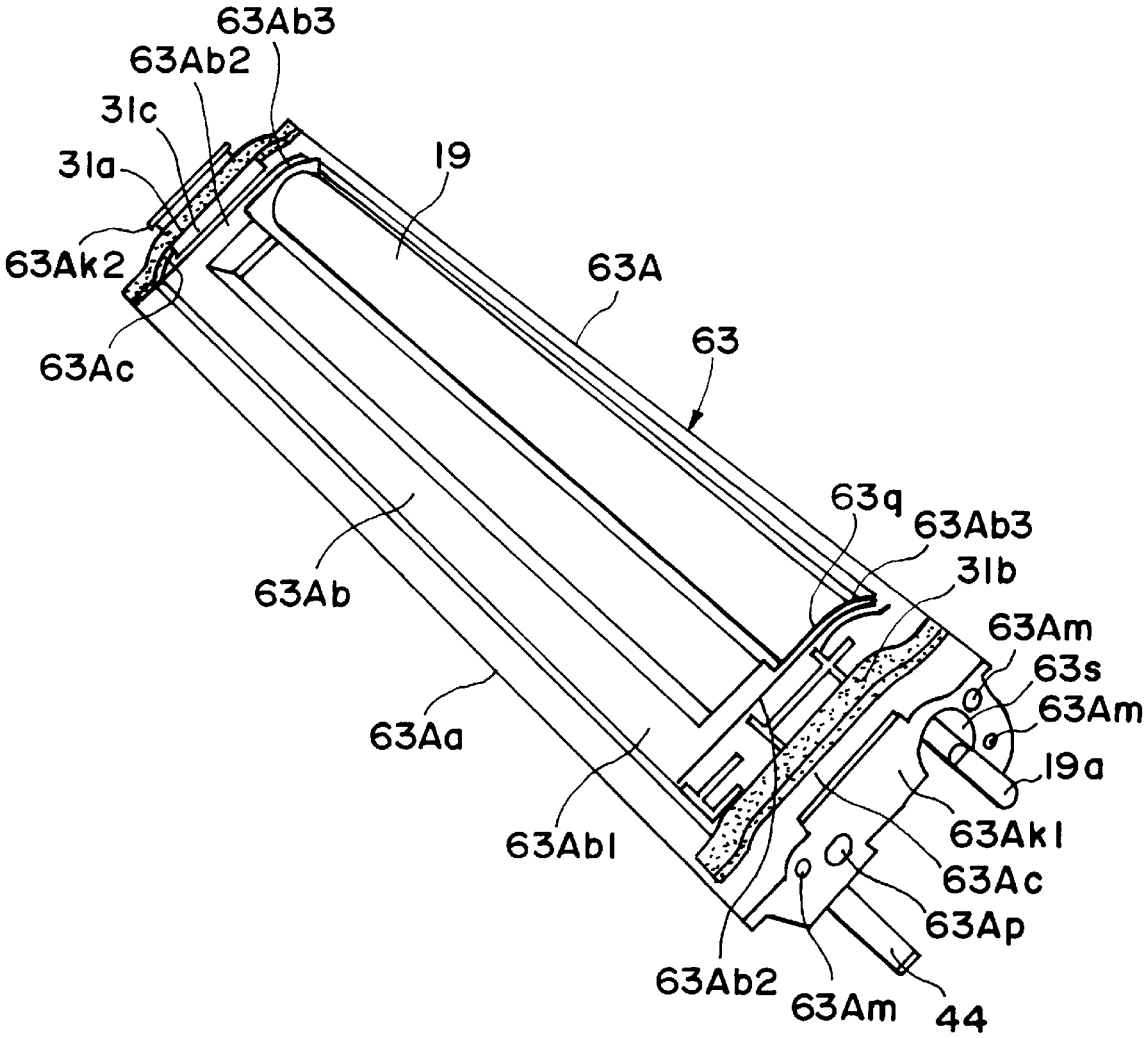
FIG. 27 is a perspective view of a developing member supporting frame
Figure 28:
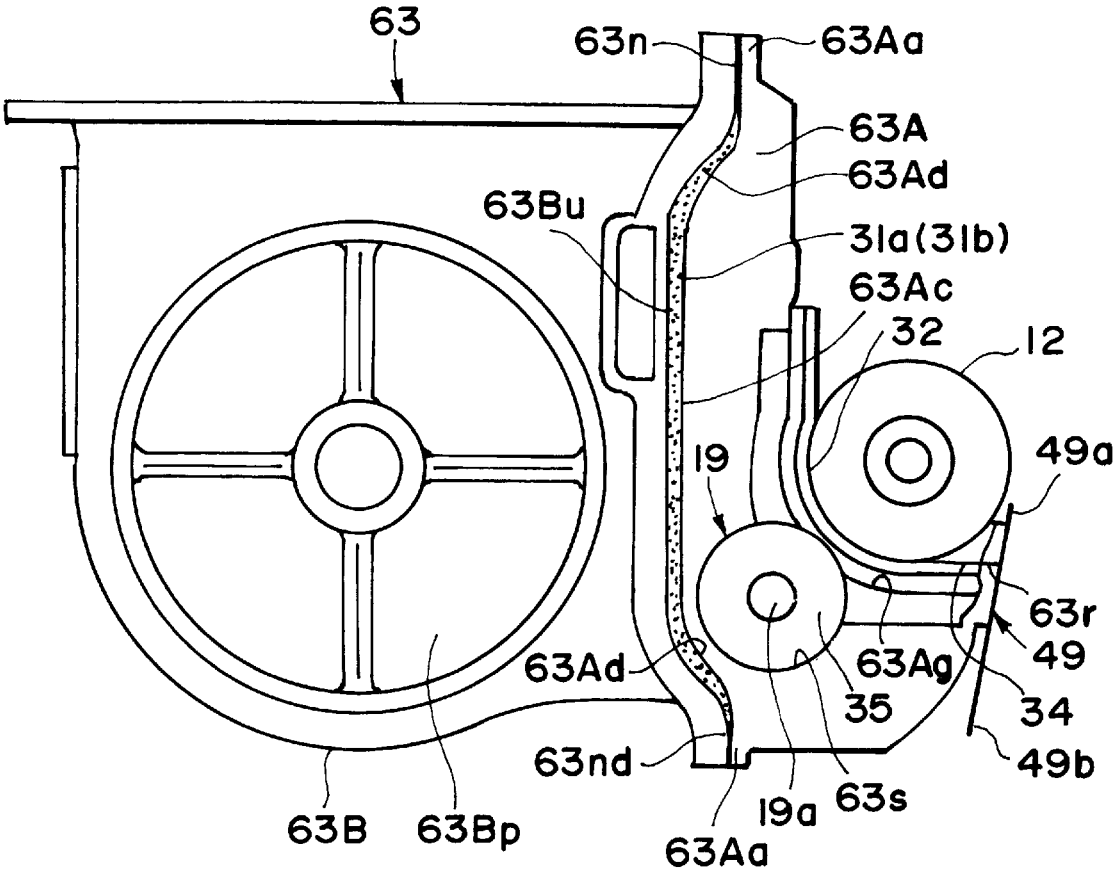
FIG. 28 is a side view of a developing member supporting frame.

The developing frame 63A has a end seal sticking surface 63A*c* for sticking thereon an end seal 31*a* and 31*b* at a position retracted from the surface 63A*b*2. At each of the lateral sides of the sticking surface 63A*c*, there is provided an arcuated surface 63A*d*. The sticking surface Ac and the flange 63A*a* are smoothly connected by the arcuated surface 63A*d* (FIGS. 27 and 28). The end seal 31*a* and 31*b* is provided at each of the opposite longitudinal ends of the toner supply opening 63A*e*, along the lateral direction of the developing frame 63A. The longitudinally opposite ends of the end seals 31*a* and 31*b*, are sandwiched between the flange 63A*a* and the lateral end of the toner frame 63B. Designated by 63*n* is a connecting plane where they are welded.

On the other hand, the toner frame 63B is provided with a seal surface 63B*u* for urging the end seals 31*a* and 31*b* stuck on the developing frame 63A when the developing frame 63A is coupled with the toner frame 63B (FIG. 28).

Figure 29:
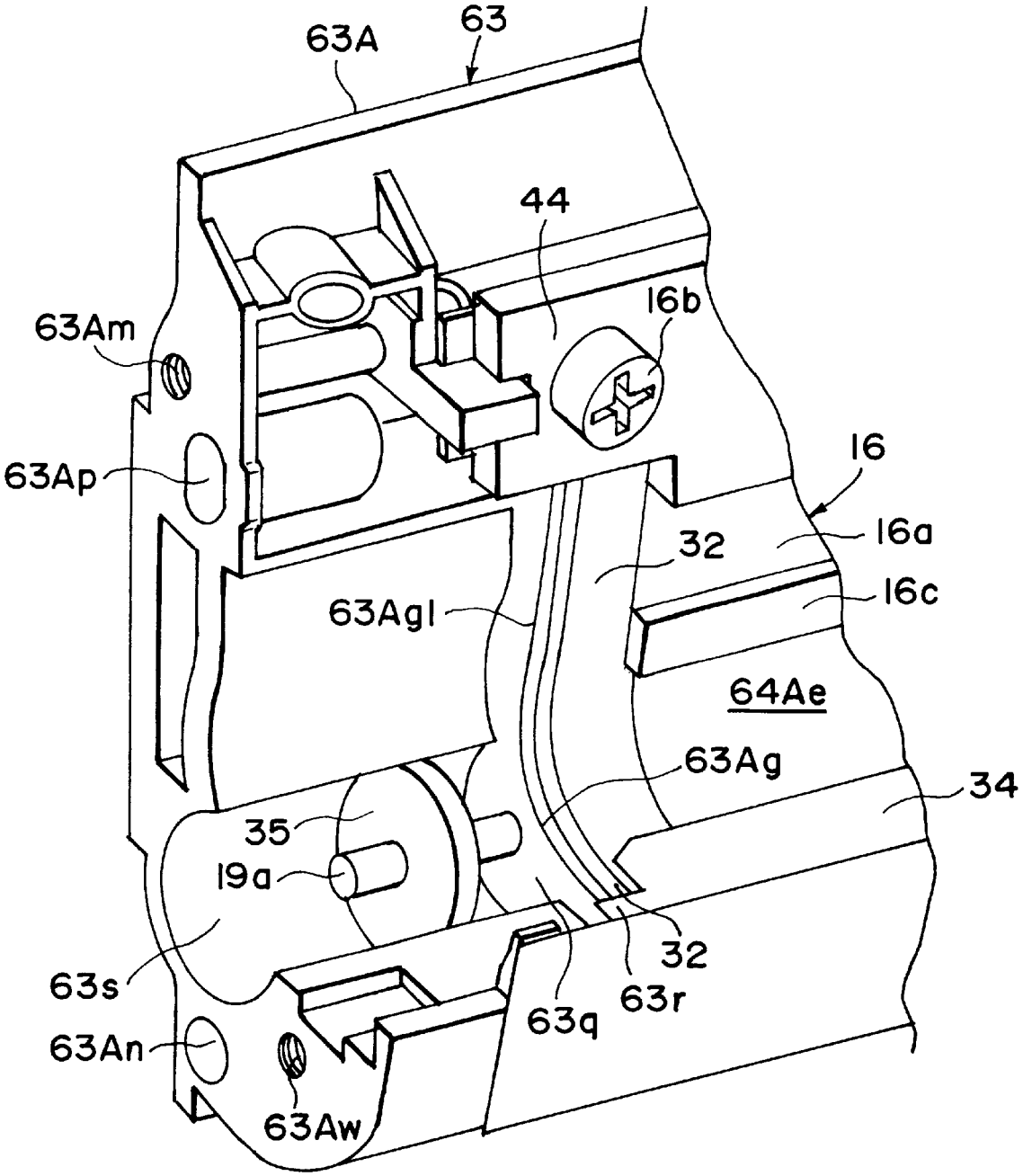
FIG. 29 is a perspective view of an end of developing member supporting frame.

A toner supply opening 63A*e* penetrates the developing frame 63A. The toner supply opening 63A*e* is extended along the developing roller 12. The vertical opening region of the toner supply opening 63A*e* is narrowed between the cleaning blade 16 and the sealing member 34. The toner supply opening Ac is enclosed by the front surface 63A*b*, the shaft mounting portion 63*q* and the flange 63A*a*. The developing roller 12 is mounted to the developing roller mounting portion in the longitudinal direction of the toner supply opening 63A*e* (FIG. 29).

As described in the foregoing, the developing frame 63A includes a developing roller 12 for developing a latent image formed on the photosensitive drum 1, the toner accommodating portion 63*a* for accommodating the toner to be used for development by the developing roller 12, a toner accommodating portion 63*a* for accommodating the toner on the surface of the developing roller 12, and an application roller 19 for applying the toner on the surface of the developing roller 12. The developing frame is usable with a developing cartridge D detachably mountable relative to the main assembly 30 of the image forming apparatus. It further includes a toner supply opening 63A*e* for supplying to the developing roller 12 the toner accommodated in the toner accommodating portion 63*a*, the developing roller mounting portion for mounting the developing roller 12 along the toner supply opening, the connecting surface for coupling with the toner frame 63B having the toner accommodating portion 63*a*, the connecting surface 63*n* being provided along the longitudinal direction of the toner supply opening at each of the lateral ends of the toner supply opening 63A*e*, a projection having a sticking surface 63*c*, a shaft mounting portion 63*q* and a front surface 63A*b*, the projection being projected toward the toner frame 63B in the direction crossing with a plane connecting the connecting surfaces 63*n*.

There is provided a shaft mounting portion 63*q* for mounting a shaft for supporting the application roller to mount the application roller, the portion projecting in a direction crossing with a plane connecting the connecting surfaces (63*w*) and mounting the application roller (19) along the toner supply opening (63A*e*), the shaft mounting portion 63*q* mounting the shaft at the developing roller (12) side beyond a plane connecting the connecting surface 63*n*, and the shaft mounting portion being provided adjacent one and the other longitudinal ends of the toner supply opening (63A*e*). The application roller having a shaft (19*a*) mounted to said shaft mounting portion (63*q*) crosses in its longitudinal direction the plane connecting said connecting surfaces (63*n*) provided at both of the lateral sides of the toner supply opening (63A*e*). The opposite longitudinal end portion are provided with elastic members (26*b*) for urging the toner seal (27) for sealing the toner supply opening of said toner frame, the mounting surface of the elastic member is in the form of a projected surface toward the toner frame beyond a plane connecting the connecting surface (63*n*). The leading edge of the projected surface is a flat surface, and the flat surface is projected toward the developing frame beyond the application roller (19). The plane connecting the mounting surface of the elastic members (26*b*) at the opposite longitudinal ends is away from the application roller (19). The mounting surface of the elastic member is connected by a curved surface outside the application roller (19) between the connecting surface and the leading edge of the projected surface. The curved surface is an arcuation having a center which is a center of the application roller (19).

A side of the mounting surface of the elastic member (266) opposite from the curved surface is connected with the connecting surface by an outwardly convex surface. The toner supply opening (63A*e*) is rectangular as seen from the toner frame and is provided with an application roller (19) mounting portion to dispose the application roller along an edge of one lateral side of the toner supply opening (63A*e*), wherein toner supply opening is defined in a plane substantially flush with the connecting surface at one lateral side thereof and is defined in a plane connecting the mounting surfaces of the elastic member at longitudinally opposite ends, at the other lateral end and at the longitudinally opposite ends.

The description will be made as to the structure of the developing frame 63A at the side opposite from the side of toner frame 63B with respect to the connecting surface 63*n*.

The shaft mounting portion 63*q* for supporting the rotation shaft 19*a* of metal of the application roller 19, as shown in FIG. 4, is molded integrally with the developing frame 63A, they are provided adjacent the opposite longitudinal ends of the developing frame 63A. Bearing holes of the shaft mounting portion 63*q* for the rotation shaft 19*a* is closer the developing roller 12 than the connecting surface 63*n*. Namely, it is at the opposite side of the toner frame 63B across the flat surface connecting the connecting surfaces 63*n*. The black developing cartridge Db does not has an application roller (FIGS. 28 and 29).

The shaft mounting portion 63*q* has an arcuated concave surface 63A*g* for sticking an elastic seal member 32 of felt for sealing between the developing zone and the outside. The arcuated convex surface 63A*g* continues to the flat surface 63A*g*1 substantially parallel with the developing blade 16. The longitudinal end portion of the 16*c* supported on the plate 16*a* is overlapped with an end of the elastic seal member 32 stuck on the surface. A seal member 34 which is parallel with the elastic blade 16*c* and which is close to the peripheral surface of the developing roller 12, is stuck on the seal mounting surface 63*r* of the developing frame 63A.

As shown in FIG. 29, a longitudinally outer portion of the shaft mounting portion 63*q* for the application roller 19, is provided a recess 63*s* having an arcuation shape section concentric with the rotation shaft 19*a* of the application roller 19, and a shaft gasket 35 in the form of a disk of felt is engaged with the recess 63*s* and the rotation shaft 19*a*. The packing 35 is lightly press-contacted to the outer surface of the shaft mounting portion 63*q* by the cylindrical projected portion 63D*f*, 63F*f* (FIGS. 35, 45) provided in each of the coupling frame 63F and the side cover 63D entering the recess 63*s* of the developing frame 63A, to eject the sealing. This is the same as the other longitudinally opposite ends.

The foregoing is the structure of the developing frame 63A of the developing cartridge D accommodating the magenta, cyan or yellow toner. In the case of a developing cartridge Db accommodating the black toner does not have the application roller, and therefore, the space accommodating the application roller, the mounting portion for the rotation shaft of the application roller, the space for the shaft sealing of the rotation shaft mounted to the mounting portion or the like are not provided. As shown in FIG. 5, the bottom surface 63*t* of the developing frame 63A below the developing roller 12 constitutes a substantially horizontal surface extended below the developing roller 12 at the developing position where the developing roller is opposed to the photosensitive drum 1.

As shown in FIG. 27, one of the longitudinal end surface of the developing frame 63A is provided with coupling frame 63F. The other end surface is provided with seats 63A*k*1, 63A*k*2 for mounting a side cover 63E at the toner seal pulling side. The seats have the same configurations. Each of the seats 63*k*1, 63*k*2 is provided with screw 63A*m* and positioning holes 63A*n*, 63A*p*. The hole 63A*n* is a round hole, and the hole 63A*p* is elongated in a direction connecting the holes 63A*n*, 63A*p*.

By the structures of the developing frame as above-described, the developing cartridge can be downsized. Or, a larger amount of the toner can be accommodated if the size of the developing cartridge is the same.

(Toner frame)

As shown in FIG. 4, the connecting surface 63*n* of the toner frame 63B with respect to the developing member supporting frame 63A and the connecting surface 63*p* of the toner frame 63B with the cover frame 63C are substantially perpendicular to each other.

Figure 30A:
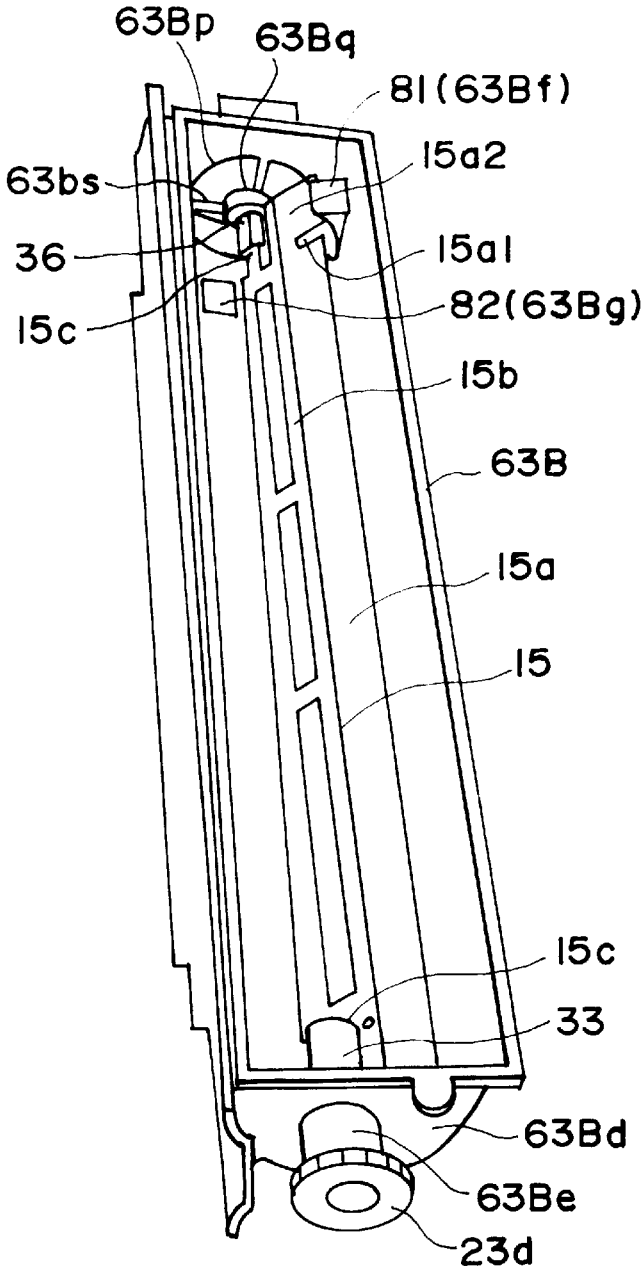
FIG. 30 is an illustration of a toner frame, wherein (a) is a perspective view of a toner frame and (b) is a cross-sectional view of a toner frame.
Figure 30B:
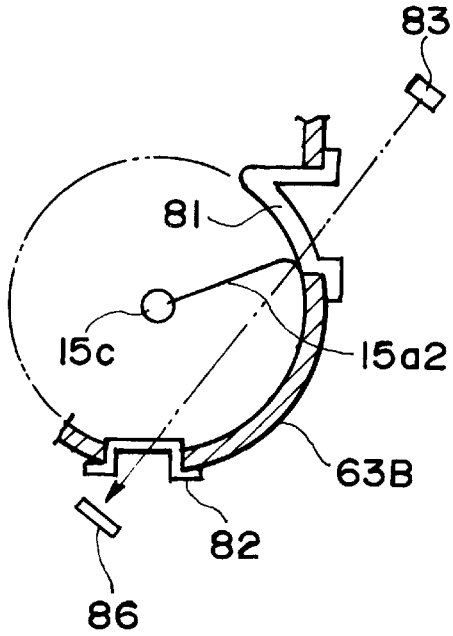
Figure 32:
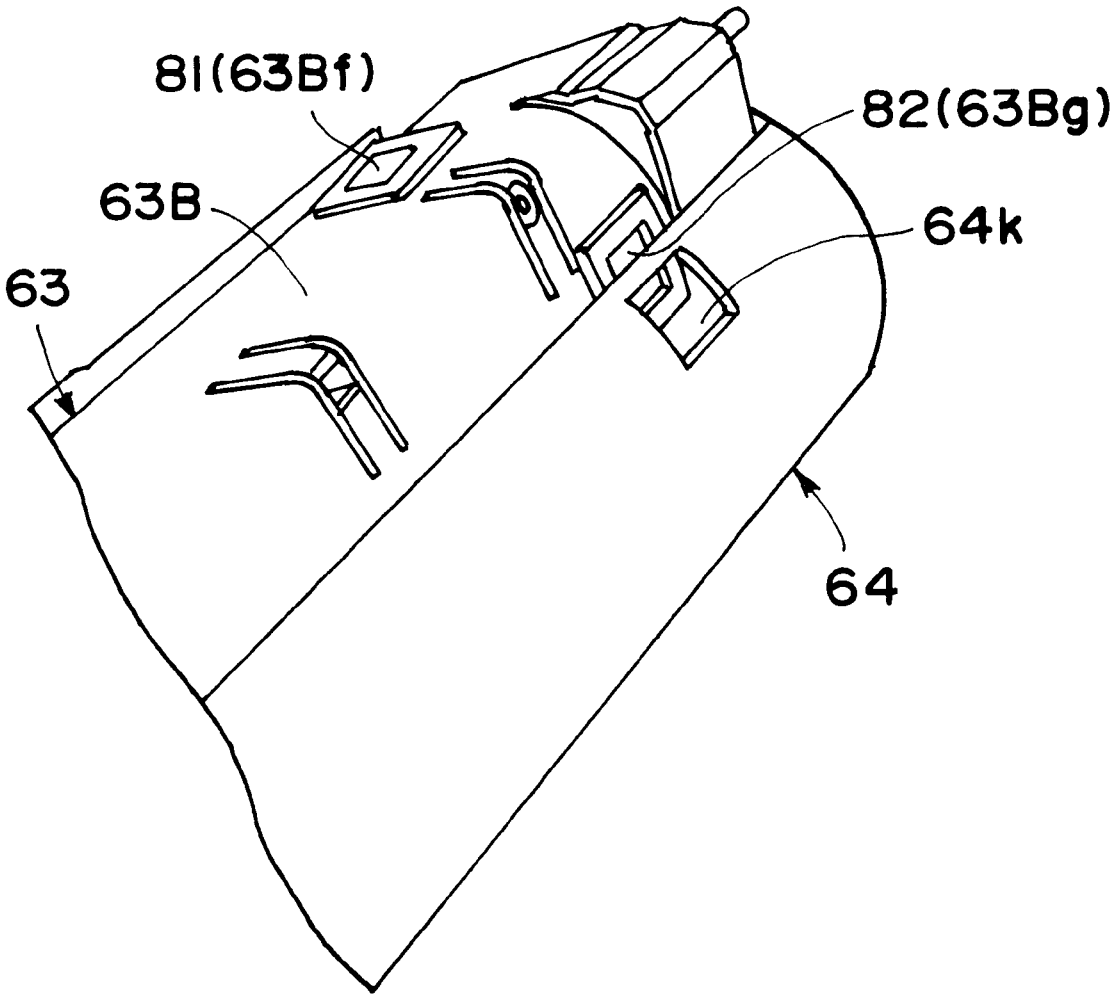
FIG. 32 is a perspective view of a nondriving side of a developing cartridge as seen inclinedly from the bottom.

As shown in FIGS. 30 (a perspective view of the toner frame) and 31, a bearing portion 63B*e* provided in an end plate 63B*d* at one longitudinal end of the toner frame 63B, rotatably supports the journal 33 integral with a gear 23*d*. The other longitudinal end of the toner frame 63B is provided with a cylindrical toner supply opening 63B*p*, and a bearing portion 63B*e* at the center thereof rotatably supports the journal 36. The bearing portion 63B*e* is connected to the toner supply opening 63B*p* by a radial arm 63B*s* from the bearing portion 63B*e*, and is integrally molded with the toner frame 63B. To the journals 33, 36, a toner feeding member 15 (toner stirring member) on the shaft 15*c* is fixed. The toner feeding member is extended substantially over the entire length of the toner frame 63B, and the opposite ends are out of the developing zone. At the same side as the toner cap 37 fixed to the toner supply opening 63B*p* and outside the developing zone, there are provided first, second openings 63B*f* and 63B*g*, as shown in FIG. 4. In to the first and second openings 63B*f*, 63B*g*, light-transmissive members 81, 82 of synthetic resin material for example are securely engaged. The light introduced through the first opening 63B*f* passes through the second opening 63B*g* when the amount of the toner is small in the toner frame 63B. As shown in FIGS. 4, 5 and 32, the shutter 64 is provided with an opening 64*k* for passing the emergent light through the second opening 63B*g*.

The light-transmissive members 81, 82 of the toner frame 63B respectively have a cylindrical surface 81*a* and a flat surface 82*a* which an elastic blade 15*a* (cleaning member) of synthetic resin material mounted to the plate 15*b* close to the center of the toner feeding member 15 rubs or scrapes with elasticity with interference with the trace of the motion of the elastic blade 15*a*. The cylindrical surface 81*a* has its center which is a center of rotation of the toner feeding member 15, and the flat surface 82*a* is perpendicular to the normal line from the center to a center of the flat surface 82*a*.

A developing cartridge for developing a latent image formed on the photosensitive member, wherein said developing cartridge is detachably mountable to a main assembly of an electrophotographic image forming apparatus, said developing cartridge comprising;

a cartridge frame;

a developing member (e.g. developing roller 12) for developing a latent image formed on the photosensitive member;

a driving force receiving member for receiving driving force for rotating said developing member from the main assembly of said apparatus when said developing cartridge is mounted to the main assembly, the driving force receiving member being exposed from a portion (side cover 63D) of said cartridge adjacent one longitudinal end of said developing member;

a developing bias contact (e.g. 41) for receiving a developing bias to be applied to said developing member from the main assembly when said cartridge is mounted to the main assembly, said developing bias contact (e.g. 41) being exposed from a portion (side cover 63D) of said cartridge adjacent one longitudinal end of said developing member;

a toner accommodating portion (e.g. 63*a*) for accommodating the toner to be used for development by said developing member;

a first light-transmissive member (e.g. 81) and a second light-transmissive member (e.g. 82), provided at a portion of said cartridge frame corresponding to said toner accommodating portion adjacent the other longitudinal end of said developing member, for detecting that remaining amount of the toner accommodated in said toner accommodating portion becomes smaller than a predetermined amount, wherein said first light-transmissive member is effective to introduce light emitted from the main assembly (e.g. 30) into said toner accommodating portion, and said second light-transmissive member is effective to direct the light having passed through said toner accommodating portion toward the main assembly.

In the longitudinal direction of the developing roller 12 as said developing member, the first light-transmissive member 81 and second light-transmissive member are disposed outside a developing zone where said developing roller 12 carries out a developing function.

The developing cartridge D further comprises a shutter 64 for covering a portion exposed through said cartridge frame, and said shutter has an opening 64*k* at a position where it is opposed to said second light-transmissive member when said shutter is positioned at an opening position.

The first light-transmissive member is concave toward inside of the toner accommodating portion 63*a*.

The second light-transmissive member is substantially flat in shape.

The developing cartridge D has an urged portion 63U urged by an urging member (e.g. compression coil spring 10*b* of the urging means 25) provided in the main assembly 30 of the apparatus when the developing cartridge D is mounted to the main assembly 30.

The developing cartridge D has a cleaning portion (e.g. elastic blade 15*a*) for removing the toner deposited on the inner surfaces of the first light-transmissive member and the second light-transmissive member.

The developing cartridge D has a toner feeding member 15 for feeding, toward the developing member 12, the toner accommodated in the toner accommodating portion 63*a*, wherein the toner feeding member 15 is extended in a longitudinal direction of the toner accommodating portion 63*a*.

The cleaning portion (15*a*) is provided at an one longitudinal end of the toner feeding member 15. The cleaning portion (15*a*) is mounted on a shaft 15*c* on which said toner feeding member 15 is mounted, and said cleaning portion (15*a*) and said toner feeding member 15 rotate integrally.

In a direction crossing with the shaft 15*c*, the length of the cleaning portion (15*a*) is longer than the length of the toner feeding member 15. By this, the toner deposited on the inner surface of the light-transmissive member can be removed assuredly.

Thus, in the developing cartridge of the embodiment, the light-transmissive members 81, 82 are disposed adjacent a longitudinal end of the developing roller 12, opposite from the end adjacent which the driving force receiving member 22 and the developing bias contact 41 are provided. Therefore, the inside space of the developing cartridge can be effectively utilized. And, the space in the main assembly of the apparatus can be effectively utilized. This is because the light emitting element 83 and the light receiving element 86 can be disposed at the opposite side where the drive transmission member 24 and the developing bias contact pin 42 are disposed, in the main assembly 30 of the apparatus. Since the light-transmissive members 81, 82 are provided adjacent the longitudinally opposite end of developing roller 12 so that length of the light guide can be saved.

In this embodiment, the developing zone where the developing roller 12 carries out the developing function is a region X (FIG. 8) between the end seals 16*d*1, 16*d*2 contacted to the peripheral surface of the developing roller 12 adjacent one and the other end thereof, where the toner is deposited on the roller peripheral surface. The seals 16*d*1, 16*d*2 are to prevent the leakage of the toner outwardly in the longitudinal direction of the roller 12. In this specification, the developing zone (X in FIG. 8) where the developing member (developing roller) carries out the developing function is the region where the toner contributable to the development of the electrostatic latent image formed on the electrophotographic photosensitive member is deposited, in the longitudinal direction of the developing member.

In this embodiment, the toner feeding member and the elastic blade 16*c* (cleaning portion) are of resin material and are integrally molded. The toner feeding member 15 and the elastic blade 16*c* are provided on the same shaft 15*c*. Therefore, the toner feeding member 15 and the elastic blade 16 can be rotated through one driving mechanism.

The toner feeding member and the cleaning portion may be separate members, which are mounted on different shafts. In this case, the driving forces are transmitted to them respectively.

In this embodiment, the first, second light-transmissive members are disposed outside the developing zone in the longitudinal direction of the developing roller, and therefore, the rotation of the cleaning portion does not adversely affect the developing function.

(Cover Frame)

As described in the foregoing, the cover frame 63C has flanges 63A*a*, 63B*a* for coupling the developing member supporting frame 63A and the toner frame 63B, and the flange 63A*a*, 63B*a* being offset toward the developing roller 12 beyond the toner seal surface 27*a*. Therefore, as shown in FIG. 4, the front wall 63C*d* of the cover frame 63C can be made closer to the developing frame 63A so that distance between the front wall 63C*d* and the later wall 63C*e* can be made larger. Therefore, inside volume provided by the toner frame 63B and the cover frame 63C, for accommodation the toner, can be increased.

(Coupling Frame)

Figure 33:
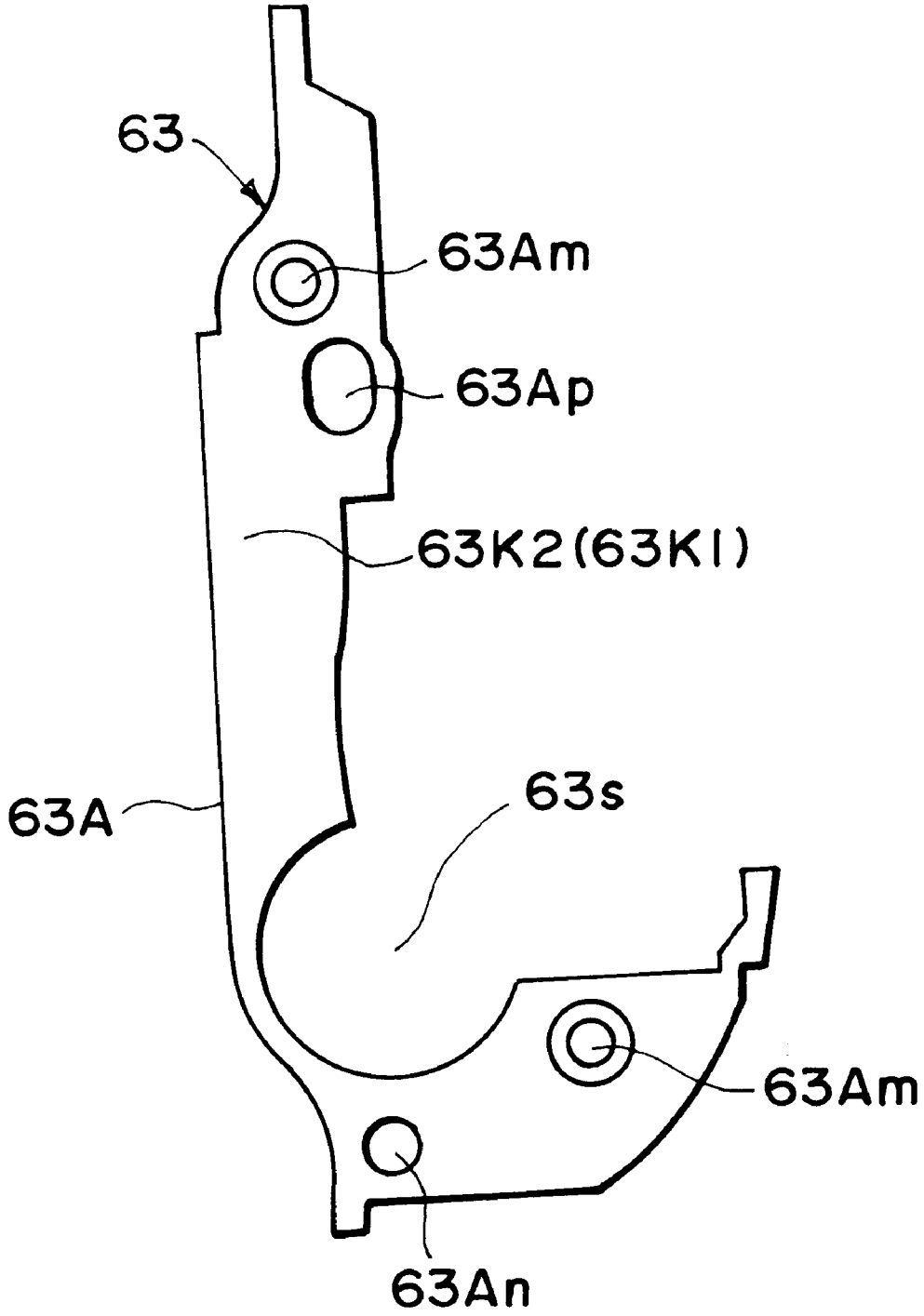
FIG. 33 is a side view of a longitudinal end portion of a developing cartridge.
Figure 34:
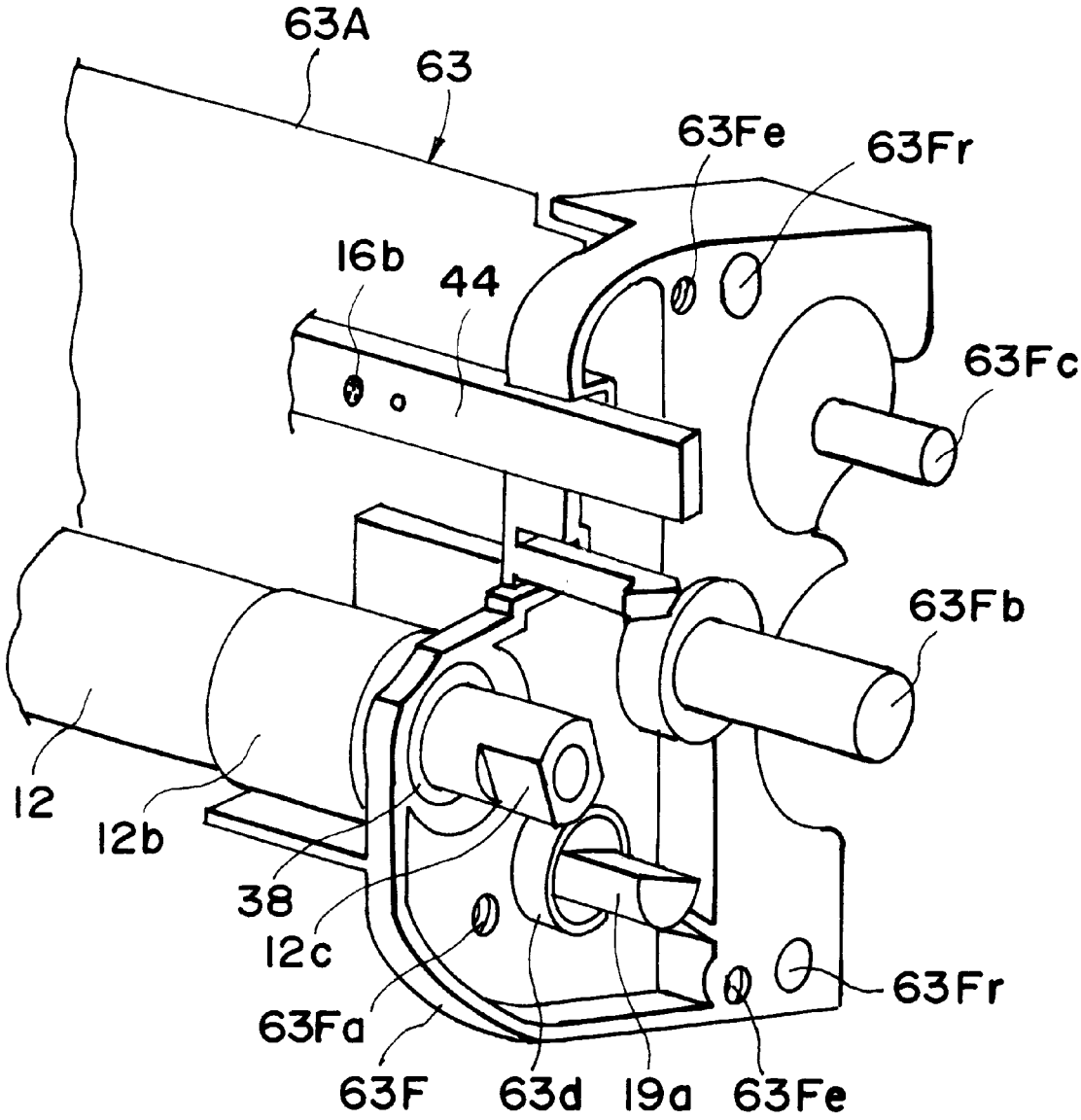
FIG. 34 is a perspective view of a coupling frame portion of a developing cartridge.
Figure 45:
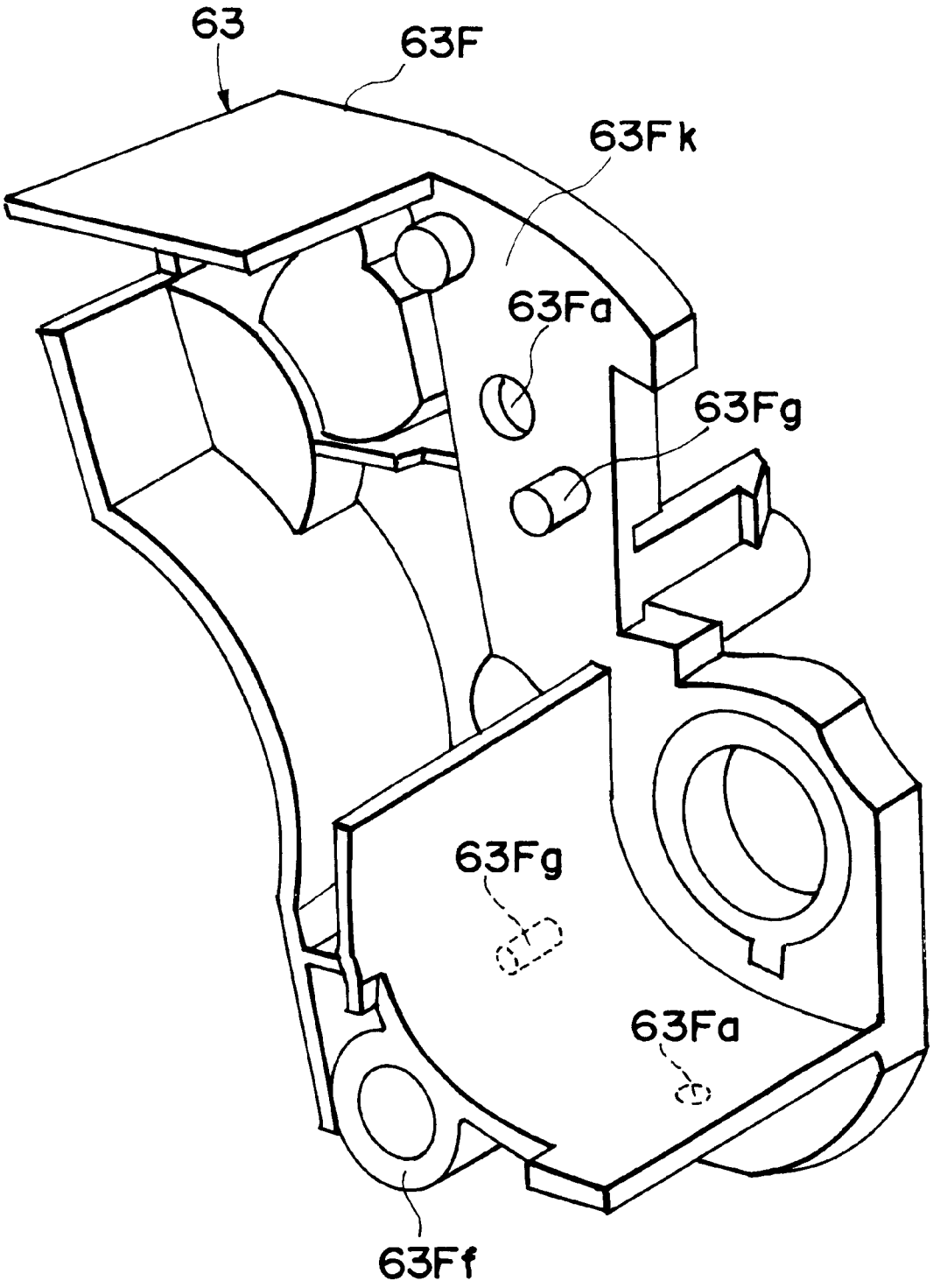
FIG. 45 is a perspective view of a cartridge frame.

As shown in FIG. 34 (perspective view), to the seat 63*k*1 (FIG. 33) at the driving force reception side end of the developing frame 63A, the coupling frame 63F is fixed by threading unshown small screws through the holes 63F*a* into the screws 63A*m* at the end surface of the developing member supporting frame 63A. By this, the seat 63A*k*1 at the driving force reception side of the developing member supporting frame 63A and the flat mounting surface 63F*k* of the coupling frame 63F shown in FIG. 45 are contacted to each other. The configuration of the mounting surface 63F*k* of the coupling frame 63F has substantially the complementary configuration with the seat 63A*k*1 of the developing frame 63A so that they are closely nested. The mounting surface 63F*k* is provided with a longitudinal cylindrical dowels 63F*g* engageable with the positioning holes 63A*n*, 63A*p* of the seat 63A*k*1 of the developing frame 63A.

As shown in FIG. 34, one end of the rotation shaft 12*c* of the developing roller 12 is supported on a developing roller bearing 38 engaged into the coupling frame 63F. The projected shaft 63F*b* supporting the driving force receiving member 22 is integrally molded with the coupling frame 63F. A projected shaft 63F*c* rotatably supporting stepped an idler gear 23*c* including a small gear 23*c*2 engaged with the gear 23*d* integral with a journal 33 supporting the toner feeding member 15, is integrally provided. There is provided a hole 63F*d* through which the rotation shaft 19*a* of the application roller 19 is penetrated. The coupling frame 63F is provided with a screw 63F*e* for mounting the side cover 63D.

The description will be made as to a support at the other end of the developing roller 12 and a toner seal 27.

(Side Cover at the Non-driving Side)

Figure 35:
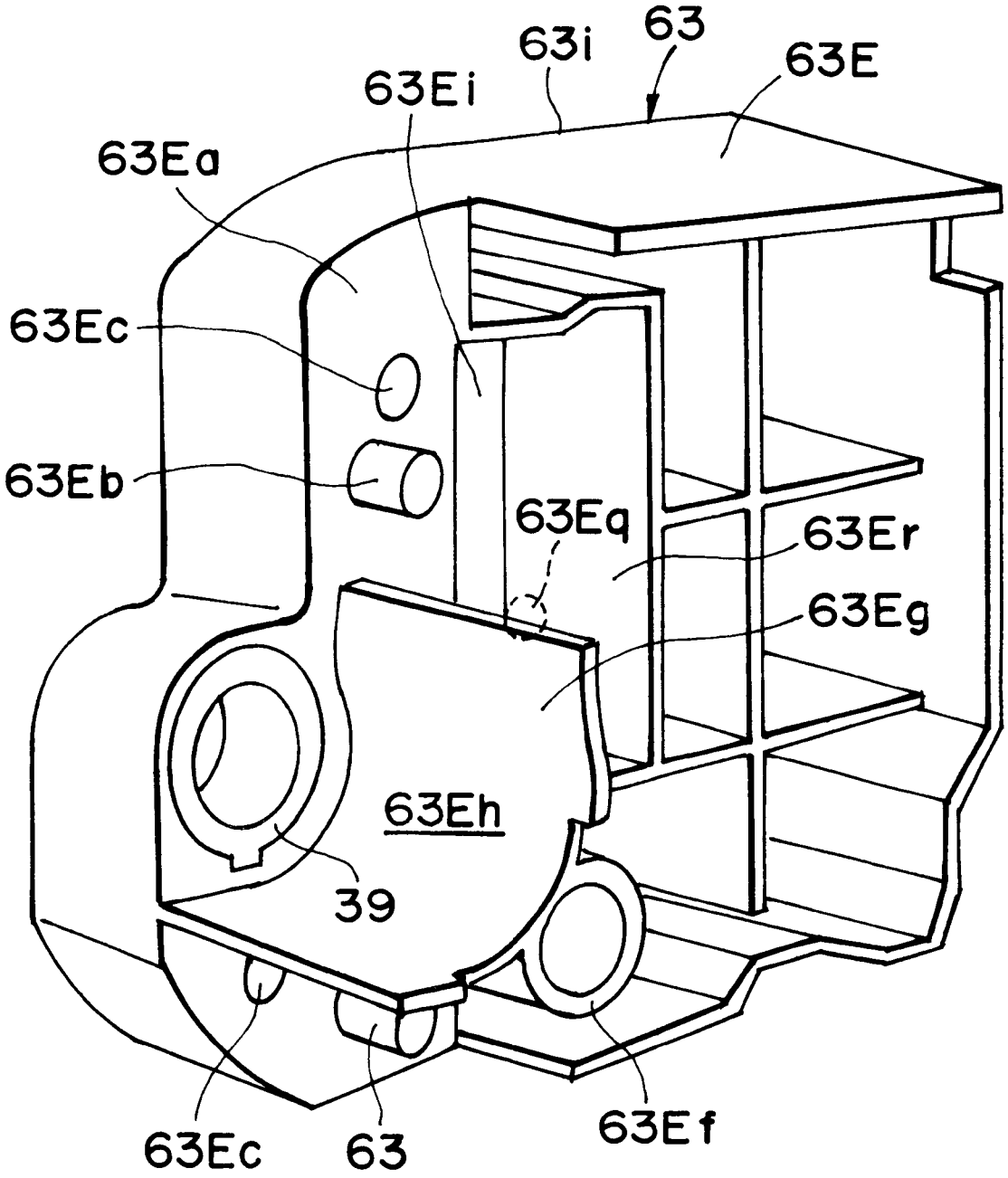
FIG. 35 is a perspective view of a non-driving side cover.

As shown in FIG. 35, a side cover 63E provided at the opposite side from the driving side has a configuration covering the longitudinal end surfaces of the toner frame 63B and the developing frame 63A. There is a flat mounting surface 63E*a* contacted to the side cover mounting seat 63A*k*2 at the longitudinal end surface of developing frame 63A, the mounting surface 63E*a* is provided with a cylindrical dowel 63E*b* extending in the longitudinal direction and engageable with the positioning holes 63A*n*, 63A*p* of the seat 63A*k*2 of the developing frame 63A. At the position aligned with the female screw 63A*m* of the developing frame 63A, a hole 63E*c* is formed in the longitudinal direction to fix the side cover 63E to the developing member supporting frame 63A by threading an unshown small screw into the screw 63A*m* through the hole 63E*c*. A developing roller bearing 39 is provided in a hole of the side cover 63E to rotatably support the rotation shaft 12*c* of the developing roller 12 with the side cover 63E being mounted to the developing frame 63A.

From the mounting surface 63E*a*, a cylindrical projected portion 63E*f* is projected in the longitudinal direction, and the free end of the projection 63E*f* presses the shaft gasket 35 of the rotation shaft 19*a* of the application roller 19 to the shaft mounting portion 63A*q* of the rotation shaft 19*a* of the application roller 19 of the developing frame 63A. A cover portion 63E*g* is provided for covering the outer periphery of the projected end of the rotation shaft 12*c* of the developing roller 12. The cover portion 63E*g* has an inner surface 63E*h* which is the same as the seal surface of the elastic seal member 32 shown in FIG. 29 (perspective view of the end portion of the application roller), when mounted, it is flush with the seal surface.

The side cover 63E is provided with a toner seal opening 63E*i* which extends in the longitudinal direction and through which an end of the toner seal 27 is penetrated to allow the toner seal 27 to be pulled out of the developing cartridge D. The toner seal opening 63E*i* is rectangular, having a long side along the lateral direction of the toner seal 27, and the length of the vertical side of the toner seal opening 63E*i* thereof in FIG. 35 is larger than the width of the toner seal pulling grip 73 (FIG. 9).

Figure 31:
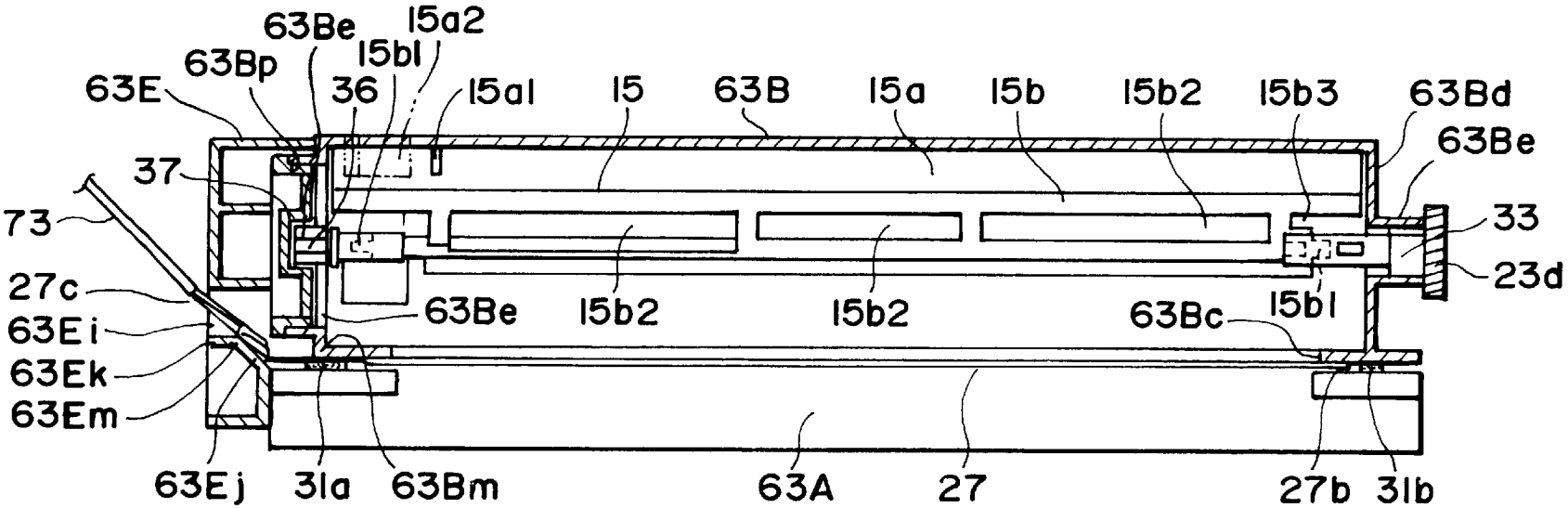
FIG. 31 is a horizontal sectional view of a toner frame.

FIG. 31 is a horizontal sectional view of the toner frame 63B including the toner supply opening 63B*c*. The toner seal 27 is stuck on the entire circumference of the edge of the toner supply opening 63B*c*, and then turned at the portion 27*b*, and is overlaid on the toner seal portion stuck on the entire circumference of the edge of the toner supply opening 63B*c*, and the end 27*c* thereof is bonded to the toner seal pulling grip 73. The end 27*c* of the toner seal 27 and the grip 73 are in the toner seal opening 63E*i*, and is extended out of the developing cartridge D.

As shown in FIG. 31, the inside of the toner seal opening 63E*i* is provided with a toner seal discharging inclined surface 63E*j*. The inclined surface 63E*j* is a flat surface and is inclined toward the toner frame side. Therefore, the toner seal 27, as shown in FIG. 31, is pulled out along the inclined surface 63E*j* inclinedly upwardly from the toner frame 63B (the side having the toner supply opening 63B*p*). The side cover 63E has a flat surface 63E*k* parallel with the sticking surface of the toner frame 63B for the toner seal and on an outer side in the pulling direction, and the sticking surface continues from the inclined surface 63E*j*. The inclined toner seal discharging surface 63E*j* is not limited to the flat surface, but may be a quadratic surface having a generating line crossing with the toner seal 27.

When the grip 73 is pulled outwardly, the toner seal 27 is pulled outwardly through the toner seal opening 63E*i* so that folded or turned portion 27*b* moves to the left in FIG. 31, and the toner seal 27 is peeled off the edge of the toner supply opening 63B*c* from the turned portion 27*b*. By completely pulling out the toner seal 27, the toner supply opening 63B*c* is fully opened. By doing so, the toner in the toner frame 63B can be supplied to the developer chamber 63A*t* of the developing member supporting frame 63A. When the toner seal 27 is pulled out, it is stretched between the corner 63B*m* sealed by the end seal 31*a* of the toner frame 63B and the corner portion 63E*m* formed by the flat surface 63Ek and the inclined toner seal discharging surface 63E*j* which is the inner wall of the toner seal opening 63E*i* of the side cover 63E. Therefore, the toner seal 27 which is folded back at the front side of the toner seal supply opening 63B*c*, is stretched along the toner seal surface at the edge of the opening 63B*c*. Thus, it is gradually peeled off at the folded portion 27*b* in one direction from the folded portion to the end seal 31*a*. Therefore, the direction in which the user pulls the toner seal 27 through the toner seal opening 63E*i* of the side cover 63E can be limited, and therefore, pulling in improper direction (which may result in the end seal 31*a* torn or on leakage of the toner) can be prevented.

By integrally molding the side cover 63E and the shaft support member for engaging the bearing 39 of the developing roller 12, the number of parts can be reduced.

(Remaining Toner Amount Detection)

As described in the foregoing with respect to FIG. 4, the toner frame 63B is provided with first and second openings 63B*f*, 63B*g*, and the openings 63B*f*, 63B*g* are hermetically sealed by light-transmissive members 81, 82. The shutter 64 is provided with an opening 64*k* across a line connecting said light-transmissive members 81, 82 in the state wherein the shutter 64 is opened to expose the developing roller 12.

The first and second openings 63B*f*, 63B*g* are disposed outside of the developing zone of the developing roller 12 in the longitudinal direction of the developing roller 12. The cover frame 63C of the cartridge frame 63 is provided with a grip 63*e* at the central portion in the longitudinal direction. The grip 63*e* is provided by forming a recess toward the inside accommodating the toner at the central portion of the cover frame 63C in the longitudinal direction. The recess 63*e*1 is short in the longitudinal direction and is formed in the flange 63C*b* of the cover frame 63C adjacent the developing frame 63A. A rear portion of the cover frame 63C remote from the developing frame 63A is provided with a recess 63*e*2 having a size longer than the recess 63*e*1, and by these recesses 63*e*1 and 63*e*2, the grip 63*e* is provided.

The first opening 63B*f* is disposed adjacent the grip 63*e* in the circumferential direction of the developing cartridge D. The second opening 63B*g* is disposed at a side remote from the first opening 63B*f* as seen from the grip 63*e*.

The light-transmissive member 81 sealing the first opening 63B*f* is projected toward the toner accommodating portion 63*a*, and the light-transmissive member 82 set in the second opening 63B*g* has a flat configuration. They may be made of acrylic resin material.

Figure 36:
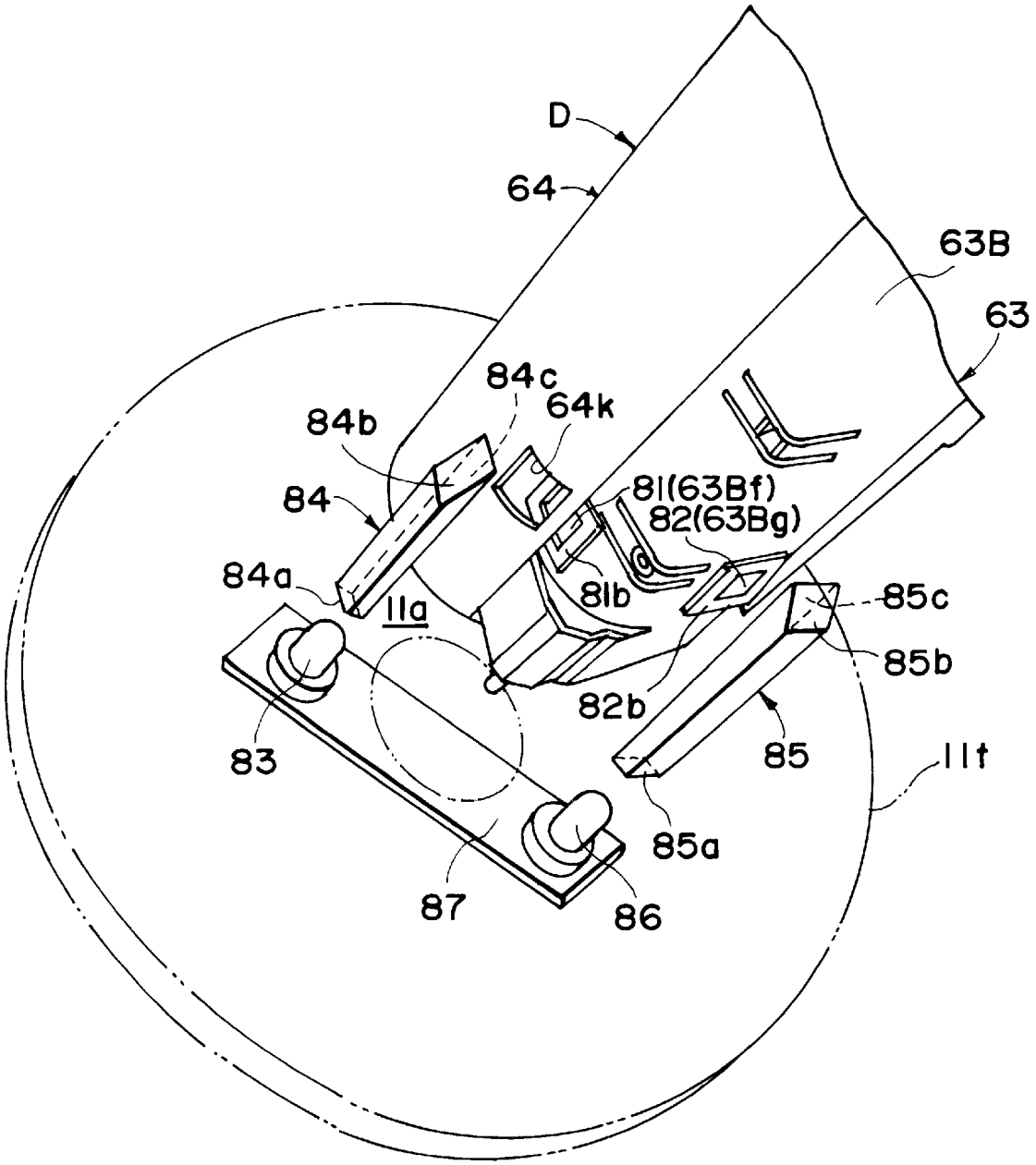
FIG. 36 is a perspective view of a remaining toner amount detecting means.

FIG. 36 shows the state wherein the developing cartridge D is loaded in the rotary unit 11. As shown in FIG. 36, the main assembly 30 of the apparatus is provided with a light emitting element 83 such as a light emitting diode emitting light in the axial direction of the rotary unit 11, and a light receiving element 86 such as CCD. On the other hand, an input light guiding member 84 and an output light guiding member 85 are projected from the wall surface 11*e* axially through the flange 11*f* of the rotary unit 11 and are fixed to the flange 11*f*. The light emitting element 83 and the light receiving element 86 are faced to the incident surface 84*a* and the emergent surface 85*a* of the light guiding members 84, 85 when the developing cartridge D is positioned at the mounting-and-demounting position.

When the developing cartridge D is mounted to the rotary unit 11, the emergent surface 84*c* of the input light guiding member 84 is opposed to the opening 64*k* of the shutter 64. The direction of the emergent surface 84*c* is determined so that light therefrom travels through the opening 64*k*, the first opening 63B*f* and the second opening 63B*g* of the shutter 64.

The incident surface 85*c* of the output light guiding member 85 is disposed at such a position that light emergent from the emergent surface 84*c* of the input light guiding member 84 travels through the opening 64*k* of the shutter 64, the first opening 63B*f* of the toner frame 63B and the second opening 63B*g*, when the developing cartridge D is mounted to the rotary unit 11.

With this structure, when the toner accommodating portion 63*a* contains the toner, the light emergent from the light emitting element 83 is blocked by the toner in the toner accommodating portion 63*a* in the toner frame 63B, but when the amount of the toner in the cartridge frame 63 is very small, the light travels through the input light guiding member 84, first opening 63B*f* into the toner frame 63B. The light emergent from the light emitting element 83 of the main assembly 30, is incident on the incident surface 84*a* of the input light guiding member 84 of the rotary unit 11; travels through the input light guiding member 84; reflected by the reflection surface 84*b*; is emergent from the emergent surface 84*c*; travels through the opening 64*k*, the transparent member 81 of the developing cartridge D, toner accommodating portion 63*a* in the toner frame 63B, transparent member 82 to the incident surface 85*c* in the output light guiding member 85 of the rotary unit 11; reflected by the reflection surface 85*b*; travels through the output light guiding member 85; is emergent from the emergent surface 85*a*; and is received by the light receiving element 86 of the main assembly 30 of the apparatus. The light receiving element 86 is a CCD or the like, and therefore, it produces a signal through photoelectric conversion, and an unshown toner presence/absence detection circuit in a main assembly 30 discriminates the no-toner state, and displays the event on a display.

The light guiding members 84, 85 are of acrylic resin material.

By unifying the light emitting element 85 and the light receiving element 86 on a common substrate 87, assembling and disassembling operation is easy.

The input light guiding member 84 and the output light guiding member 85 are provided in each of the cartridge mounting portions 14*y*, 14*m*, 14*c*, 14*b* in one rotary unit 11.

As shown in FIG. 4, the light-transmissive member 81 has a cylindrical surface 81*a* having an axis coincident with the center line (center of rotation of the toner feeding member 15) of the journals 33, 36 functioning as the supporting shaft 15*c* and projects toward inside of the toner accommodating portion 63*a*. The flange 81*b* in the first opening 63B*f* is welded or bonded to the edge of the first opening 63B*f*. Thus, the light-transmissive member 81 is provided with a recess 81*c*, and therefore, the light transmitting portion of the light-transmissive member 81 is not contaminated or damaged when the developing cartridge D is handled.

The light-transmissive member 82 has a flat surface 82*a* crossing perpendicularly to a normal line extended from the center of the supporting shaft 15*c* (journals 33 and 36) of toner feeding member 15, and the flange 82*b* in the opening 63B*g* is welded or bonded to the edge of the opening 63B*g*. Since the transmissive member 82 is provided with a shallow recess, the transmission surface of the light-transmissive member 82 is not contaminated or damaged when the developing cartridge D is handled. The radius of the toner feeding member 15 is larger than the length of the normal line extended to the flat surface 82*a* or the cylindrical surface 81*a* faced to the toner accommodating portion 63*a* of the light-transmissive member 81, 82 from the center of rotation of the toner feeding member 15. The toner frame 63B includes an inner surface such as an arcuated surface 63B*t* along which an elastic blade of the toner feeding member 15 is slid with the elastic blade being slightly bent in free state. The radius of the arcuated surface 63B*t* is larger than the length of a normal line extended from the center of rotation of the member 15 to the flat surface 82*a* of the light-transmissive member 82 or the cylindrical surface 81*a* of the light-transmissive member 81.

As shown in FIG. 30 ands 31, the end portions of the journal 33, 36 is provided with axial slits, into which a blade supporting metal plate 15*b* for the toner feeding member 15 is inserted so as to be supported thereon. Holes into which the free ends 15*b*1 of the blade supporting metal plate 15*b* inserted into the slit snugly fits, are formed at the axes of the journals 33, 36. The supporting metal plate 15*b* is provided with an elongated hole 15*b*2 elongated in the longitudinal direction, and longitudinally elongated grooves 15*b*3 are formed at the opposite ends.

With the provision of the elongated holes 15*b*2 and the elongated grooves 15*b*3, when the toner feeding member 15 rotates, the toner in the toner accommodating portion 63*a* is raised, and is fed out into the developer chamber 63A*t* when the toner feeding member 15 approaches to the horizontal position. In this case, the toner fed out, returns to the toner accommodating portion 63*a* through the elongated holes 15*b*2 and the elongated grooves 15*b*3, so that it can be avoided that too much toner is fed into the developer chamber 63A*t*. Additionally, the load of the toner feeding member 15 can be reduced, so that driving power for the developing cartridge D can be reduced.

To the blade supporting metal plate 15*b*, the elastic blade 15*a* is bonded or welded to constitute an integral unit. The light-transmissive members 81, 82 are slightly projected into the toner accommodating portion 63*a* beyond the arcuated surface 63B*t* of the toner frame 63B. On the other hand, the free end of the elastic blade 15*a* is away from the center of rotation by the same distance over the entire length thereof, and therefore, the elastic blade 15*a* is bent more in the positions of the cylindrical surface 81*a* of the light-transmissive member 81 and the flat surface 82*a* of the light-transmissive member 82 than in the other longitudinal positions. By this, the toner is assuredly removed from the cylindrical surface 81*a* and the flat surface 82*a*. Thus, the correctness of the detection of the presence or absence of the toner in the toner accommodating portion 63*a* is maintained.

In order to assure the correctness of the detection of the presence or absence of the toner in the toner accommodating portion 63*a*, a part, in the longitudinal direction, of the elastic blade 15*a* (toner stirring member) is flexed more than the other portion to assuredly remove the toner deposited on the inner surfaces of the light-transmissive members 81, 82. To avoid the influence to the development, the light-transmissive members 81, 82 are located adjacent the longitudinal end portion of the toner accommodating portion 63*a*, which is outside the developing zone, so that motion of the toner adjacent the longitudinal end portion of the elastic blade 15*a*, which motion is different from that of the other longitudinal portion does not influence the image region. Since the lengths of the entering emergent light guiding members 84, 85 may be short, the attenuation of the light quantity is small, and therefore, the light emitting element 83 and the light receiving element 86 can be constituted with small size and low cost.

To avoid the influence, to the image region, of the non-uniformity of the toner stirring by the elastic blade 15*a* in the longitudinal direction, the light-transmissive member 81, 82 as are provided adjacent the ends of the toner accommodating portion 63*a*. FIGS. 30, 31 show the example with which the provision of the end does not influence the image region. As shown in the Figures, a part of the elastic blade 15*a* is cut away (portion 15*a*1) from the end toward the center in a zone outside the image region. The cut-away portion 15*a*1 may be in the form of a slit having a width or a cut substantially not having a width. The portion 15*a*1 is disposed adjacent a longitudinally outer portion of the light-transmissive members 81, 82 toward the central portion of the toner frame 63B.

Because of the provision of the cut-away portion 15*a*1 even if the light-transmissive member cleaning portion 15*a*2 of the elastic blade 15*a* for cleaning the light-transmissive member 81, 82 deforms significantly to produce non-uniform motion when it passes by the light-transmissive members 81, 82, no influence is imparted beyond the portion 15*a*1 to the behavior of the elastic blade in the developing zone.

The toner feeding member 15 rotates in FIG. 4 in the counterclockwise direction to raise the toner toward the toner supply opening 63B*c* and feeds the toner into the developer chamber 63A*t* through the toner supply opening 63B*c*.

By the application roller 19 which rotates during developing operation, the toner is applied on the developing roller 12, and the layer thickness of the toner on the developing roller 12 is regulated by the developing blade 16, and simultaneously the triboelectric charge is given. The toner deposited on the developing roller 12 is supplied with a developing bias to be deposited to the latent image on the photosensitive drum 1, so as to provide a visualized image on the photosensitive drum 1. The application roller 19, developing blade 16 and the developing roller 12 are given the same potential.

By repetition of the development operation, the amount of the toner in the toner accommodating portion 63*a* decreases. By the rotation of the elastic blade 15*a* of the toner feeding member 15 in the counterclockwise direction with the decrease of the toner, the cylindrical surface 81*a* and the flat surface 82*a* faced to the toner accommodating portion 63*a* of the light-transmissive members 81, 82 are rubbed so that toner is removed therefrom. When the toner accommodating portion 63*a* approaches to the empty state, the toner remains on the flat surface 82*a*, but the cylindrical surface 81*a* is cleaned by the elastic blade 15*a*, and therefore, the toner is not deposited again. On the other hand, even if the toner on the flat surface 82*a* is removed by the elastic blade 15*a*, the falling toner covers the flat surface 82*a*. However, when the remaining amount of the toner reduces, the duration in which the toner is accumulated on the flat surface 82*a* is longer than the duration in which the toner is not accumulated thereon. When the length or ratio of the duration in which the light from the light emitting element 83 to the light receiving element 87 through the input light guiding member 84, the light-transmissive member 81, the toner accommodating portion 63*a*, the light-transmissive member 82, the shutter 64, the opening 64*k* and the output light guiding member 85, is longer or larger than a predetermined length or ration, the no-toner is displayed on a display portion of the main assembly 30 of the apparatus.

Since the opening for the toner presence/absence detection is provided adjacent a longitudinal end portion of the toner frame, the motion of the stirring blade for scraping the inner surface of the light-transmissive member for sealing the opening may be different from the other portion, but the influence of the different motion is limited to the longitudinal end portion of the toner accommodating portion of the toner frame, and does not influence the image region.

Since the opening for the toner presence/absence detection is provided adjacent the longitudinal end portion of the toner frame, the distance between the opening and the light emitting element or the light receiving element can be shortened, thus accomplishing the saving of the light guiding member.

The material of the light guiding member is not limited to a hard acrylic material, but light fibers are usable.

(Toner Deposition Prevention to the Outer Wall of the Developing Cartridge)

As shown in FIG. 8, a round hole 64*a* provided at an apex portion of one of a side sector-shaped wall 64*e*, perpendicular to the longitudinal direction, of the shutter 64, is rotatably engaged with a projected portion 63*c* provided at provision of the side wall 64*e*, and a round hole 64*a* of the other side sector-shaped wall 64*f* is engaged rotatably with a projected portion 63*g* mounted on the other longitudinal end of the developing cartridge D. The portion between the side walls 64*e*, 64*f* of the shutter 64 is a covering portion 64*g*.

The covering portion 64*g* of the shutter 64 extends in the longitudinal direction and has an arcuation shape section having a center at the projected portion 63*g* mounted to the side cover 63E and the projected portion 63*c* integral with the side cover 63D. The shutter 64 is open when the cartridge is mounted to the main assembly 30 of the apparatus, and the developing roller 12 or the like is exposed as shown in FIG. 6. When the cartridge is out of the main assembly 30, the shutter 64 is closed to cover the developing roller 12 or the like. The opening and closing of the shutter 64 is carried out by the mounting-and-demounting operation of the developing cartridge D onto the rotary unit 11 through the interrelation between the shutter 64 and the cartridge mounting portion 14 of the rotary unit 11. The opening 63*b* for exposing the developing roller 12 or the like, is defined by the developing blade 16, tongue portion 63A*u* of the developing member supporting frame 63A shown in FIG. 4, and the side covers 63D, 63E shown in FIG. 6.

Figure 37:
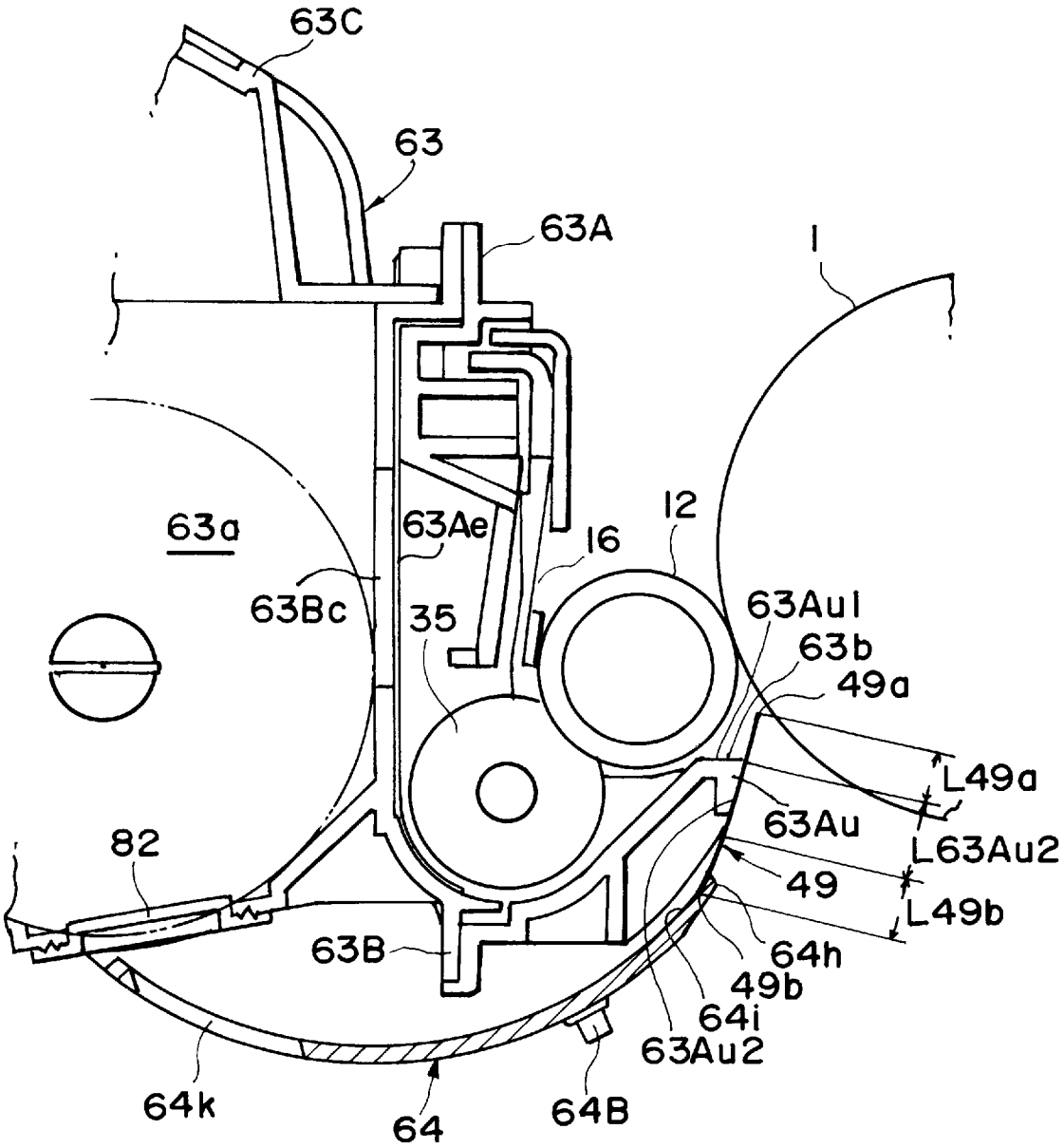
FIG. 37 is a partial enlarged view of the remaining toner amount detecting means of FIG. 36.

As shown in FIG. 37 (partial enlarged view of the part shown in FIG. 4), the upper surface 63A*u*1 of the tongue portion 63A*u* of the developing member supporting frame 63A having a generally L-shaped cross-section, is substantially horizontal at the developing position, and the front side 63A*u*2 thereof is inclined such that acute angle is formed between the tongue portion 63A*u* and the upper surface. The flat surface including the front side 63A*u*2 of the tongue portion, cross an open end (door end) of the shutter 64 64*h*, and is outside the inner surface 64*i* of the shutter at the open end 64*h*.

A flexible seal 49 is stuck on the front side 63A*u*2 of the tongue portion of the developing member supporting frame 63A. The flexible seal 49, as shown in FIG. 6, extends in the longitudinal direction so as to cover the developing zone beyond the developing zone of the developing roller 12. More particularly, the opposite ends of the flexible seal 49 are extended so as to overlap with the spacer rollers 12*a*, 12*b*. One longitudinal side 49*a* of the flexible seal 49 is close to the photosensitive drum 1 such that toner image formed on the photosensitive drum 1 can pass through. The edge of the other side 49*b* is presscontacted to the inner surface 64*i* of the shutter at the edge of the open end 64*h* of the shutter 64 when the shutter 64 is open. Flexible seal 49 is a flat belt-like when the shutter 64 is not mounted on the cartridge frame 63. When the shutter 64 is mounted to the cartridge frame 63, and the inner surface 64*i* of the shutter 64 is contacted to the other side 49*b* of the seal 49, the flexible seal 49 is bent.

Figure 38:
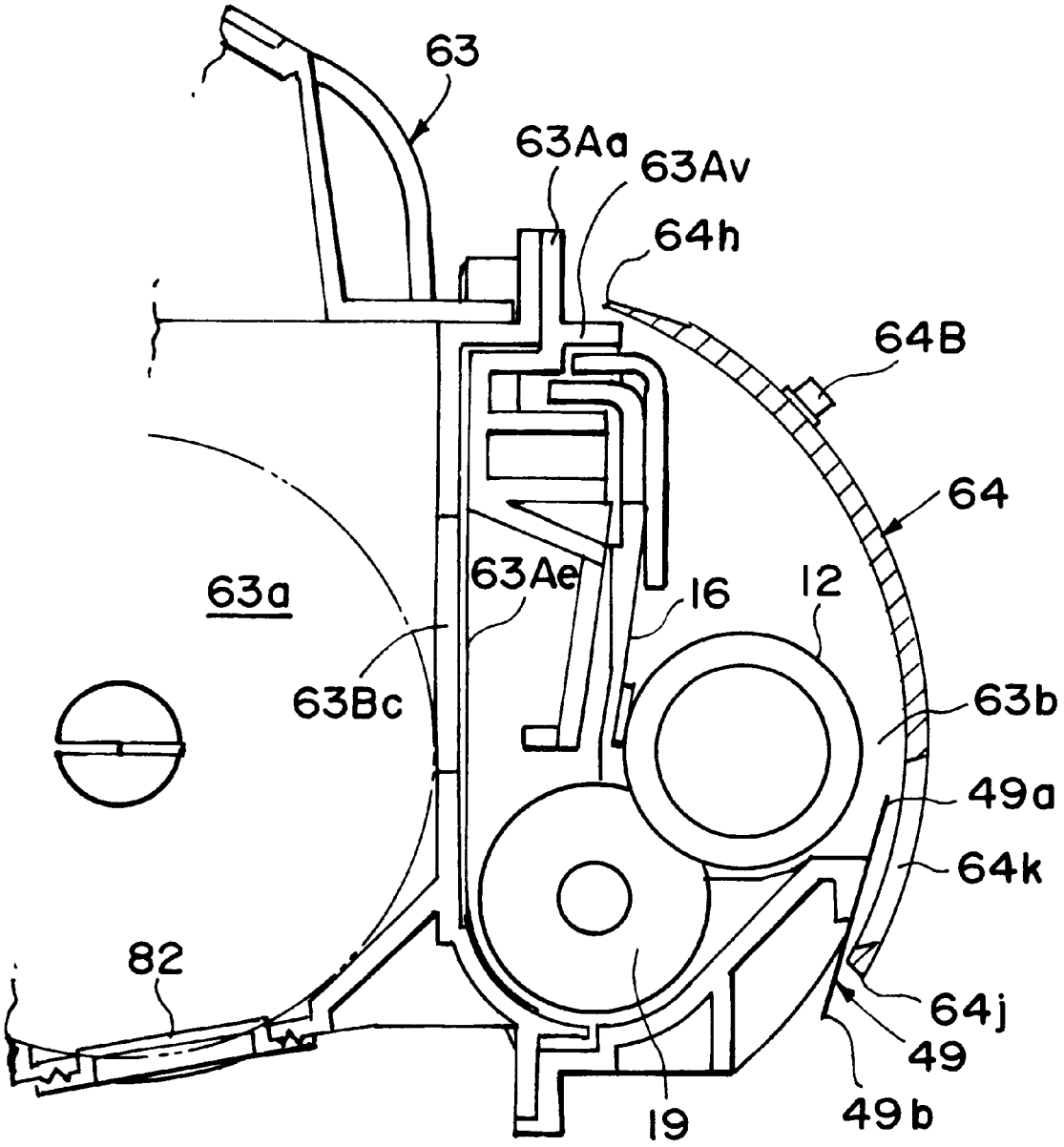
FIG. 38 is a longitudinal sectional view wherein the shutter is closed.

As shown in FIG. 38, when the shutter 64 is closed, the rear edge 64*j* of the shutter 64 is away from the other side 49*b* of the flexible seal 49, and the flexible seal 49 is flat.

When the shutter 64 is closed, the open end 64*h* of the shutter 64 is overlapped on the projection 63A*v* provided on the front side (downstream end in the opening direction) of the flange 63A*a* of the developing member supporting frame 63A to contact it or to be slightly spaced therefrom. The rear edge 64*j* of the shutter 64 is overlapped with the flexible seal 49 to contact the flexible seal 49 or to be close thereto. The opening 64*k* of the shutter 64 is substantially overlapped with the flexible seal 49.

When the shutter 64 is open, one side 49*a* of the flexible seal 49 prevents the leakage of the toner from the developing roller 12 side. Even if the toner is scattered, the toner does not go around to the outer wall surface of the cartridge frame 63 since the shutter 64 and other side 49*b* of the flexible seal 49 are press-contacted to the inner surface 64*i* of the shutter 64. When the developing cartridge D is dismounted, the use's hand is not contaminated even if the user grips the cartridge frame 63 or the like as well as the grip 63*e* of the developing cartridge D.

When the shutter 64 is closed, it covers the entire opening 63*b* for exposing the developing roller 12 or the like, and the both of the side walls 64*e*, 64*f* of the shutter 64 are close to and cover the both side surfaces 63*h*, 63*i* of the side covers 63D, 63E, and the flexible seal 49 is overlapped to the opening 64*k* of the shutter 64, and therefore, the developing roller 12 or the like is sufficiently protected. In addition, the dust is prevented from moving toward the developing roller 12.

The width L63A*u*2 of the front side 63A*u*2 of the tongue portion of the developing member supporting frame 63A to which the flexible seal 49 is stuck, is 2–10 mm; the length L49*a* of the flexible seal 49 projected toward the photosensitive drum 1 in the lateral direction from the corner where the front side 63A*u*2 of the tongue portion and the upper surface 63A*u*1 thereof is 1–5 mm; length L49*b* of the portion of the flexible seal projected from the bottom end of the front side 63A*u*2 of the tongue portion is 5–30 mm. In the embodiment, the width L63A*u*2 of the front side of the tongue portion is 4.5 mm; the length of the portion of the flexible seal 49 projected toward the outer periphery of the developing roller 12 L49*a*=2.5 mm; and the length of the portion of the flexible seal 49 projected toward the other side 49*b* (free end for rubbing the shutter 64) L49*b*=18 mm. The length of the flexible seal 49 is 242 mm (the sheet width of the image forming apparatus is 216 mm (letter O (LTR) size width).

The material of the flexible seal 49 is polyethylene terephthalate PET, polyethylene PE, polyprene or the like.

As described in the foregoing, the developing cartridge D includes a shutter 64 which is movable between the cover position for covering the portion where the developing roller 12 is to be exposed from the cartridge frame 63 and a retracted position for exposing the developing roller 12 from the cartridge frame 63.

It also includes a flexible seal 49 which is extended in the longitudinal direction of the developing roller 12 and which is projected from a cartridge frame 63 at each of the lateral ends at the position where the cartridge frame 63 is opposed to the movement path of the shutter 64. The flexible seal 49 is effective to prevent the leakage of the toner from the cartridge frame 63.

When the shutter 64 is retracted to the retracted position, a one side 49*a* of the lateral sides of the flexible seal 49 is brought into contact with the inner surface 64*i* of the shutter 64.

Since the flexible seal 49 is provided in this manner, the shutter 64 and the flexible seal 49 can prevent the contamination of the outer wall of the cartridge frame 63 with the scattering toner during the image formation operation in which the shutter 64 is opened. Upon mounting-and-demounting of the developing cartridge by the user, the portion contacted to the developing cartridge is not contaminated, and therefore, the user is not contaminated.

The flexible seal 49, when the shutter 64 is closed, substantially entirely covers the opening 64*k* of the shutter 64 for the detection of the remaining toner amount (presence or absence), and therefore, the foreign matter such as dust is prevented from entering the exposed portion of the developing cartridge D through the opening 64*k*.

(Side cover at the driving force reception side (developing bias contact))

Figure 39:
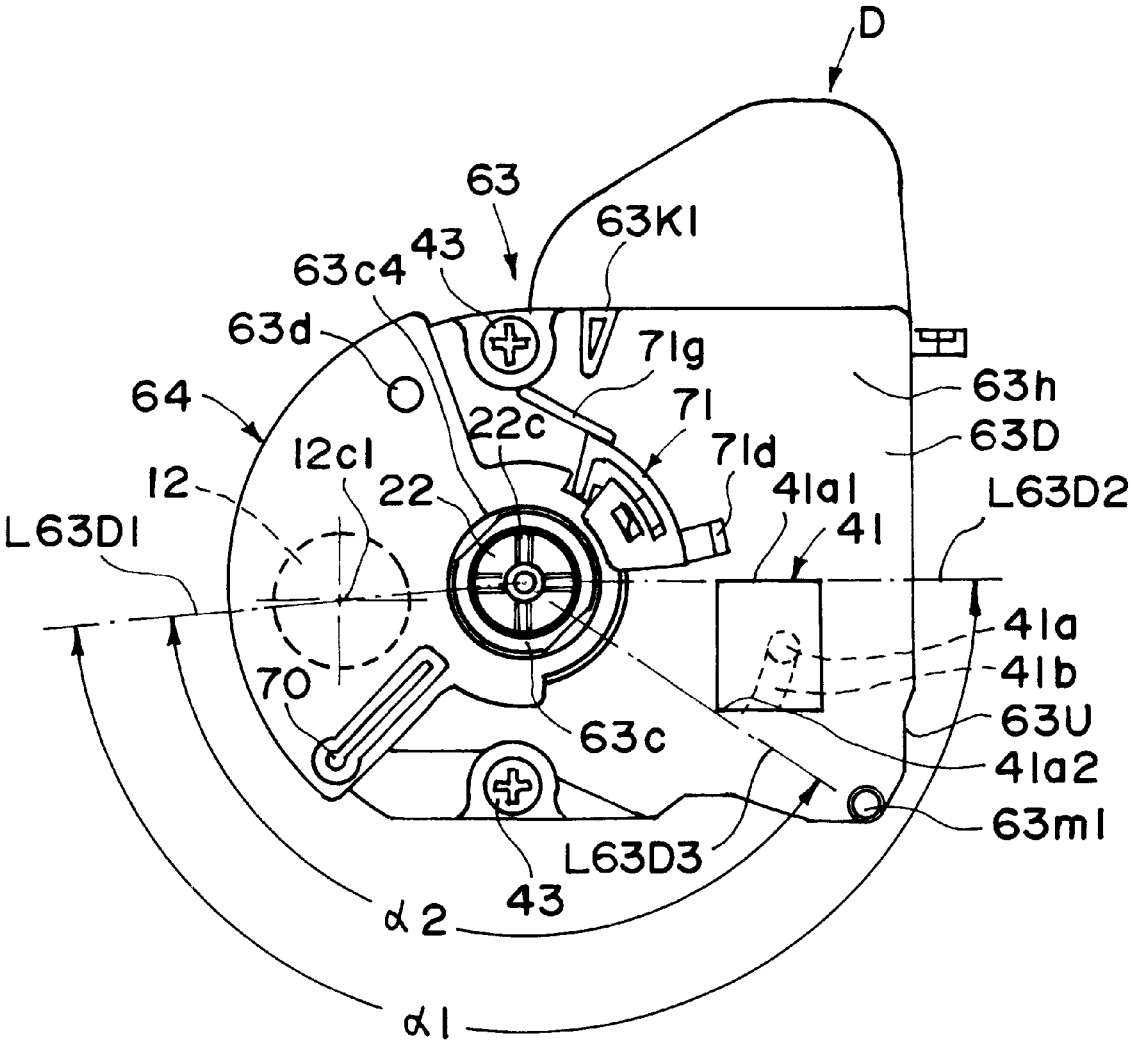
FIG. 39 is a side view of a driving side cover.

As shown in FIG. 39, the side surface 63*h* of the side cover 63D provided at the driving force reception side of the developing cartridge D constitutes a flat surface substantially perpendicular to the longitudinal direction when the developing cartridge D has been assembled. The side surface 63*h* has an integral cylindrical projected portion 63*c* enclosing the driving force receiving member 22.

The free end of the projected portion 63*c* and the free end (in the axial direction) of the driving force receiving member 22 are substantially on a flat surface parallel with the side surface 63*h*.

The side surface 63*h* has a developing bias contact 41 which is flush with the side surface 63*h* and exposed there. The configuration of the developing bias contact 41 is substantially rectangular, and one side 41*a*1 thereof is on a line L63D2 passing through the center of rotation 22*c* of the driving force receiving member 22. The line L63D2 passing through the center of rotation 22*c* of the driving force receiving member 22 is at approx. $\alpha 1$=approx. 175° away, in the counterclockwise direction, from a line L63D1 connecting the center 12*c*1 (center of rotation of the developing roller 12) of the rotation shaft 12*c* of the developing roller 12 and the center of rotation 22*c* of the driving force receiving member 22 as seen from the outside of the side cover 63D having the developing bias contact, in the longitudinal direction of the developing roller 12. An angle $\alpha 2$ formed between the line L63D3 connecting the center of rotation 22*c* of the driving force receiving member 22 and the corner 41*a*2 of a side opposed to the side 41*a*1 of the developing bias contact 41 and a line L63D1 connecting the centers of rotation 12*c*1 and 22*c* of the developing roller 12 and the driving force receiving member 22. The developing bias contact 41 is disposed in a region of 140° to 175° in the counterclockwise direction relative to the line L63D1 connecting the center of rotation 12*c*1 of the developing roller 12 and the center of rotation 22*c* of the driving force receiving member 22, as seen from the side cover 63D of the cartridge frame 63 which has the developing bias contact 41, in the longitudinal direction of the developing roller 12. Because the developing bias contact 41 is disposed in such a region, the portion to be contacted to the main assembly developing bias contact member (contact pin 42) provided in the main assembly of the apparatus, is in the region. Therefore, a portion of the developing bias contact other than the contacting portion may be out of the region. However, further preferably, all the region of the developing bias contact 41 is in the position within the region.

The developing bias contact 41, when the developing cartridge D is mounted to the rotary unit 11, is contacted to the developing bias contact pin 42 provided on the flange 11*g* of the rotary unit 11 shown in FIG. 14 and projected by elastic force in the axial direction from the wall surface 11*a*. In FIG. 39, the portion enclosed by the broken lines 41*a*, define the portion contacting to the contact pin 42 during the development. The contact pin 42 has a free end of semi-spherical shape, which is in sliding contact with the developing bias contact 41 when the developing cartridge D is mounted to the rotary unit 11. In FIG. 39, the portion enclosed by the broken lines 41*b*, define the portion contacting to the contact pin 42. The developing cartridge D, when it is mounted to the rotary unit 11, and the rotary unit 11 is rotated for positioning, the spacer rollers 12*a*, 12*b* at the opposite ends of the developing roller 12 are abutted to the photosensitive drum 1. The developing cartridge D is supported by the arcuated ribs 26*a*, 59*e* of the rotary unit 11 supporting the projected portions 63*c*, 63*g* of the cartridge frame 63 against the spring force of the compression coil spring lid, and pivots about the center of rotation 22*c* of the driving force receiving member 22 (centers of the projected portions 63*c*, 63*g*). Since the developing bias contact 41 is disposed in the above-described region, the developing bias contact pin 42 projected from the rotary unit 11 is not out of the developing bias contact 41 despite the pivoting action. Therefore, the developing bias contact pin 42 and the developing bias contact 41 are in sliding contact with each other during the rotational positioning operation in the developing process operation, so that no electric conduction defect occurs due to foreign matter sandwiched between the contact pin 42 and the contact 41. The developing bias contact pin 42 is not contacted to the surface of the synthetic resin material of the side 63*h* of the developing cartridge D during the rotation of the rotary unit 11, and therefore, the 63*h* is not scraped.

During the development operation, through the contact pin 42 and the developing bias contact 41, the developing roller 12 is supplied with a developing bias voltage which is an AC voltage having a peak-to-peak voltage of 2000 V and a frequency of 2000 Hz biased with a DC voltage of −400 V.

The developing bias contact 41 of the developing cartridge D mounted to the rotary unit 11 as a substantially rectangular shape, and the center portion of the rectangular is contacted to the developing bias contact pin 42 provided in the rotary unit 11.

The driving force receiving member 22, the developing bias contact 41 and the positioning projection (pin) 63*d* are substantially aligned on a line.

As described in the foregoing, there is provided a developing cartridge D for developing a latent image formed on an electrophotographic photosensitive member, which is detachably mountable relative to a main assembly of an electrophotographic image forming apparatus, said developing cartridge comprising:

a cartridge frame;

a developing roller 12 for developing the electrostatic latent image formed on the electrophotographic photosensitive member;

toner accommodating portion for accommodating toner to be used for development by the developing roller;

a driving force receiving member 22 for receiving driving force for rotating said developing roller, from the main assembly of apparatus when said developing cartridge is mounted to the main assembly, wherein said driving force receiving member is exposed from a portion 63D of said cartridge frame, provided at one longitudinal end portion;

a developing bias contact 41 for receiving a developing bias to be applied to said developing roller 12 from the main assembly of the apparatus, when said developing cartridge is mounted the main assembly, wherein said bias contact 41 is exposed from a portion 63D of said cartridge frame, provided at one longitudinal end portion;

wherein said developing bias contact 41 is within a range of 140° to 175° from a line connecting a center 12*c*1 of rotation of said developing roller 12 and a center 22*c* of rotation of said driving force receiving member 22 in a center of rotation as seen from an outside of such a portion of said cartridge frame as has said developing bias contact, in a longitudinal direction of said developing roller.

Said developing bias contact 41 is substantially rectangular, and substantial center portion of the rectangular shape is contacted to a developing bias contact pin 42 provided in the main assembly, so that developing bias contact 41 receives a developing bias to be applied to said developing roller 12 from the main assembly through said developing bias contact pin 42.

A short side of the rectangular shape is extended along a line which is at approx. 175° from the line connecting the center 12*c*1 of rotation of said developing roller 12 and the center 22*c* of rotation of said driving force receiving member 22 in the counterclockwise direction.

Said developing bias contact 41 is disposed at such a position that corner portion of the rectangular shape contacts a line L63D3 positioned at approx. 145° from the line connecting the center 12*c*1 of rotation of said developing roller 12 and the center 22*c* of rotation of said driving force receiving member 22 in the counterclockwise direction.

Said developing cartridge further comprises a developing blade 16 for regulating an amount of the toner deposited on a peripheral surface of said developing roller 12.

The toner accommodated in said toner accommodating portion 63*a* is yellow color toner, magenta color toner or cyan color toner, said developing cartridge further comprising an application roller 19 for depositing the toner on a peripheral surface of said developing roller 12, and the bias received from the main assembly is applied to said developing roller 12, said developing blade 16 and said application roller 19.

The bias received from the main assembly by said developing bias contact 41 is applied to a plate portion 16*a* of said developing blade 16 through a first leaf spring portion 41*c*, and is applied to said application roller 12 through a second leaf spring portion 41*d*, and is further applied to said application roller 19 of a shaft portion of said developing roller through a coil spring 46, wherein said developing bias contact, first leaf spring portion and second leaf spring portion are parts of an integral metal member.

The toner accommodated in said toner accommodating portion 63*a* is black color toner, wherein the bias received from the main assembly by said developing bias contact 41 is applied to said developing roller 12, and not to said developing blade 16.

As described in the foregoing, the developing cartridge D includes the developing cartridge side cover 63D having, as a portion of the cartridge frame 63, the opening for exposing the driving force receiving member 22 and a developing bias contact mounting portion for mounting the developing bias contact 41. The side cover 63D of the developing cartridge includes the urging force receptor portions (spring receptor portions) 63*k*1, 63*k*2 for receiving the urging force of the compression coil spring 11*d* provided in the rotary unit 11 of the main assembly 30 of the apparatus when the developing cartridge D is mounted to the main assembly 30 of the electrophotographic image forming apparatus, and the abutment portions in the form of bosses 63*m*1, 63*m*2 for contacting to the rotary unit 11 of the main assembly 30, for regulating the rotation of the developing cartridge D rotated by the force received by the urging force receptor portions 63*k*1, 63*k*2. The developing bias contact 41 is located at a position retracted from the free end 63*c*3 of the cylindrical portion 63*c*2 having the opening for exposing the driving force receiving member 22 and the urging force receptor portions 63*k*1, 63*k*2 in the longitudinal direction of the developing roller 12.

The side cover 63D is securely fixed to the coupling frame 63F by screws 43 threaded through the hole 63D*rs* of the side cover 63D into the screws 63F*e* (FIG. 34). The dowel 63D*s* of the side cover 63D is engaged with a hole 63F*r* of the coupling frame 63F to accomplish relative positioning between the cover 63D and the frame 63F. One of the holes is elongated.

Figure 40:
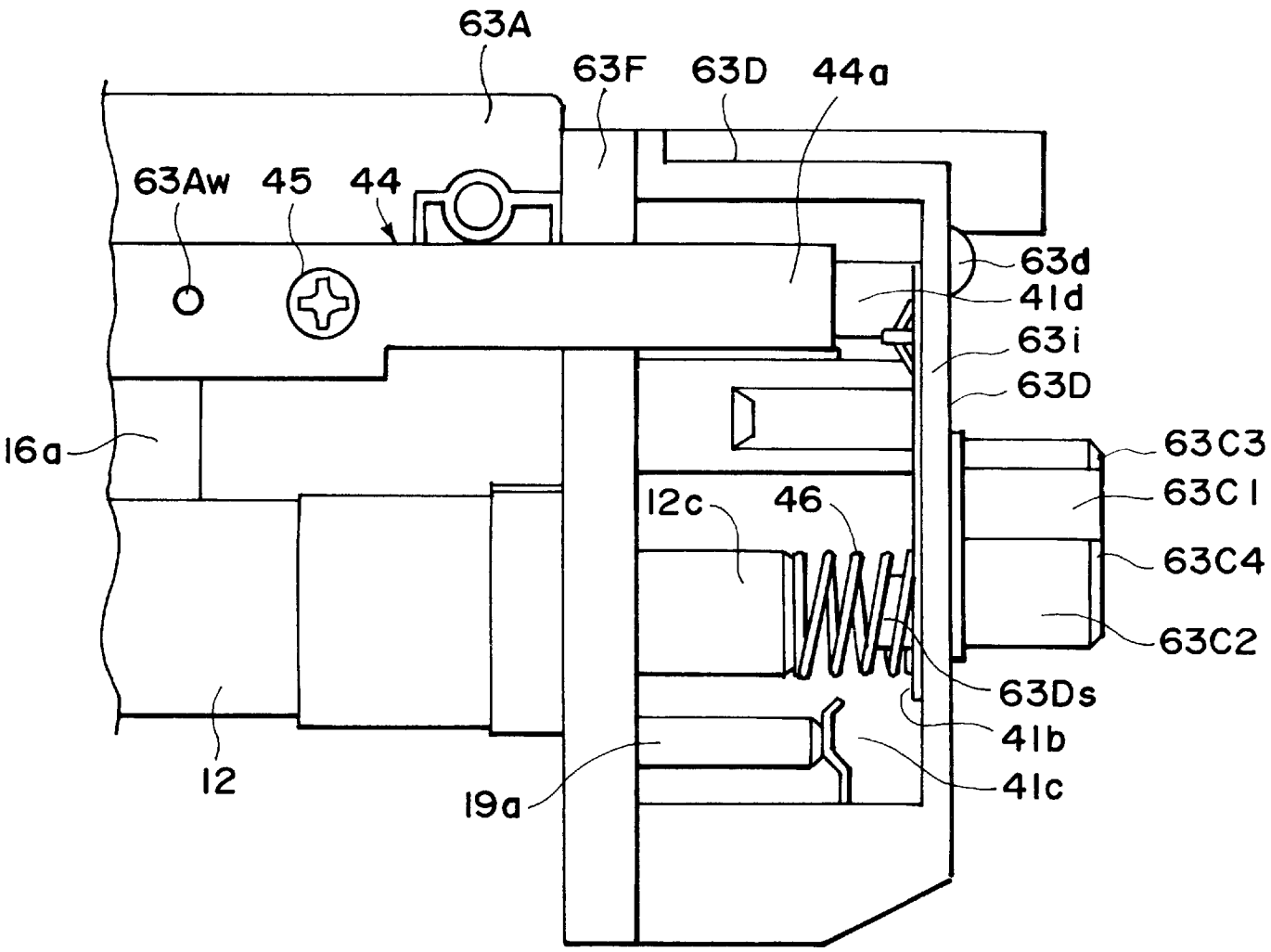
FIG. 40 is a front view of an end with the shutter of the developing cartridge being removed.

As shown in FIG. 40, the inside of the side cover 63D is provided with a spring holding projection 63Ds projected in the axial direction toward the end of the rotation shaft 12*c* of the developing roller 12, and around the spring holding projection 63Ds a contact portion 41*b* is provided. An application roller contact portion 41*c* contacted to the end of the rotation shaft 19*a* of the application roller 19 is provided as a second leaf spring portion in the form of a cantilever. In the case of the color developing cartridges Dy, Dm, Dc, the developing blade 16 is elastic, and in order to urge the blade supporting metal plate 16*a* (flexible thin plate), a confining plate 44 is overlapped on the blade supporting metal plate 16*a* and is engaged with and positioned by a dowel 63A*w* integrally formed with the developing member supporting frame 63A. Small screws 45 are threaded through holes of the plate 44 into the developing member supporting frame 63A. The plate 44 is extended to a neighborhood of the back side of the side surface 63*i* of the side cover 63D at the driving force reception side, and the free end 44*a* thereof is overlapped with the developing blade contact portion 41*d* of the developing bias contact 41. The developing blade contact portion 41*d* is inclined toward the free end 44*a* of the plate 44, and the free end 44*a* of the plate 44 is abutted to the inclined surface, by which the developing blade contact portion 41*d* is bent. In other words, the developing blade contact portion 41*d* functions an first leaf spring portion.

The contact 41, the inner developing bias contact portion 41*b*, the application roller contact portion 41*c*, the developing blade contact portion 41*d*, are formed as integral metal sheet to constitute the developing bias contact member. Therefore, the developing roller 12, the developing blade 16 and the application roller 19 are maintained at the same potential. The material of the developing bias contact member may be phosphor bronze, belium bronze, stainless steel or the like.

Between the inner developing bias contact portion 41*b* and the end surface of the rotation shaft 12*c* of the developing roller 12, a developing bias contact spring 46 in the form of a metal compression coil spring is compressed.

In the case of the black developing cartridge Db, the plate 16*a* supporting the elastic blade 16*c* of the developing blade 16 is rigid and in the form of a strip, and therefore, no confining plate 44 used in the above-described color developing devices Dy, Dm, Dc is not used. Therefore, the developing blade contact portion 41*d* of the black developing cartridge Db and the developing blade 16 re electrically isolated, so that developing blade contact portion 41*d* does not function. Thus, the developing roller 12 of the black developing cartridge Db is supplied with the developing bias, but the developing blade 16 is not supplied with it.

Figure 41:
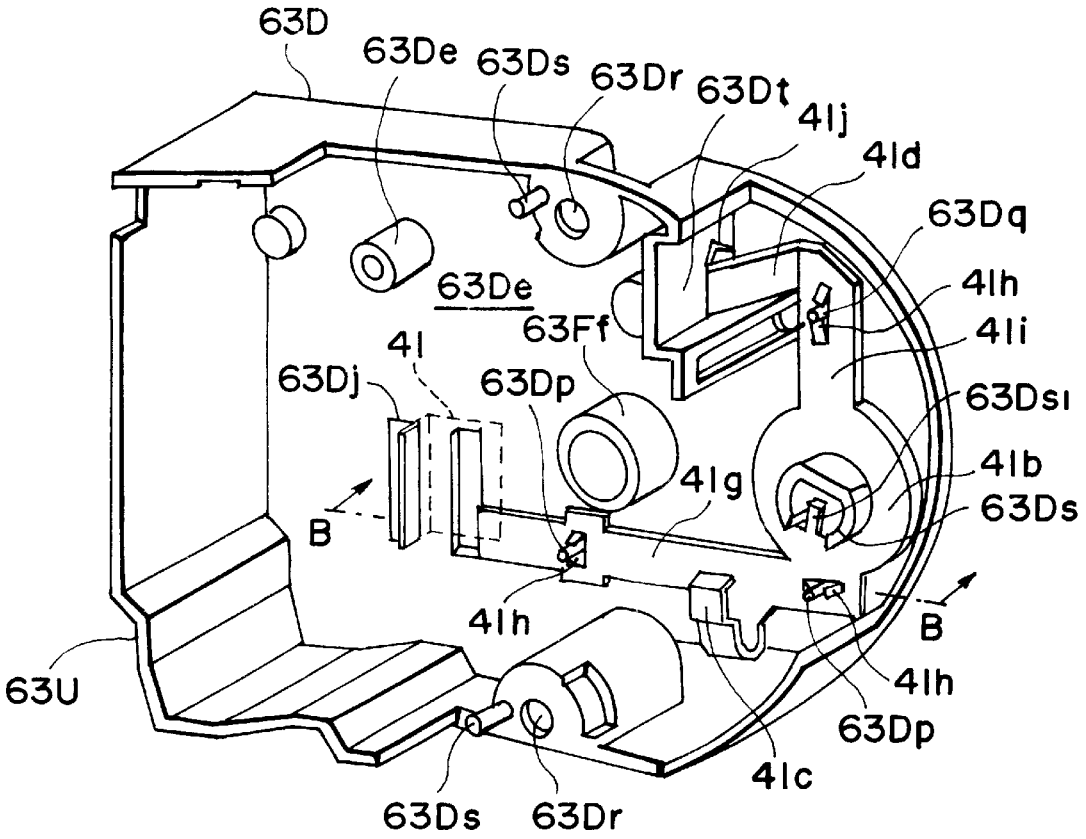
FIG. 41 is a perspective view of an inside of the driving side cover.
Figure 42:
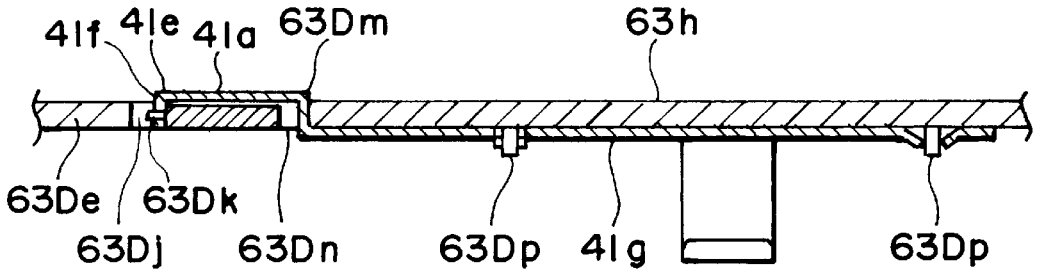
FIG. 42 is a sectional view taken along a line B—B of FIG. 39.

As shown in FIG. 41 showing the inside of the side cover 63D at the driving force reception side, the back side 63De parallel with the side surface 63*h* of the side cover 63D is flat, and is contacted by the inner developing bias contact portion 41*b*. As shown in FIG. 42 (B—B sectional view of FIG. 41), the connection between the inner contact portion 41*b* and the outer exposed portion 41*a* is such that one end portion 41*e* of the outer exposed portion 41*a* is bent to provide a bent portion 41*f* which is provided with a hole, which in turn is engaged with a dowel 63D*k* in the elongated hole 63D*j* penetrating between the side surface 63*h* and back side 63D*e*. An elongated hole 63D*n* parallel with the elongated hole 63D*j* is provided, and the other side of the outer exposed portion 41*a* is bent into the inside through the elongated hole 63D*n*, and the conductive plate portion 41*g* extended along the back side 63D*e* of the side cover 63D is contacted to the back side 63D*e*. As shown in FIG. 41, it continues to and flush with the outer circumference portion of the inner contact portion 41*b*. A dowel 63D*p* projected at the back side 63D*e* of the side cover 63D is engaged with the hole 41*h*, with the reverse, of the conductive plate portion 41*g*. In FIG. 41, a hole 41*h*, with the reverse, of the conductive plate portion 41*i* flush with the upper part of the contact portion 41*b* is engaged with the dowel 63D*q* projected from the inside of the side cover 63D. The conductive plate portion 41*i* is contacted to the back side 63D*e* of the side cover 63D. A blade contact portion 41*d* is inclinedly and integrally extended from the conductive plate portion 41*i* as if it is bent by more than 90 degrees as shown in FIG. 41. The free end portion of the blade contact portion 41*d* is folded into a contact end 41*j* to suppress wearing, and the contact end is contacted to the wall surface 63D*t* provided on the back side 63D*e* of the side cover 63D.

Designated by 63D*s* is a supporting portion for supporting a magnet provided in the inside of the developing roller 12 of the black developing cartridge. Designated by 63D*s*1 is an urging portion for urging a magnet with the elastic force of the molded portion in the thrust direction.

The application roller contact portion 41*c* is extended downwardly from a part of the bottom edge of the lower, and the end portion thereof is bend upwardly to provide a contact portion 41*c*.

With this structure, the developing bias applied to the developing bias contact 41 is applied to the developing roller 12 through the inner developing bias contact portion 41*b*, the developing bias contact spring 46 and the developing roller shaft 12*c*, and is also applied to the rotation shaft 19*a* of the application roller 19 contacted to the application roller contact portion 41*c* to provide the same potential as the developing roller 12 with the application roller 19. The developing bias applied to the outer exposed portion 41*a* is applied to the developing blade 16 through the plate 44 contacted to the developing blade contact portion 41*d*, so that same potentials are provided for the developing roller 12 and the developing blade 16.

Since the developing bias is applied to the developing roller 12, the developing blade 16, the application roller 19 by the developing bias contact member 41 which is an integral member, so that no contact portion exists and therefore electrical stabilization is accomplished.

In the black developing cartridge Db, the voltage is not applied to the developing blade 16. It does not have an application roller.

As regards the developing bias contact, the developer cartridge with the developing bias contact pivots in the rotary unit about the center of rotation of the driving force receiving member (pressure for urging the developing roller to the photosensitive drum). During the rotation, the disengagement between the developing bias contact pin projected from the rotary unit of the main assembly and the developing bias contact of the developing cartridge is prevented. By this, the outer wall of the developing cartridge (surface of the side cover) is prevented from being scraped, or the conduction defect stemming from the foreign matter introduced between the developing bias contact and the pin can be prevented.

In the foregoing, the side cover 63D covers all of the application roller gear 23*e*, the stirring gear 23*d*, the stepped idler gear 23*c* and developing roller gear 23*b* or the like engaged with the driving gear 23*a*. However, the side cover 63D does not receive external force for the driving of the developing cartridge D.

Since the cylindrical projected portion around the opening for the driving force receiving portion and the contact mounting portion are at the same side of the same member, which is to be positioned, then the positional accuracies of the contact relative to the main assembly of the apparatus and the drive input portion can be enhanced.

The side cover 63D of this embodiment is used for a developing cartridge detachably mountable to a main assembly of an electrophotographic image forming apparatus for developing a latent image formed on the photosensitive member.

It comprises an opening (e.g. an opening 63*c*4 provided in a cylindrical portion 63*c*2 as a projected portion) for exposing said driving force receiving member 22.

It also comprises a developing bias contact mounting portion for mounting said developing bias contact.

The developing cartridge side cover 63D further comprises an urging force receptor portion (e.g. spring receptor portion 63*k*) for receiving urging force of a spring member (e.g. compression coil spring 11*d*) provided in the main assembly 30 of the apparatus when the developing cartridge is mounted to the main assembly 30 of the electrophotographic image forming apparatus, and an abutment portion (e.g. boss 63*m*) for contacting to the main assembly 30 to limit the rotation of the rotation developing cartridge D which is rotated by the force received by said urging force receptor portion.

The urging force receptor portion is in the form of a flat plate projected, and said abutment portion is in the form of a projected column.

The opening 63*c*4 for exposing the driving force receiving member is formed in the cylindrical portion projected so as to enclose the driving force receiving member 22.

The developing cartridge D is provided with a shutter 64 movable between a close position for covering the exposed portion of the developing member (e.g. developing roller 12*a*) and a retracted position retracted from the close position, and said cylindrical portion 63*c*2 rotatably mounts one longitudinal end of said shutter 64.

The developing cartridge side cover 63D has a mounting portion 71C for mounting a locking member 71 for locking said shutter 64 at the close position.

The developing cartridge side cover 63D is provided with screw bores 63D*r* for demountably mounting the developing cartridge side cover 63D to the coupling frame 63F for supporting the coupling member 22*d* as the driving force receiving member 22. The coupling frame 63F is mounted to the developing frame 63A including a mounting portion for the developing roller 12. The developing cartridge side cover 63D covers the gear (e.g. developing roller gear 23*b*) for transmitting driving force received by the coupling member 22*d* as the driving force receiving member from the main assembly 30, to the developing member in the form of a developing roller 12, when its mounted to the developing frame 63A through the coupling frame 63F.

When the developing cartridge side cover 63D is mounted to the developing frame 62A, it is mounted to the developing frame 63A with the coupling frame 63F supporting the coupling member 22*d* as the driving force receiving member sandwiched therebetween.

The developing cartridge side cover 63D is an integrally molded plastic resin material.

The mounting method of the developing cartridge side cover 63D comprises:

(a) preparing a developing frame 63A including a developing member mounting portion for mounting a developing member (e.g. developing roller 12) for developing a latent image formed on the photosensitive member;

(b) preparing a coupling frame 63F for supporting a driving force receiving member 22 for receiving driving force for rotating said developing member from the main assembly 30 of the apparatus when mounted to the main assembly 30 of the electrophotographic image forming apparatus;

(c) preparing a developing cartridge side cover 63D*a* having an opening 63*c*4 for exposing said driving force receiving member 22, and a developing bias contact 41 for receiving a developing bias to be applied to said developing member from the main assembly 30 when the developing cartridge D is mounted to the main assembly 30;

(d) coupling frame mounting of mounting the coupling frame 63F to the developing frame 63A;

(e) developing cartridge side cover mounting of mounting the developing cartridge side cover 63D to the coupling frame 63F such that developing bias contact 41 is electrically connected to the developing member and that driving force receiving member 22 is exposed through the opening 63*c*4 of the developing cartridge side cover 63D.

In the coupling frame mounting step, the coupling frame 63F is mounted to the developing frame 63A by screws, and in the developing cartridge side cover mounting step, the developing cartridge side cover 63D is mounted to the coupling frame 63F by screws.

In the embodiment, the side cover 63E and the developing member supporting frame 63A are screwed, but the connecting method may be another, for example, snap-fit and/or snap clip is usable.

According to the foregoing embodiments, the direction in which the user pulls the toner seal can be regulated by a toner seal opening of the side cover so that seal member is prevented from being torn by pulling in an erroneous direction, and/or the leakage of the toner can be prevented. Integral molding with the shaft support member of the developing roller is effective to decrease the number of parts.

As described in the foregoing, according to the present invention, the number of parts can be reduced.

While the invention has been described with reference to the structures disclosed herein, it is not confined to the details set forth and this application is intended to cover such modifications or changes as may come within the purposes of the improvements or the scope of the following claims.

What is claimed is:

1. A side cover for a developing cartridge for developing a latent image formed on an electrophotographic photosensitive member, said developing cartridge being detachably mountable relative to a main assembly of an electrophotographic image forming apparatus, said developing cartridge including a developing roller, for developing a latent image formed on the electrophotographic photosensitive member; a toner accommodating portion for accommodating toner to be used for development by said developing roller, the toner accommodating portion being provided with a toner supply opening for supplying the accommodated toner to said developing roller; and a toner seal for sealing said toner supply opening, said toner seal being pulled out prior to start of use of said developing cartridge, by which said toner supply opening is unsealed to permit supply of the toner accommodated in said toner accommodating portion to said developing roller, said side cover comprising:

a shaft support portion for rotatably supporting a shaft at one end of said developing roller;

a toner seal opening for directing said toner seal to outside when a toner supply opening of said toner accommodating portion is unsealed; and a guiding portion, provided at a side of said side cover that is inside when said side cover is mounted to a cartridge frame of said developing cartridge, for guiding the toner seal toward said toner seal opening when said toner seal is pulled out to unseal the toner supply opening.

2. A side cover according to claim 1, further comprising an engaging portion for engaging one end of a shaft of an application roller for depositing toner on a peripheral surface of said developing roller.

3. A side cover according to claim 1, further comprising an urging force receptor portion for receiving urging force from an elastic member provided in the main assembly to be positioned in the main assembly when said developing cartridge is mounted to the main assembly, and a contact portion for regulating rotation of developing cartridge by the urging force received by said urging force receptor portion.

4. A side cover according to claim 1, further comprising a shaft mounting portion for mounting a shaft which functions to provide a center of rotation when said developing cartridge is mounted to the main assembly.

5. A side cover according to claim 1, wherein aid developing cartridge side cover is an integrally-molded member of plastic resin material.

6. A side cover according to claim 1, further comprising a gripping portion at one longitudinal end of said toner seal, said griping portion being of plastic resin material.

7. A side cover according to claim 1, further comprising a cover portion for covering a toner cap mounted to a toner filling opening for filling the toner into said toner accommodating portion to seal said toner filling opening.

8. A mounting method for a developing cartridge side cover for a developing cartridge for developing a latent image formed on an electrophotographic photosensitive member, said developing cartridge being detachably mountable relative to a main assembly of an electrophotographic image forming apparatus, comprising:

(a) a developing frame preparing step of preparing a developing frame including a developing roller mounting portion for mounting a developing roller for developing a latent image formed on the electrophotographic photosensitive member;

(b) a toner frame preparing step of preparing a toner frame including a toner accommodating portion for accommodating toner to be used for development by said developing roller, wherein said toner accommodating portion has a toner supply opening for supplying the toner accommodated therein to said developing roller (c) a developing cartridge side cover preparing step of preparing a developing cartridge side cover having a shaft support portion for rotatably supporting a shaft at one end of said developing roller, a toner seal opening for directing said toner seal to outside, and a guiding portion, provided at a side of said side cover that is inside when said side cover is mounted to a cartridge frame of said developing cartridge, for guiding the toner seal toward said toner seal opening when said toner seal is pulled out to unseal the toner supply opening;

(d) a coupling step of coupling said developing frame and said toner frame; and (e) a side cover mounting step of mounting said developing cartridge side cover to one longitudinal end of said developing frame and said toner frame, while said toner seal is extended from said toner seal opening to outside.

9. A method according to claim 8, wherein said developing cartridge side cover is fixed to said developing frame by screws.

10. A method according to claim 8, wherein said coupling step couples said developing frame and said toner frame by ultrasonic welding.

11. A method according to claim 8, wherein said coupling step couples said developing frame and said toner frame by snap fitting, and/or by snap clip.

12. A developing cartridge for developing a latent image formed on the photosensitive member, wherein said developing cartridge is detachably mountable to a main assembly of an electrophotographic image forming apparatus, said developing cartridge comprising:

(a) a developing roller for developing a latent image formed on an electrophotographic photosensitive member;

(b) a toner accommodating portion for accommodating the toner to be used by said developing roller;

(c) wherein said toner accommodating portion has a toner supply opening for supplying the toner accommodated therein to said developing roller;

(d) a toner seal for sealing said toner supply opening, said toner seal being pulled out prior to start of use of said developing cartridge, by which said toner supply opening is unsealed to permit supply of the toner accommodated in said toner accommodating portion to said developing roller; and (e) a side cover having a shaft support portion for rotatably supporting a shaft at one end of said developing roller, and a toner seal opening for directing said toner seal to outside when a toner supply opening of said toner accommodating portion is unsealed, and a guiding portion, provided at a side of said side cover that is inside when said side cover is mounted to a cartridge frame of said developing cartridge, for guiding the toner seal toward said toner seal opening when said toner seal is pulled out to unseal the toner supply opening, wherein one end of said developing roller is supported on said shaft support portion, and said toner seal is pulled through said toner seal opening.

13. A developing cartridge according to claim 12, wherein said side cover has an engaging portion for engaging with one end of a shaft of an application roller for depositing the toner on a peripheral surface of said developing roller.

14. A developing cartridge according to claim 12, wherein said side cover includes an urging force receptor portion for receiving urging force from an elastic member provided in the main assembly to be positioned in the main assembly when said developing cartridge is mounted to the main assembly, and a contact portion for limiting rotation of said developing cartridge by urging force received by said urging force receptor portion.

15. A developing cartridge according to claim 12, wherein said side cover includes a shaft mounting portion for mounting a shaft which functions as a center of rotation when said developing cartridge is mounted to the main assembly.

16. A developing cartridge according to claim 12, wherein said side cover is an integrally-molded member of plastic resin material.

17. A developing cartridge according to claim 12, wherein a gripping portion at one longitudinal end of said toner seal is of plastic resin material.

18. A developing cartridge according to claim 12, wherein said side cover includes a cover portion for covering a toner cap mounted to a toner filling opening for filling toner into said toner accommodating portion to seal said toner filling opening.

19. A side cover for a developing cartridge for developing a latent image formed on an electrophotographic photosensitive member, said developing cartridge being detachably mountable relative to an electrophotographic image forming apparatus, said developing cartridge including a developing roller, for developing a latent image formed on the electrophotographic photosensitive member; a toner accommodating portion for accommodating toner to be used for development by said developing roller, the toner accommodating portion being provided with a toner supply opening for supplying the accommodated toner to said developing roller; and a toner seal for sealing said toner supply opening, said toner seal being pulled out prior to start of use of said developing cartridge, by which said toner supply opening is unsealed to permit supply of the toner accommodated in said toner accommodating portion to said developing roller, said side cover comprising:

a shaft support portion for rotatably supporting a shaft at one end of said developing roller;

a toner seal opening for directing said toner seal to outside when a toner supply opening of said toner accommodating portion is opened;

an urging force receptor portion for receiving urging force from an elastic member provided in the main assembly to be positioned in the main assembly when said developing cartridge is mounted to the main assembly;

a contact portion for regulating rotation of said developing cartridge by the urging force received by said urging force receptor portion; and a shaft mounting portion for mounting a shaft which functions to provide a center of rotation when said developing cartridge is mounted to the main assembly.

20. A side cover according to claim 19, wherein said developing cartridge side cover is an integrally-molded member of plastic resin material.

21. A side cover according to claim 19, further comprising a gripping portion at one longitudinal end of said toner seal, said gripping portion being of plastic resin material.

22. A side cover according to claim 19, further comprising a cover portion for covering a toner cap mounted to a toner filling opening for filling the toner into said toner accommodating portion to seal said toner filling opening.

23. A side cover according to claim 19, further comprising a guiding portion, provided at a side of said side cover that is inside when said side cover is mounted to a cartridge frame of said developing cartridge, for guiding the toner seal toward said toner seal opening when said toner seal is pulled out to unseal the toner supply opening.

24. A mounting method for a developing cartridge side cover for a developing cartridge for developing a latent image formed on an electrophotographic photosensitive member, said developing cartridge being detachably mountable relative to a main assembly of an electrophotographic image forming apparatus, comprising:

(a) a developing frame preparing step of preparing a developing frame including a developing roller mounting portion for mounting a developing roller for developing a latent image formed on the electrophotographic photosensitive member;

(b) a toner frame preparing step of preparing a toner frame including a toner accommodating portion for accommodating toner to be used for development by said developing roller, wherein said toner accommodating portion has a toner supply opening for supplying the toner accommodated therein to said developing roller;

(c) a developing cartridge side cover preparing step of preparing a developing cartridge side cover having a shaft support portion for rotatably supporting a shaft at one end of said developing roller, a toner seal opening for directing said toner seal to outside, an urging force receptor portion for receiving urging force from an elastic member provided in the main assembly to be positioned in the main assembly when said developing cartridge is mounted to the main assembly, a contact portion for regulating rotation of said developing cartridge by the urging force received by said urging force receptor portion, and a shaft mounting portion for mounting a shaft which functions to provide a center of rotation when said developing cartridge is mounted to the main assembly;

(d) a coupling step of coupling said developing frame and said toner frame; and (e) a side cover mounting step of mounting said developing cartridge side cover to one longitudinal end of said developing frame and said toner frame, while said toner seal is extended from said toner seal opening to outside.

25. A method according to claim 24, wherein said developing cartridge side cover is fixed to said developing frame by screws.

26. A method according to claim 24, wherein said coupling step couples said developing frame and said toner frame by ultrasonic welding.

27. A method according to claim 24, wherein said coupling step couples said developing frame and said toner frame by snap fitting, and/or by snap clip.

28. A developing cartridge for developing a latent image formed on an electrophotographic photosensitive member, wherein said developing cartridge is detachably mountable to a main assembly of an electrophotographic image forming apparatus, said developing cartridge comprising:

(a) a developing roller for developing a latent image formed on the electrophotographic photosensitive member;

(b) a toner accommodating portion for accommodating the toner to be used by said developing roller;

(c) wherein said toner accommodating portion has a toner supply opening for supplying the toner accommodated therein to said developing roller;

(d) a toner seal for sealing said toner supply opening, said toner seal being pulled out prior to a start of use of said developing cartridge, by which said toner supply opening is unsealed to permit supply of the toner accommodated in said toner accommodating portion to said developing roller; and (e) a side cover having a shaft support portion for rotatably supporting a shaft at one end of said developing roller, a toner seal opening for directing said toner seal to outside when a toner supply opening of said toner accommodating portion is opened, an urging force receptor portion for receiving urging force from an elastic member provided in the main assembly to be positioned in the main assembly when said developing cartridge is mounted to the main assembly, a contact portion for regulating rotation of said developing cartridge by the urging force received by said urging force receptor portion, and a shaft mounting portion for mounting a shaft which functions to provide a center of rotation when said developing cartridge is mounted to the main assembly, wherein one end of said developing roller is supported on said shaft support portion, and said toner seal is pulled through said toner seal opening.

29. A developing cartridge according to claim 28, wherein said side cover has an engaging portion for engaging with one end of a shaft of an application roller for depositing the toner on a peripheral surface of said developing roller.

30. A developing cartridge according to claim 28, wherein said developing cartridge side cover is an integrally-molded member of plastic resin material.

31. A developing cartridge according to claim 28, further comprising a gripping portion at one longitudinal end of said toner seal, said gripping portion being of plastic resin material.

32. A developing cartridge according to claim 28, wherein said side cover further comprises a guiding portion, provided at a side of said side cover that is inside when said side cover is mounted to a cartridge frame of said developing cartridge, for guiding the toner seal toward said toner seal opening when said toner seal is pulled out to unseal the toner supply opening.

* * * * *

UNITED STATES PATENT AND TRADEMARK OFFICE

CERTIFICATE OF CORRECTION

PATENT NO. : 6,104,895

DATED : August 15, 2000

INVENTOR(S) : Kanji Yokomori, et al.

It is certified that error appears in the above-identified patent and that said Letters Patent is hereby corrected as shown below:

TITLE PAGE:

[30] "195030/1997" should read --9-195030-- and
"186154/1998" should read --10-186154--.

COLUMN 1:

Line 8, "a" (second occurrence) should read --an--;
Line 30, "with" should read --with a--;
Line 51, "as" should read --a--;
Line 52, "opposing" should read --opposite--; and
Line 58, "opposing" should read --opposite--.

COLUMN 3:

Line 52, delete "a showing of".

COLUMN 4:

Line 29, "FIG. 43 ((a), (b), (c), (d)) is" should read --FIGS. 43 ((a), (b), (c), (d)) are--.

COLUMN 6:

Line 66, "is constituted" should read --consists--.

UNITED STATES PATENT AND TRADEMARK OFFICE

CERTIFICATE OF CORRECTION

PATENT NO. : 6,104,895

DATED : August 15, 2000

INVENTOR(S) : Kanji Yokomori, et al.

It is certified that error appears in the above-identified patent and that said Letters Patent is hereby corrected as shown below:

COLUMN 8:
Line 16, "cartridge" should read --cartridges--;
Line 19, "an" should read --a--; and
Line 33, "rotate" should read --rotates--.

COLUMN 9:
Line 53, "tridge." should read --tridge--;
Line 66, "of" (second occurrence) should read --or--.

COLUMN 12:
Line 34, "(Shutter)" should read --¶(Shutter)--.

COLUMN 13:
Line 10, "(Installation)" should read --¶(Installation)--.

COLUMN 14:
Line 14, "surface," should read --surfaces,--; and
Line 67, "cartridge" (first occurrence) should read --cartridges--.

COLUMN 15:
Line 3, "handhold" should read --handheld--.

UNITED STATES PATENT AND TRADEMARK OFFICE

CERTIFICATE OF CORRECTION

PATENT NO. : 6,104,895

DATED : August 15, 2000

INVENTOR(S) : Kanji Yokomori, et al.

It is certified that error appears in the above-identified patent and that said Letters Patent is hereby corrected as shown below:

COLUMN 17:
Line 47, "projection" should read --projected--.

COLUMN 18:
Line 26, "a" should read --α-.

COLUMN 19:
Line 49, "a" should be deleted;
Line 50, "center of the flange is" should read --centers of the flanges are--; and
Line 66, "crosssection" should read --cross-section--.

COLUMN 20:
Line 6, "plate" should read --plates--;
Line 25, "faced to" should read --facing--;
Line 33, "is" should read --is an--; and
Line 36, "opposing" should read --opposite--.

UNITED STATES PATENT AND TRADEMARK OFFICE

CERTIFICATE OF CORRECTION

PATENT NO. : 6,104,895

DATED : August 15, 2000

INVENTOR(S) : Kanji Yokomori, et al.

It is certified that error appears in the above-identified patent and that said Letters Patent is hereby corrected as shown below:

COLUMN 21:

Line 18, "clockwisely" should read --clockwise--;
Line 23, "cartridge" should read --cartridges--;
Line 24, "is" should read --are--;
Line 27, "cartridge" should read --cartridges--;
Line 31, "cartridge" should read --cartridges– and "abuts" should read --abut--;
Line 32, "cartridge" should read --cartridges– and "is" should read --are--;
Line 35, "enters" should read --entered--;
Line 36, "cartridge" should read --cartridges--;
Line 37, "cartridge" should read --cartridges--;
Line 39, "is" should read --are--; and
Line 41, "cartridge" should read --cartridges--.

COLUMN 22:

Line 7, "of preparing" should read --to prepare--;
Line 10, "to" should be deleted;
Line 25, "a" (first occurrence) should be deleted;
Line 33, "a" should read --an--;
Line 35, "63*p*" should read --63P--;
Line 36, "63*p*" should read --63P--;
Line 39, "63*p*." should read --63P.--; and
Line 46, "constitutes" should read --constitute--.

UNITED STATES PATENT AND TRADEMARK OFFICE

CERTIFICATE OF CORRECTION

PATENT NO. : 6,104,895

DATED : August 15, 2000

INVENTOR(S) : Kanji Yokomori, et al.

It is certified that error appears in the above-identified patent and that said Letters Patent is hereby corrected as shown below:

COLUMN 23:

Line 14, "an end seal" should read --end seals--; and
Line 19, "seal" should read --seals--; and
"is" should read --are--.

COLUMN 24:

Line 12, "portion are" should read --portions are--;
Line 29, "(266)" should read --(23*b*)--;
Line 49, "is closer" should read --are closer to--; and
Line 53, "has" should read --have--.

COLUMN 25:

Line 25, "surface" should read --surfaces--;
Line 56, "member" should read --member 15--; and
Line 62, "In to" should read --Into--.

COLUMN 26:

Line 17, "comprising;" should read --comprising:--; and
Line 39, "member;" should read --member; and--.

COLUMN 27:

Line 16, "an" should be deleted; and
Line 55, "member" should read --member 15--.

UNITED STATES PATENT AND TRADEMARK OFFICE

CERTIFICATE OF CORRECTION

PATENT NO. : 6,104,895

DATED : August 15, 2000

INVENTOR(S) : Kanji Yokomori, et al.

It is certified that error appears in the above-identified patent and that said Letters Patent is hereby corrected as shown below:

COLUMN 28:

Line 12, "accommodation" should read --accommodating--; and
Line 36, "stepped" should be deleted.

COLUMN 29:

Line 66, "on" should read --in--.

COLUMN 31:

Line 63, "FIG. 30 ands 31," should read --FIGS. 30 and 31,--.

COLUMN 32:

Line 1, "inserted" should read --are inserted-- and "fits," should read --fit,--;
Line 10, "to" should be deleted;
Line 53, "member" should read --members--; and
Line 54, "as" should be deleted.

COLUMN 33:

Line 1, "member" should read --members--;
Line 27, "faced to" should read --facing--; and
Line 30, "to" should be deleted.

UNITED STATES PATENT AND TRADEMARK OFFICE

CERTIFICATE OF CORRECTION

PATENT NO. : 6,104,895

DATED : August 15, 2000

INVENTOR(S) : Kanji Yokomori, et al.

It is certified that error appears in the above-identified patent and that said Letters Patent is hereby corrected as shown below:

COLUMN 35:

Line 5, "use's" should read --user's--;
Line 9, "the" should be deleted; and
Line 34, "width)." should read --width)).--.

COLUMN 36:

Line 56, "to" should be deleted; and
Line 62, "to" should be deleted.

COLUMN 37:

Line 3, "lid," should read --11d,--;
Line 17, "the" (third occurrence) should read --the side surface--;
Line 27, "rectangular" (second occurrence) should read --rectangular shape;
Line 51, "portion" should read --portion; and--;
Line 55, "mounted" should read --mounted to--;
Line 59, "tion;" should read --tion,--; and
Line 64, "an" should be deleted and "of" (second occurrence) should be deleted.

UNITED STATES PATENT AND TRADEMARK OFFICE

CERTIFICATE OF CORRECTION

PATENT NO. : 6,104,895

DATED : August 15, 2000

INVENTOR(S) : Kanji Yokomori, et al.

It is certified that error appears in the above-identified patent and that said Letters Patent is hereby corrected as shown below:

COLUMN 38:
Line 57, "to" should be deleted.

COLUMN 39:
Line 31, "functions an" should read --functions as a--;
Line 32, "The" should read --The developing bias--;
Line 34, "as" should read --as an--;
Line 47, "no" should be deleted; and
Line 51, "re" should read --are--.

COLUMN 40:
Line 6, "to and" should read --to be--;
Line 28, "of the lower, and" should read --and the lower--; and
Line 29, "bend" should read --bent--;

COLUMN 41:
Line 6, "at" should read --on--;
Line 27, "to" (first occurrence) should be deleted; and
Line 57, "its" should read --it is--.

COLUMN 42:
Line 20, "63A;" should read --63A; and--.

UNITED STATES PATENT AND TRADEMARK OFFICE

CERTIFICATE OF CORRECTION

PATENT NO. : 6,104,895

DATED : August 15, 2000

INVENTOR(S) : Kanji Yokomori, et al.

It is certified that error appears in the above-identified patent and that said Letters Patent is hereby corrected as shown below:

COLUMN 43:

Line 29, "aid" should read --said--;
Line 34, "griping" should read --gripping--; and
Line 55, "roller" should read --roller;--.

COLUMN 44:

Line 17, "the photosensitive" should read--an electrophotographic photosensitive--;
Line 22, "an" should read --the--;
Line 25, "roller;" should read --roller,--;
Line 26, "(c) wherein" should read --wherein--;
Line 29, "(d) a toner" should read --(c) a toner--; and
Line 35, "(e) a side" should read --(d) a side--.

UNITED STATES PATENT AND TRADEMARK OFFICE

CERTIFICATE OF CORRECTION

PATENT NO. : 6,104,895

DATED : August 15, 2000

INVENTOR(S) : Kanji Yokomori, et al.

It is certified that error appears in the above-identified patent and that said Letters Patent is hereby corrected as shown below:

COLUMN 46:

Line 52, "roller;" should read --roller,--;
Line 54, "(c) wherein" should read --wherein--;
Line 57, "(d) a toner" should read --(c) a toner--; and
Line 63, "(e) a side" should read --(d) a side--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*